US008474066B2

(12) United States Patent
Kato

(10) Patent No.: US 8,474,066 B2
(45) Date of Patent: Jul. 2, 2013

(54) PAIR OF PANTS WITH THE L POCKET

(75) Inventor: Koji Kato, Hashima (JP)

(73) Assignee: Koji Kato, Gifu-Ken (JP)

( * ) Notice: Subject to any disclaimer, the term of this patent is extended or adjusted under 35 U.S.C. 154(b) by 0 days.

(21) Appl. No.: 13/366,877

(22) Filed: Feb. 6, 2012

(65) Prior Publication Data

US 2012/0144559 A1 Jun. 14, 2012

Related U.S. Application Data

(62) Division of application No. 12/105,604, filed on Apr. 18, 2008, now Pat. No. 8,176,571.

(30) Foreign Application Priority Data

Apr. 27, 2007 (JP) ..... 2007-117985

(51) Int. Cl.
*A41F 9/00* (2006.01)

(52) U.S. Cl.
USPC ..... 2/237

(58) Field of Classification Search
USPC ..... 2/247–254, 235, 236, 237
See application file for complete search history.

(56) References Cited

U.S. PATENT DOCUMENTS 2,024,922 A 12/1935 Julius
2,525,060 A 10/1950 Axler
2,526,813 A 10/1950 Fanning
2,684,486 A 7/1954 Purves
3,097,365 A 7/1963 Zins
3,098,238 A 7/1963 Diamond
3,438,061 A 4/1969 Goldberg
3,638,242 A 2/1972 Herter
3,800,332 A 4/1974 Forrest
3,812,541 A 5/1974 Stuart
3,839,740 A 10/1974 Tornberg (Continued)

FOREIGN PATENT DOCUMENTS

CN 1114166 A 1/1996
CN 1526333 A 9/2004

(Continued)

OTHER PUBLICATIONS

Search Report issued by the UK Intellectual Property Office in corresponding GB 0806754.8, Jun. 30, 2008.

(Continued)

*Primary Examiner* — Alissa L Hoey
(74) *Attorney, Agent, or Firm* — Buchanan Ingersoll & Rooney PC

(57) ABSTRACT

The cotton pants 1 as a pair of pants with the L pocket is that the front and the reverse edge 3Ab of the storing part 3A is perpendicular against the length direction of the belt part 3. Also because the upper edge of the raw fabric which does not have the rectangle expansion and contraction inside the elongating part 3B is sewn on and the lower edge of the raw fabric which does not have expansion and contraction is sewn on the lower edge of the belt part 3, one part of the raw fabric 6 which does not have expansion and contraction can be seen even if the one who wears it turns over the lower edge of the elongating part 3B by curiosity and the inner structure of the stretch stopper material 11 etc. can not be seen.

3 Claims, 34 Drawing Sheets

U.S. PATENT DOCUMENTS

| | | | | |
|---|---|---|---|---|
| 4,193,136 | A | 3/1980 | Pierce | |
| 4,583,478 | A * | 4/1986 | Bassetti | 112/413 |
| 4,596,055 | A | 6/1986 | Aach et al. | |
| 5,544,366 | A | 8/1996 | Kato | |
| 6,880,175 | B2 | 4/2005 | Tajima et al. | |
| 6,986,165 | B2 | 1/2006 | Neff et al. | |
| 7,512,994 | B2 | 4/2009 | Kato | |
| 8,176,571 | B2 * | 5/2012 | Kato | 2/237 |
| 2008/0301855 | A1 | 12/2008 | Ball | |
| 2009/0126080 | A1 | 5/2009 | Kato | |
| 2009/0320182 | A1 | 12/2009 | Schmalz et al. | |

FOREIGN PATENT DOCUMENTS

| | | | |
|---|---|---|---|
| DE | 202 11 959 | U1 | 9/2002 |
| EP | 1 623 639 | A1 | 2/2006 |
| FR | 2 692 113 | A1 | 12/1993 |
| FR | 2 904 196 | A1 | 2/2001 |
| GB | 560470 | | 4/1944 |
| JP | 52-168614 | | 12/1977 |
| JP | 54-69008 | U | 5/1979 |
| JP | 2518804 | B2 | 5/1996 |
| JP | 2578079 | B2 | 11/1996 |
| JP | 09-268405 | A | 10/1997 |
| JP | 11-181604 | A | 7/1999 |
| JP | 3073523 | U | 9/2000 |
| JP | 2001-226804 | A | 8/2001 |
| JP | 2002-105711 | A | 4/2002 |
| JP | 2004-308049 | A | 11/2004 |
| JP | 3789663 | B2 | 4/2006 |

OTHER PUBLICATIONS

Official Action dated Apr. 12, 2011, issued by the Japanese Patent Office in corresponding Japanese Patent Application No. 2007-117985.

Chinese Official Action dated Aug. 21, 2012 issued in the corresponding Chinese Patent Application No. 201010004494.2.

* cited by examiner

FIGT. 19a
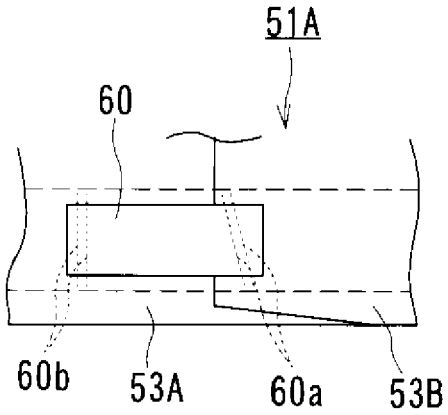
FIGT. 19b
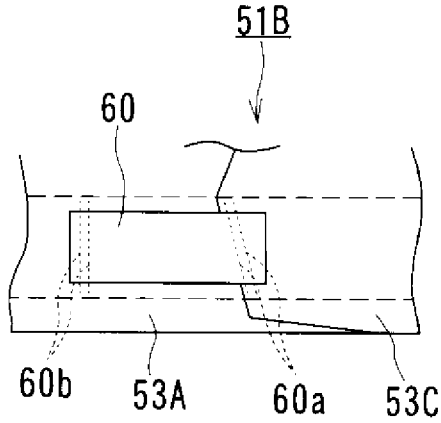
FIGT. 19c
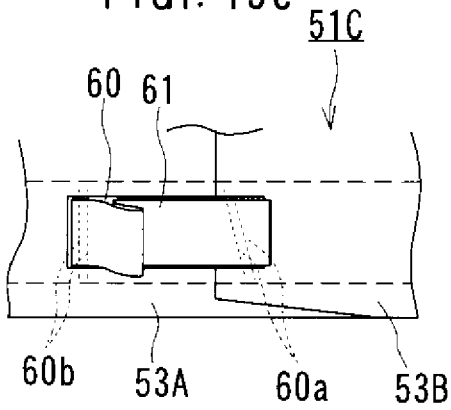
FIGT. 19d
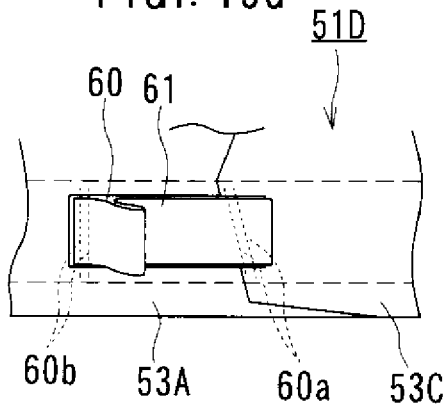

PAIR OF PANTS WITH THE L POCKET

BACKGROUND OF THE INVENTION

1. Field of the Invention

This invention is regarding a garment which are having the waist part which has a doubled part by a pocket, that is a pair of pants which is being capable of expansion and contraction on a waist size of a pair of pants (trousers), a skirt and the culottes skirt, etc. (hereinafter referred to as a pair of pants'), especially refers to a casual pair of pants having the L pocket at the side part of the front surface such as a pair of Jeans (a pair of jean pants and denims), a pair of cotton pants and a pair of chinos and a formal and dressy pair of pants that is not casual which have the L pocket.

2. Description of the Related Art

Generally speaking, the belt part size of the manufactured pair of pants such as a pair of pants, for example, is set by the designated intervals as 69 cm, 72 cm, or 75 cm and the purchasers choose the closest and the best size to the own size to buy and wear it by correcting it to the own best size or by reforming with a leather belt. However there are issues that the correcting process is necessary in case of correction of the belt size and it takes time and cost, reforming by the Leather belt causes the wrinkles around the belt part of a pair of pants which is not desirable as the design, moreover the ease of comfort when wearing is not as pleasant.

Hereupon, assuming these are solved, the engineering such as the patented invention which is stated in The Japanese Patent No. 2578079 and The Japanese Patent No. 2518804 taking part in the invention of this inventor. To be more precise, it is to make the best size capable of expansion and contraction by interfering the elastic material such as a rubber at the belt size and a part of front of a pair of pants and moreover, this inventor improved these patent inventions and invented regarding the structure of the waist size of the garment which is able to stretch smoothly being capable of expansion and contraction as well as improving the outward appearance even when the gap formed to make it capable of expansion and contraction is expanded. And this inventor applies for a patent on this invention.

The Japanese Laid Open Patent Publication No. 2001-226804 shows the engineering, it does not lower the product image by that the padding material of the waist area being visible because the elongating part that is inserted in the storing part by the elasticity of the primary elastic material contacts only with the Lining of the storing part so that the contact resistance lowers and the smooth movement between the elongating part and the storing part becomes possible and the Lining is attached interior of the storing part seen from the front side and the reverse side of the storing part.

Regarding these inventions, all are indicated as one of the embodiments of a case that a borderline between the elongating part and the storing part is brought to the side pocket of the formal pants. However, for Jeans that The L pocket is attached on the front and mainly a casual pair of pants such as a cotton pair of pants, as it's shown in FIG. 33*a* as well as these inventions, problems as following occur when positioning the borderline of the elongating part 103B and the storing part 103A t the side near the front center FC of The L pocket 102.

Hereupon, FIG. 33*a* is the partial enlarged drawing shown from the front indicating around the L pocket of pants which has The L pocket adopted structure which is capable of expansion and contraction of waist size.

FIG. 33*b* is partial enlarged drawing shown from reverse indicating around the L pocket before sewing on the elongating part.

FIG. 33*c* is partial enlarged drawing shown from reverse indicating around The L pocket after sewing on the elongating part and the storing part.

As shown in FIG. 33*b*, the L pocket saccate cloth 105 is sewing on back of pants 101 which has The L pocket 102. If borderline of the elongating part 103B and the storing part 103A on front side is extended straight to reverse side, the saccate cloth 105 projects from the borderline on reverse side and outward appearance gets worse. Also who wears it tuck up the Lower end of the elongating part 103B with curiosity, interior structure such as primary elastic material 110 etc. can be seen, therefore the edge of the storing part 103A to be projected diagonally as covering the saccate cloth 105.

Due to this, the reverse side of pants 101 does not lose the outward appearance, however as shown in FIG. 33*c*, only part 106 needs to be sewn manually to avoid sewing the saccate cloth 105 on to the elongating part 103B when sewing the elongating part 103B and the storing part 103A on to the reverse side. Because it can not be machine-sewed, it takes effort and loses mass production of the mass-produced casual pants 101.

Besides, as shown in FIG. 34*a* and FIG. 34*b*, the belt cloth stick 103*a* and 103*b* are conducted to casual pants 101 which has the L pocket 102, therefore the edge of 103B against the storing part 103A is thin as it is easy to rub and move. When the waist of pants 101 stretches and the elongating part 103B is pulled out from the storing part 103A, the elongating part 103B slips down to downward direction as the arrow shows, therefore there was an issue which lose outward appearance upper end of the elongating part 103B and the storing part 103A.

This issue, as shown in FIG. 34*c* and FIG. 34*d*, can be solved by making the elongating part 103B, as shown by the arrow, to go upward when the elongating part 103B is pulled out while rubbing and moving against the storing part 103A, the step is not occurred between upper edge and the edge of the storing part 103A and the outward appearance improves.

Hereupon, FIG. 34*a* and FIG. 34*b* are diagrams which indicate the issue areas in the event of the elongating part to be pulled out as the elongating part of pants which have the L pocket, adopted the structure of being capable of expansion and contraction on waist size, is rubbed and moved against the storing part. FIG. 34*c* and the FIG. 34*d* are the diagrams which indicate a solution of the issue in the event of the elongating part to be pulled out as the elongating part of pants which have the L pocket is adopted the structure of being capable of expansion and contraction on waist size, is rubbed and moved against the storing part.

Moreover, as shown in FIG. 33*b* and FIG. 33*c*, if 105*a*, the edge part 105*a* of the saccate cloth 105, is looped up to the upper end, the upper end of the saccate cloth 105 gets pulled following by rubbing of the elongating part 103B when the elongating part 103B stretches against the storing part 103A round the waist of the pants 101. As a result, the Left edge of the Fig. of the front bodice 104 (The edge near the L pocket 102 side by seeing from the front) which the upper end of the saccate cloth 105 is sewn on so that the outward appearance around the L pocket 102 worsen.

Accordingly, to prevent this, as shown in FIG. 35*a*, by conducting piping 106A after dividing the upper edge of 105A where is the edge part of the saccate cloth 105A, only internal upper edge of the saccate cloth 105A gets pulled following rubbing and moving of the elongating part 103B which means the Left edge in Fig. of 104 front bodice which the outer upper edge of the saccate cloth 105A does not get pulled and this part does not go tight. Therefore a fine outward appearance can be kept even by seeing from the front side.

However, even when conducting the piping 106A s shown in FIG. 35*b*, in case that the piping is conducted by expanding the piping 100*a* after dividing the raw fabric upper end of the saccate cloth 105A by putting the slit 100*a*, closer the stitch 106*a* gets to the slit 100*a* edge 100*b*, closer it gets to the slit 100*a* edge and less the stitch 106*a* margin as it goes lower of piping 106A. The strength of 106*b*, the Lower part of the piping 106A, gets weak and by wearing the pants 101A which has The L pocket 102 for a long period of time and repeating laundering a number of times, there is a case that the piping 106A comes off because the stitch 106*a* of lower part 106*b* gets undone, so there was concern that the saccate cloth 105A tears from divided part 100*a*.

Hereupon, FIG. 35*a* is a partially enlarged drawing which shows around the L pocket from the reverse before sewing on to the elongating part and the storing part of the pants which has the L pocket which adopted the structure that is capable of expansion and contraction for a waist size.

FIG. 35*b* is a diagram which shows issues when conducting the piping on the L pocket saccate cloth.

These issues are the deformation of the L pocket which are shown in FIG. 36*a* and FIG. 36*b* and it was the same on 104B which is the Letter S shaped line (the peripheral area), the Letter S shaped pocket 102B which has 104C, a pair of pants 101B which is equipped with 102C and 101C. Also the straight line (peripheral area) 104D which is the deformation of the L pocket as it is shown in FIG. 36*c* and FIG. 36*d*, the pocket 102D which has 104E, a pair of pants 101D which is equips 102E and 101E were the same.

More, FIG. 36*a* and FIG. 36*b* are the diagrams which show the pocket which has the Letter S shaped line and it is a kind of the L pockets.

FIG. 36*c* and FIG. 36*d* are the diagrams which show the pocket which has straight line and it is a kind of The L pockets.

Regarding the range of this specification and the patent application, both generally called the Letter S pocket which has the Letter S shaped line as it is shown in FIG. 36*a* and FIG. 36*b*, and also the pocket which has the straight line as it is shown in FIG. 36*c* and FIG. 36*d* are kinds of The L pockets, so those are recognized as being included in 'The L pocket'. And a pair of pants with the L pocket' includes a pair of pants which has pocket which has the straight line that is shown in the FIG. 36 (*c*) and the FIG. 36 (*d*).

BRIEF SUMMARY OF THE INVENTION

Thereupon, regarding this invention, the subject which supplies a pair of pants with The L pocket which is capable of expansion and contraction of waist size by positioning the borderline of the elongating part and the storing part to the side near the front center of The L pocket keeping the outward appearance and the beauty and not losing the mass production is set.

Also, regarding this invention, the subject which a pair of pants with the L pocket which is able to improve the outward appearance by not making aware of step between the elongating part and the storing part by making the elongating part to go up when the waist area stretches the elongating part to rub and move against the storing part.

Moreover, regarding this invention, the subject that supplies a pair of pants with The L pocket that does not lose the beauty by pulling around the L pocket when wearing it, and also that resists repetition of laundering or long-hour wearing by maintaining the strength of the saccate cloth of The L pocket is also set.

According to a first aspect of the invention, there is provided a pair of pants with the L pocket which has a structure which is capable of expansion and contraction around the waist area that an apparent length of a belt part is made to be capable of expansion and contraction by connecting a primary elastic material to the belt part which has a padding material comprising a doubled part which is positioned near the outer edge close to the front center of the mentioned above L pocket, a elongating part which is formed at the mentioned above belt part that the one edge elongates one side of the belt part side of such doubled part, a storing part which is formed at the other belt part side of the mentioned above doubled part, and the primary elastic material that the both edges are connected between the mentioned above elongating part and the mentioned above storing part, and to put the both the front and the reverse of the edge of the mentioned above storing part perpendicularly against the stretching direction and also to sew the upper edge of the raw fabric which does not have an expansion and contraction inside the mentioned above elongating part from the edge of the reverse side of the mentioned above storing part up to the edge close to the front center of the saccate cloth of the mentioned above L pocket and it characterizes that the lower edge of the raw fabric which does not have the mentioned above expansion and contraction is sewn on to the lower edge of the mentioned above elongating part.

Hereupon, as 'The raw fabric which does not have expansion and contraction', there are the raw fabrics such as polyester and nylon etc., and these raw fabrics are had recourse to part such as lining, sleek (the saccate cloth of the Jeans' The L pocket), ribbon and tape.

Thus, the doubled part of the elongating part which structures the capability of expansion and contraction around waist area and the storing part positions near the outer edge close to the front center of the L pocket, so the edge of the storing part turns to appearance which connects to outer edge close to the front center of the L pocket smoothly and the beauty can be kept even by not hiding the edge of the storing part.

Also the edge of the storing part on the front and the reverse side to be put perpendicularly against the stretching direction of the belt part and sewn the upper edge of the raw fabric which does not have expansion and contraction inner the elongating part, due to this, all the sewing processes can be done by sewing machine and guarantee mass productivity.

Then because the inner elongating part and the lower edge of the belt part are connected by raw fabric which does not have expansion and contraction, even the one who wears intends to turn the Lower edge of the elongating part which is not sewn over by curiosity, inner structure can not be seen and only a part of raw fabric can be seen, so a situation which the one who wears it pulling out the structure of the primary elastic material and destroys the structure of capability of expansion and contraction can definitely be prevented. Thus, regarding a pair of pants with the L pocket which is the result of this invention, to add structure of expansion and contraction around waist area to a pair of pants with the L pocket which were previously thought to be impossible made it possible by simple structure.

Thus, it is a pair of pants with the L pocket which does not lose mass productivity, keep the outward appearance and beauty finely, positioning the borderline of the elongating part and the storing part at the side close to the front center of the L pocket and make the waist size capable of expansion and contraction.

According to a second aspect of the invention, there is provided a pair of pants with the L pocket which has a structure which is capable of expansion and contraction around the waist area that an apparent length of a belt part is made to be capable of expansion and contraction by connecting a primary elastic material to the belt part which has a padding material comprising a doubled part which is positioned near the outer edge close to the front center of the mentioned above L pocket, a elongating part which is formed at the mentioned above belt part that the one edge elongates one side of the belt part side of such doubled part, a storing part which is formed at the other belt part side of the mentioned above doubled part, and the primary elastic material that the both edges are connected between the mentioned above elongating part and the mentioned above storing part, and above storing part is put perpendicularly against the stretching direction of the mentioned above belt part and also the both sided adhesive core is put inside the cuff part of the mentioned above elongating part and is pressed with an iron to adhere the cuff part of the mentioned above elongating part and at the one side of the belt part side of such doubled part which the both edges are connected between the mentioned above elongating part and the mentioned above storing part.

Thus, the doubled part of the elongating part which structures the capability of expansion and contraction around waist area and the storing part positions near the outer edge close to the front center of the L pocket, so the edge of the storing part turns to the appearance which connects to outer edge close to the front center of The L pocket smoothly and the beauty can be kept even by not hiding the edge of the storing part.

Also the edge of the storing part on the front and the reverse side to be put perpendicularly against the stretching direction and connecting the cuff part of the elongating part by both sides adhesive padding, all the sewing operations can be done by the sewing machine and guarantee the mass productivity.

Then because the cuff part of the elongating part is connected to the inner cuff part of the elongating part by joining with ironing iron press, even the one who wears it tries to turn the lower edge of the part which is not sewn the elongating part over by curiosity, the one can not see the inner structure and can only see a part of the reverse side of lower the elongating part of both side adhesive padding. It definitely can prevent the situation that the one who wears it pulls out the inner structure and destroys the structure of capability of expansion and contraction.

Thus, it becomes a pair of pants with the L pocket which is capable of expansion and contraction of waist size by positioning the borderline of the elongating part and the storing part at the side close to the front center of the L pocket keeping the outward appearance and beauty and not losing the mass productivity.

According to a third aspect of the invention, there is provided a pair of pants with the L pocket which has a structure which is capable of expansion and contraction around the waist area that an apparent length of a belt part is made to be capable of expansion and contraction by connecting a primary elastic material to the belt part which has a padding material comprising a doubled part which is positioned near the outer edge close to the front center of the mentioned above L pocket, a elongating part which is formed at the mentioned above belt part that the one edge elongates one side of the belt part side of such doubled part, a storing part which is formed at the other belt part side of the mentioned above doubled part, and the primary elastic material that the both edges are connected between the mentioned above elongating part and the mentioned above storing part, and the mentioned above elongating part diagonally as the mentioned above elongating part is pulled out to the diagonal to the upper when the mentioned above elongating part is pulled out from the mentioned above storing part.

Thus, the doubled part of the elongating part which structures the capability of expansion and contraction around waist area and the storing part positions near the edge close to the front center of the L pocket, so the edge of the storing part turns to appearance which connects to outer edge close to the front center of the L pocket smoothly and the beauty can be kept even by not hiding the edge of the storing part.

Also, by sewing the edge of the primary elastic material on the edge of the elongating part diagonally as the elongating part to be pulled up diagonally, when apparent length of the belt part extends and the elongating part is pulled out the storing part, the elongating part gets pulled up diagonally so that the step between the elongating part and the storing part will not be felt so that the outward appearance remarkably improves.

Thus, regarding a pair of pants with the L pocket which has the structure that is capable of expansion and contraction around waist area which is capable of expansion and contraction of the apparent length of the belt part, by making the elongating part to raise when waist area stretches by rubbing and moving against the storing part, the step between the elongating part and the storing part will not be concerned and the outward appearance improves.

According to a fourth aspect of the invention, there is provided a pair of pants with the L pocket which specifies that the upper cuffs part of the mentioned above front center side edge of the mentioned above L pocket saccate cloth and was processed slash along with the divided part.

By dividing the upper cuff part such as making slit when folding the raw fabric of the saccate cloth at the front center side of a pair of pants with the L pocket, it can effectively prevent from occurring wrinkles around the L pocket seeing from the front when shrinking waist area of a pair of pants with The L pocket. That is by dividing the upper part of the cuff part at the front center side edge of the L pocket saccate cloth and managing slash to prevent a fray from the divided part, the pulling force which gets hooked to the L pocket saccate cloth when the waist area of a pair of pants with The L pocket can be released by opening and closing the divided part, so it can prevent getting wrinkles around the L pocket or getting bent the L pocket corner because the pulling force affects to the front side.

Thus, adding to the effect which is written above, it becomes a pair of pants with the L pocket by effectively avoiding to occur wrinkles around the L pocket seen from the front when waist area expands and contracts and by not losing the outward appearance and beauty and positioning the borderline between the elongating part and the storing part at the side close to the front center of the L pocket to be capable of expansion and contraction.

According to a fifth aspect of the invention, there is provided a pair of pants with the L pocket which specifies that the upper cuffs part of the mentioned above front center side edge of the mentioned above L pocket saccate cloth and was applied a piping along with the divided part then was formed the mentioned above saccate cloth by sewing the cuffs of said piping and turning inside out.

By dividing the upper cuff part such as making slit when folding the raw fabric of the saccate cloth at the front center side of a pair of pants with the L pocket, it can effectively prevent from occurring wrinkles around the L pocket seeing from the front when shrinking waist area of a pair of pants with the L pocket. That is, by dividing the upper part of the cuff part at the front center side edge of the L pocket saccate cloth and conducting piping along with the divided area, the pulling force which gets hooked to the L pocket saccate cloth when the waist area of a pair of pants with the L pocket can be released by opening and closing the divided part, so it can prevent getting wrinkles around the L pocket or getting bent the L pocket corner the pulling force affects to the front.

Moreover, by conducting the piping along with the divided area, parts which piping was conducted touch when the divided area opens and closes, so it slips better and opening and closing become smoother.

And by pick sewing and reversing the cuff part of the piping and the saccate cloth to be sewn on, the cuff part of the piping strengthen so that even though a force works on the cuff part of the piping by wearing it for long period of times of repeating laundering, the cuff part of piping does not touch.

Thus, adding to the effect which is written above, it becomes a pair of pants with the L pocket which is capable of expansion and contraction of waist size by effectively preventing to occur wrinkles around the L pocket seen from the front when waist area expands and contracts and not losing the outward appearance and beauty and positioning the borderline between the elongating part and the storing part at the side close to the front center of the L pocket.

According to a sixth aspect of the invention, there is provided a pair of pants with the L pocket which specifies to leave the upper patched part of the mentioned above front center side edge of the mentioned above L pocket saccate cloth unpatched and apart.

By leaving divided the only upper part of the connecting area when connecting the raw fabric of the saccate cloth at the front center side of a pair of pants with The L pocket, it can effectively prevent to be occurred wrinkles around the L pocket seen from the front when waist area of a pair of pants with the L pocket expands and contracts.

That is, by leaving not connecting only the upper part of the connecting area of the front center side edge of the L pocket saccate cloth, the pulling force which gets hooked to the L pocket saccate cloth can be released by divided area to open and close when waist area of a pair of pants with the L pocket expands and contracts, so that can prevent to wrinkle around the L pocket or bend the corner of The L pocket as the pulling force affects to the front side.

Thus, adding to the effect which is written above, it becomes a pair of pants with the L pocket which is capable of expansion and contraction of the waist size by effectively preventing to occur wrinkles around the L pocket seen from the front when waist area expands and contracts and not losing the outward appearance and beauty and positioning the borderline between the elongating part and the storing part at the side close to the front center of the L pocket.

According to a seventh aspect of the invention, there is provided a pair of pants with the L pocket which specifies that the tuck is formed at the upper part of the cuffs on the mentioned above front center side edge of the mentioned above L pocket saccate cloth.

By forming tuck at the upper cuff part when folding the raw fabric of the saccate cloth at the front center side of a pair of pants with The L pocket, it effectively prevent to occur wrinkles around the L pocket seen from the front when waist area of a pair of pants with The L pocket expands and contracts.

That is, by forming a tuck on the upper part of the cuff area on the front center side edge of the L pocket saccate cloth, the pulling force which takes to the L pocket saccate cloth is released by opening and closing of the tuck when waist area of a pair of pants with the L pocket expands and contracts, so that can prevent to wrinkle around the L pocket or bend the corner of the L pocket as the pulling force affects to the front side.

Thus, adding to the effect written above, it becomes a pair of pants with the L pocket which effectively prevents causing wrinkles around the L pocket seen from the front when waist area stretches and losing the outward appearance and beauty and which is capable of expansion and contraction of waist size by positioning the borderline of the elongating part and the storing part at the side close to the front center of the L pocket.

According to an eighth aspect of the invention, there is provided a pair of pants with the L pocket which specifies that the width of the mentioned above pleats of the tuck are larger than the elastic portion because of the elastic structure around the mentioned above waist area.

Thus, adding to the effect written above, it becomes a pair of pants with the L pocket which is capable of expansion and contraction of waist size by effectively preventing to occur wrinkles around the L pocket seen from the front when waist area expands and contracts and not losing the outward appearance and beauty and positioning the borderline between the elongating part and the storing part at the side close to the front center of the L pocket.

According to a ninth aspect of the invention, there is provided a pair of pants with the L pocket which has a structure which is capable of expansion and contraction around the waist area that an apparent length of a belt part is made to be capable of expansion and contraction by connecting a primary elastic material to the belt part which has a padding material comprising a doubled part which is positioned near the outer edge close to the front center of the mentioned above L pocket, a elongating part which is formed at the mentioned above belt part that the one edge elongates one side of the belt part side of such doubled part, a storing part which is formed at the other belt part side of the mentioned above doubled part, and the primary elastic material that the both edges are connected between the mentioned above elongating part and the mentioned above storing part, and the mentioned above saccate cloth is formed by that the upper part of the edge close to the front center of the mentioned above saccate cloth if divided to conduct the piping to such divided part and the cuff part of such piping is pick sewn and reversed to form the mentioned above saccate cloth.

Thus by pick sewing the cuff part of the piping and reversing to sew on the saccate cloth, the cuff part of the piping strengthen and wearing of long period of the time and repeating laundering do not undo the cuff part of the piping Then because the piping is conducted at the divided area which is the upper edge close to the front center of the saccate cloth, only inner of the upper edge of the saccate cloth gets pulled by rubbing and moving of the elongating part and the Left edge of the front bodice which only the outer side of the upper of the saccate cloth is sewn does not get pulled so that this part does not go tight so that the dine outward appearance can be kept even in case of seeing from the front side.

Thus, it becomes a pair of pants with the L pocket which keeps the strength of the L pocket saccate cloth and resists the repeated laundering and which does not lose beauty by going right around the L pocket when wearing it.

According to a tenth aspect of the invention, there is provided a pair of pants with the L pocket which specifies that the cuffs near the front center of the mentioned above saccate cloth was shifted as wide as the mentioned above piping to inner than the mentioned above divided part when forming the mentioned above saccate cloth.

Due to this, even when seeing a pair of pants with the L pocket from the reverse side, the piping can not be seen because it hides inside the cuff part close to the front center of the saccate cloth, so the outward appearance improves much more. Also even pulling out the elongating part from the storing part at the condition seeing a pair of pants with the L pocket from the reverse side, the side which is sewn on the elongating part of the piping only moves to the cuff part of the saccate cloth, so piping can not be seen.

Thus, it becomes a pair of pants with the L pocket which the outward appearance improves much more when they are displayed on the shelf as merchandise, which resists wearing for long period of time and repeating laundering keeping the strength of the saccate cloth of the L pocket and which does not lose beauty by going tight around the L pocket when wearing it.

According to an eleventh aspect of the invention, there is provided a pair of pants with the L pocket which has a structure which is capable of expansion and contraction around the waist area that an apparent length of a belt part is made to be capable of expansion and contraction by connecting a primary elastic material to the belt part which has a padding material comprising a doubled part which is positioned near the outer edge close to the front center of the mentioned above L pocket, a elongating part which is formed at the mentioned above belt part that the one edge elongates one side of the belt part side of such doubled part, a storing part which is formed at the other belt part side of the mentioned above doubled part, and the primary elastic material that the both edges are connected between the mentioned above elongating part and the mentioned above storing part, and the saccate cloth of the L pocket that is formed by connecting the cuff part of the edge of the mentioned above front center side of the saccate cloth of the mentioned above L pocket, is left at the condition that the upper part of the mentioned above cuff part apart without connecting and is conducted the piping along with the apart part then the cuff part of such piping is pick sewn and reversed to form the mentioned above saccate cloth.

Thus, regarding the saccate cloth of the L pocket which is formed by connecting the cuff part of the front center side edge of the saccate cloth of the L pocket, in such case by leaving the upper part of the cuff part apart not connecting and conduct piping along with the divided area, the cuff part of the piping will not be released because the cuff part of the piping is strengthened by sewing on the saccate cloth by pick sewing the cuff part of the piping then reversing so that even if force works on the cuff part of the piping by wearing for a long period of time and repeating laundering.

Then because the upper part of the edge close to the front center side of the saccate cloth of the L pocket is left apart not connecting it and the piping is conducted along with the apart part, only inner side of the upper end of the saccate cloth gets pulled as the elongating part rubs and moves and the Left edge of the front bodice which the outer side of the upper edge of the saccate cloth is sewn is not pulled so that this part does not go tight and fine outward appearance can be kept even by seeing from the front side.

Thus, it becomes a pair of pants with the L pocket which does not lose beauty by going tight around the L pocket when wearing it and also keeps the strength of the saccate cloth of the L pocket and resists wearing for a long period of time and repeating laundering.

According to a twelfth aspect of the invention, there is provided a pair of pants with the L pocket which specifies when sewing on the mentioned above L pocket saccate cloth parallel to the outer edge of the mentioned above L pocket, put up the upper part of the mentioned above outer edge perpendicularly to the mentioned above belt part and also compress and press the mentioned above outer edge center part from the reverse side at the condition of shrinkage to the Length direction, then sew on or stick over the fabric which has an elasticity along with the reverse side as the band shape.

Hereupon, as 'The raw fabric which does not have expansion and contraction', there are raw fabrics such as a power net, a spanlex, a tricot, a knit raw fabric, a polyurethane mixed raw fabric which mixes the polyurethane from 1% to 30%, a cotton stretch, a stretch lace, a bias tape (lining, tricot etc.), a rubber tape, a stretch satin etc.

Thus, because the raw fabric which has expansion and contraction over it after pressing (e.g. by iron etc.) is sewn on or stuck at the shape of belt from the reverse side at the condition of shrinking the outer edge center to the Length direction, the upper outer edge part of the L pocket also gets pulled to the front center direction when wait area stretched by the structure which is capable of expansion and contraction around waist and the elongating part moves to the direction of pulling out from the storing part. However as it was mentioned above the outer edge center part is capable of expansion and contraction so it stretches and follows smoothly and the outward appearance won't be lost by getting existed wrinkles around the L pocket.

And when the force to stretch around waist is released, the elongating part again moves to the stored direction into the storing part by the primary elastic material which the both edges are connected between the elongating part and the storing part, in this case also it returns to the existed condition beautifully because it shrinks and follows smoothly due to the structure which is capable of expansion and contraction at the outer edge center part of the L pocket.

Thus, it becomes a pair of pants with the L pocket which is capable of expansion and contraction of waist size by positioning the borderline between the elongating part and the storing part at the side close to the front center of the L pocket without losing the outward appearance and beauty.

According to a thirteenth aspect of the invention, there is provided a pair of pants with the L pocket which specifies that to put the mentioned above outer edge upper part perpendicularly to the stretching direction of the mentioned above belt part and insert more than one slit at the mentioned above outer edge center part and the raw fabric which has the expansion and contraction along with the reverse side of the mentioned above outer edge at belt shape over it is sewn or stuck when the saccate cloth of the mentioned above L pocket is being sewn along with the outer edge of the mentioned above L pocket.

Thus, because the raw fabric which is capable of expansion and contraction at the shape of belt is sewn or stuck at the condition of putting notch more than 1 at the outer edge center part and shrinking the notch, the upper outer edge of The L pocket also gets pulled to the front center direction when the elongating part moves to the direction pulling out of the storing part that waist area stretches by the structure which is capable of expansion and contraction, however the outer edge center part, as mentioned above, has the structure which is capable of expansion and contraction so it stretches and follows smoothly so that does not lose the outward appearance by getting existed wrinkles around the L pocket.

Also, in stead of pressing with iron etc. by the reverse side with the condition of shrinking the outer edge center part at the Length direction, it is making the structure which is capable of expansion and contraction at the outer edge center part by sewing or sticking the raw fabric which has expansion and contraction at the shape of belt over with condition of putting notch more than 1 at the outer edge center part and shrinking the notch so that the manufacturing process became simpler and the manufacturing time shortened. And when the force to stretch around waist is released, the elongating part again moves to the direction to store inside the storing part by the primary elastic material which the both edges are connected between the elongating part and the storing part. However also at this point the outer edge center part of the L pocket shrinks and follows smoothly because it has the structure which is capable of expansion and contraction and it returns to the existed condition beautifully.

Thus, it becomes a pair of pants with the L pocket which is capable of expansion and contraction of waist size by positioning the borderline between the elongating part and the storing part at the side close to the front center of the L pocket without losing the outward appearance and beauty.

According to a fourteenth aspect of the invention, there is provided a pair of pants with the L pocket which specifies that is a bended form like projecting to the mentioned above front center direction as the outer edge of the mentioned above L pocket going from the upper part down to the Lower part contacting the mentioned above belt part.

Thus, the outer edge center part of the L pocket has the outer edge form which is bent as projecting to the front center direction, therefore when waist area stretches by the structure which is capable of expansion and contraction around waist area nd the elongating part moves to the direction which is pulled from the storing part, the upper outer edge of the L pocket also gets pulled to the front center direction, however the upper outer edge can follow smoothly because the outer edge center part is projected to the front center direction more than the upper outer edge and the outward appearance won't be lost as getting existed wrinkles around the L pocket.

Also, it is not necessary to press by iron etc. from reverse side with the condition of shrinking the outer edge center part to the length direction or sewing over the raw fabric which has expansion and contraction at the shape of belt by putting notch more than 1 at the outer edge center part with the condition of shrinking the notch and also it is only to change the form of the raw fabric so that the manufacturing process is much more simplified and manufacturing time is shortened. And if the force which tries to stretch the waist area is released, the elongating part moves again to the direction which is stored inside the storing part by the primary elastic material which the both side edges are connected between the elongating part and the storing part, however at this time, the upper outer edge of the L pocket can follow smoothly and return to the form of existed The L pocket beautifully.

Thus, it becomes a pair of pants with the L pocket which is capable of expansion and contraction of waist size by positioning the borderline between the elongating part and the storing part at the side close to the front center of the L pocket without losing the outward appearance and beauty.

According to a fifteenth aspect of the invention, there is provided a pair of pants with the L pocket which specifies that the piping is conducted on the upper edge of the cuffs of the mentioned above front center side edge of the mentioned above L pocket saccate cloth.

Thus, it becomes a pair of pants with the L pocket which is capable of expansion and contraction of waist size by positioning the borderline between the elongating part and the storing part at the side close to the front center of the L pocket without losing the outward appearance and beauty.

According to a sixteenth aspect of the invention, there is provided a pair of pants with the L pocket which specifies the belt holes are sewn to the mentioned above belt part avoiding to obstruct the movement of the mentioned above elongating part, moreover covering the edge of the mentioned above storing part.

Regarding a pair of pants with the L pocket which is the result of the invention, the doubled part of the elongating part and the storing part which structures the structure which is capable of expansion and contraction around waist area positions near the outer edge close to the front center of the L pocket, therefore appearance becomes as the edge of the storing part connects to the outer edge close to the front center smoothly and the beauty can be kept without hiding the edge of the storing part. However, if the structure which is capable of expansion and contraction around waist area stretches widely, the edge of the storing part and the outer edge close to the front center of the L pocket shift, therefore the edge of the storing part can be visible.

Thereupon, by sewing the belt hole to the belt part as covering the edge of the storing part, it can make not to give unnatural feeling by perfectly hiding the edge of the storing part on visual even in case that the edge of the storing part and the outer edge close to the front center of the L pocket shift.

Thus, it becomes a pair of pants with the L pocket which is capable of expansion and contraction of waist size by positioning the borderline between the elongating part and the storing part close to the front center of the L pocket without losing the outward appearance and beauty other than adding the effect written above.

According to a seventeenth aspect of the invention, there is provided a pair of pants with the L pocket which specifies the stretch stopper that limits the maximum stretch is placed to the mentioned above primary elastic material.

Thus, it becomes a pair of pants with the L pocket which is capable of expansion and contraction of the waist size by positioning the borderline of the elongating part and the storing part at the side close to the front center of the L pocket which can keep the Ling life of the primary elastic material without losing the outward appearance and beauty.

According to an eighteenth aspect of the invention, there is provided a pair of pants with the L pocket which specifies that the mentioned above stretch stopper is sewn on to the mentioned above belt part with the mentioned above elastic material at the edge near the front center of the mentioned above primary elastic material, sewn on only the edge close to sides of the mentioned above primary elastic material by loosening as much as the mentioned above primary elastic material stretches, and also sewn on the side of the mentioned above belt part projecting more than the edge close to the side of the mentioned above primary elastic material.

This sewing stitches can not be seen from the front side of a pair of pants with the L pocket because one side of the primary elastic material gets sewn at the edge of the elongating part with one side edge of the stretch stopper material, however the other edge of the primary elastic material gets sewn on the storing part with the other edge of the stretch stopper material, therefore this sewing stitch comes out on surface of a pair of pants with the L pocket regarding mainly the casual a pair of pants with The L pocket, seeing this sewing stitch will not be too much concern, however due to improve the beauty more, it is effective to hide this sewing stitch with the belt hole.

However the belt holes used to be attached at seven places a circumference as in the past, but it became the main current to attach at five places a circumference in recent years, therefore the spaces of the adjacent belt holes tend to be wider. Regarding a pair of pants with the L pocket which is capable of expansion and contraction of the waist belt, the next belt hole comes at the position apart when hiding opening part of the storing part with the belt hole, therefore when sewing the other edge of the stopper material with the other edge of the primary elastic material on the storing part, this stitch of the sewing on could not be positioned right below the next belt hole and could not be hidden.

Thereupon, regarding a pair of pants with the L pocket which is the result of this invention, by extending the other edge of the stretch stopper material, sewn the only other edge of the stopper material at the position that is apart from the opening part of the storing part by stitching and positioning this stitch right below of the next belt hole to be able to hide it as making it invisible from the front. Also the middle part of the stretch stopper material is only sewn on the other side of the primary elastic material and it is at the condition which is floating from the inner storing part so that the outer beauty can not be lost.

Furthermore, in case of the casual a pair of pants with the L pocket including Jeans, it is common to get feel of the vintage jeans which is worn out by washing with the pumice stones, by the bio-washing (the bio-process) to take off the fluff destroying the surface of the fabric with the enzyme instantaneously, so adhesive fabric padding is set to strengthen the storing part in order to resist the impact of bio-washing. In this case, only the other edge of the stretch stopper material would be sewn by stitch at the aparted position from the opening part of the storing part even piercing this adhesive fabric padding.

Thus, in addition to add the effect which is written above, it becomes a pair of pants with The L pocket which is capable of expansion and contraction of the waist size by positioning the borderline between the elongating part and the storing part at the side close to the front center of the L pocket without losing the outward appearance and beauty.

According to a nineteenth aspect of the invention, there is provided a pair of pants with the L pocket which specifies the stopper part that functions as a stretch stopper by limiting the maximum stretch is placed to the mentioned above primary elastic material and the mentioned above stopper is united to the mentioned above elongating part.

Do to this, there is no need to set the sole stretch stopper by ribbon tape etc., also the sewing process gets simplified therefore the span of life of the primary elastic material can be extended at a low price without casting too much.

Thus, in addition to add the effect which is stated above, the span of life of the primary elastic material can be extended, it becomes a pair of pants with the L pocket which is capable of extension and contraction of the waist size by positioning the borderline between the elongating part and the storing part at the side close to the front center of the L pocket without losing the outward appearance and beauty.

According to a twentieth aspect of the invention, there is provided a pair of pants with the L pocket which specifies the mentioned above stopper part is sewn on the mentioned above belt part with the mentioned above primary elastic material at the edge near the side of the mentioned above primary elastic material by loosening as much as the mentioned above primary elastic material stretches and moreover, sewn on the side of the mentioned above belt part projecting more than the edge close to the side of the mentioned above primary elastic material.

Due to this, it is not necessary to set the sole stretch stopper by ribbon tape etc., and the sewing process gets simplified therefore the span of life of the primary elastic material can be extended at a low price without costing too much. Also by taking the same structure as a pair of pants with the L pocket which is the result of the invention of the clause of the claims #18, it is made possible to hide not to be seen from the front by sewing on only the edge of the stopper part at the position apart from the opening part of the storing part and by positioning this stitch at right below of the belt hole.

Thus, in addition to the effect which is the stated above, it becomes a pair of pants with the L pocket which is capable of expansion and contraction of the waist size by positioning the borderline between the elongating part and the storing part at the side close to the front center of the L pocket without losing the outward appearance and beauty.

According to a twenty-first aspect of the invention, there is provided a pair of pants with the L pocket which specifies that is sewn or stuck an adhesive cloth which is made of a fabric without the elasticity or the Lining made of the fabric without elasticity interior near an aperture of the mentioned above elongating part.

Now, as 'raw fabric which does not have extension and contraction', it has raw fabric of polyester and raw fabric of nylon etc., and these fabrics are used for partial material of lining or sleek (the saccate cloth of the Jeans' the L pocket) or ribbon tape.

Therefore, in addition to the effect which is stated above, the elongating part which is inserted to the storing part by elasticity of the primary elastic material contacts only to adhesive cloth of inner storing part or lining inside of the storing part, then it would not contact padding material etc. and more and it can lower the contact resistance therefore smooth movement of the elongating part and the storing part can be obtained.

Thus, it becomes a pair of pants with the L pocket which is capable of extension and contraction of the waist size by positioning the borderline between the elongating part and the storing part at the side close to the front center of the L pocket without losing the outward appearance and beauty by getting smooth movement of the elongating part and the storing part.

BRIEF DESCRIPTION OF THE SEVERAL VIEWS OF THE DRAWINGS

FIG. 19*a* is the partial development drawing which indicates the structure which the reverse side of the principal part of a pair of pants with the L pocket which is the result of the first deformation example of the seventh embodiment of this inventions being midway sewn.

FIG. 19*b* is the partial development drawing which indicates the structure that the reverse side of principal part of a pair of pants with the L pocket which is the result of the second deformation example of the seventh embodiment of this invention is being midway sewn.

FIG. 19*c* is the partial development drawing which indicates the structure that the reverse side of the principal part of a pair of pants with the L pocket which is the result of the third deformation example of the seventh embodiment of this invention is being midway sewn.

FIG. 19*d* is the partial development drawing which indicates the structure that the reverse side of the principal part of a pair of pants with the L pocket which is the result of the fourth deformation example of the seventh embodiment of this invention is being midway sewn.

DETAILED DESCRIPTION OF THE INVENTION

Figure 1A:
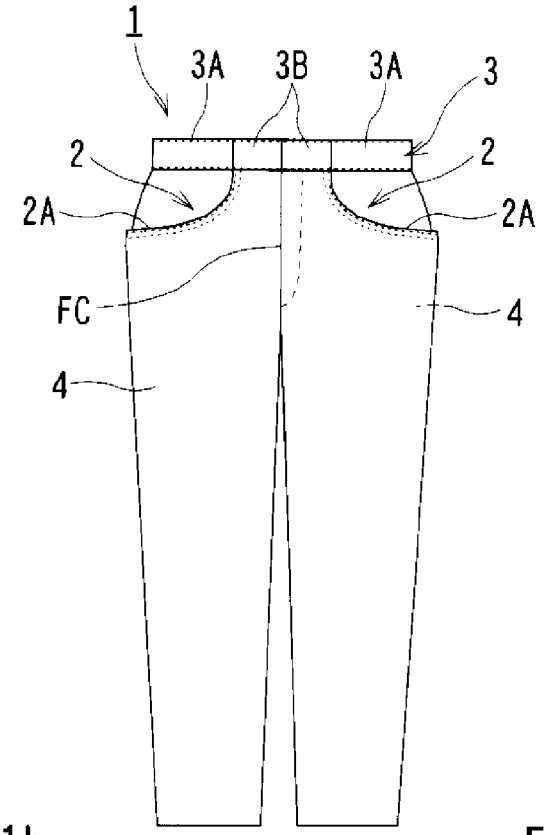
FIG. 1*a* is the front view which indicates the whole structure of the cotton pants as a pair of pants with the L pocket which is the result of the first embodiment of this invention.

What follows regarding a pair of pants with the L pocket which is the result of the embodiment of this invention, it is to be explained by referring to the drawing. Furthermore, regarding point forward the second embodiment, the same mark and the same sign as the first embodiment means the same or equivalent function part to the first embodiment and the same mark and the same sign of the mutual embodiment is the common function part to those embodiments therefore the overlapped detail explanation is to be omitted here.

First Embodiment

To begin with, to explain referring to FIG. 1, FIG. 2, FIG. 3, FIG. 4, FIG. 5 and FIG. 6 regarding a pair of pants with The L pocket which is the result of the first embodiment of this invention.

FIG. 1*a* is the front view which indicates the whole structure of the cotton pants as a pair of pants with the L pocket which is the result of the first embodiment of this invention.

Figure 1B:
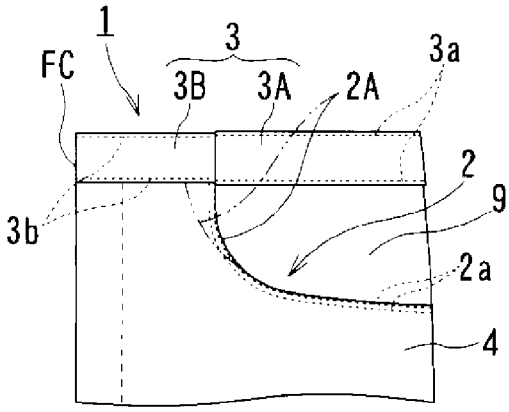
FIG. 1*b* is the partial enlarged drawing which indicates the condition that the left pocket and the waist area near that of cotton pants are shrunk.

FIG. 1*b* is the partial enlarged drawing which indicates the condition that the left pocket and the waist area near that of cotton pants are shrunk.

Figure 1C:
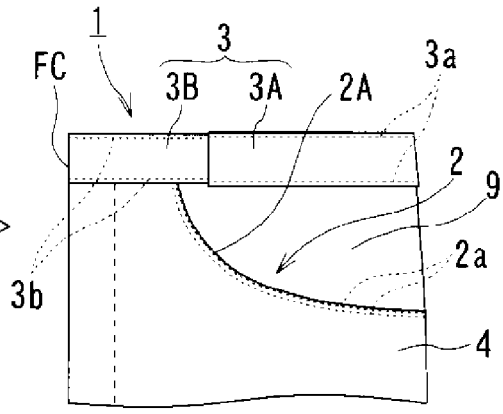
FIG. 1*c* is the partial enlarged drawing which indicates the condition the waist area is stretched.

FIG. 1*c* is the partial enlarged drawing which indicates the condition the waist area is stretched.

Figure 2A:
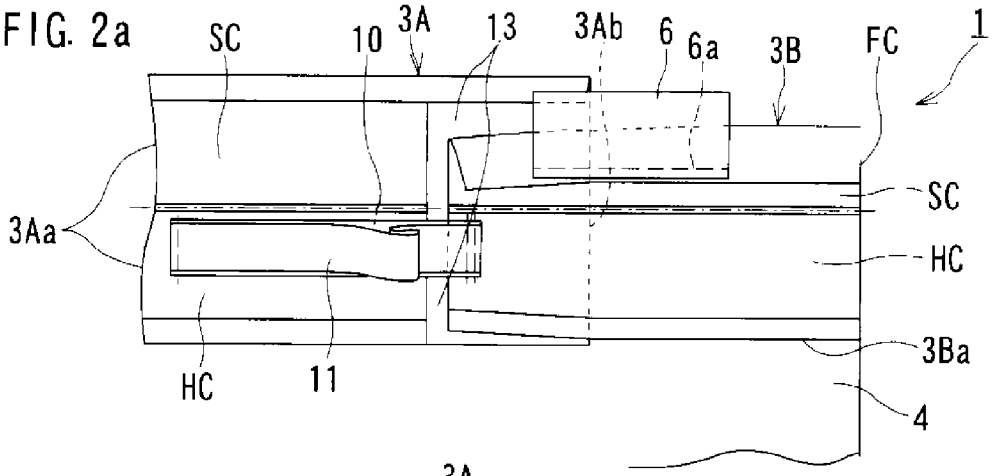
FIG. 2*a*, FIG. 2*b*, and FIG. 2*c* are the part developments which indicate the structure on midway of sewing on the back side of the principal part of a pair of pants with the L pocket which is the result of the first embodiment of this invention.
Figure 2B:
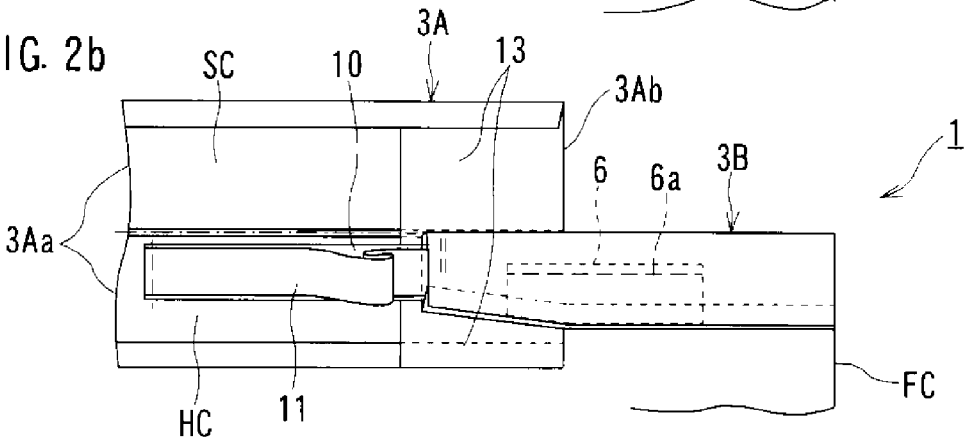
Figure 2C:
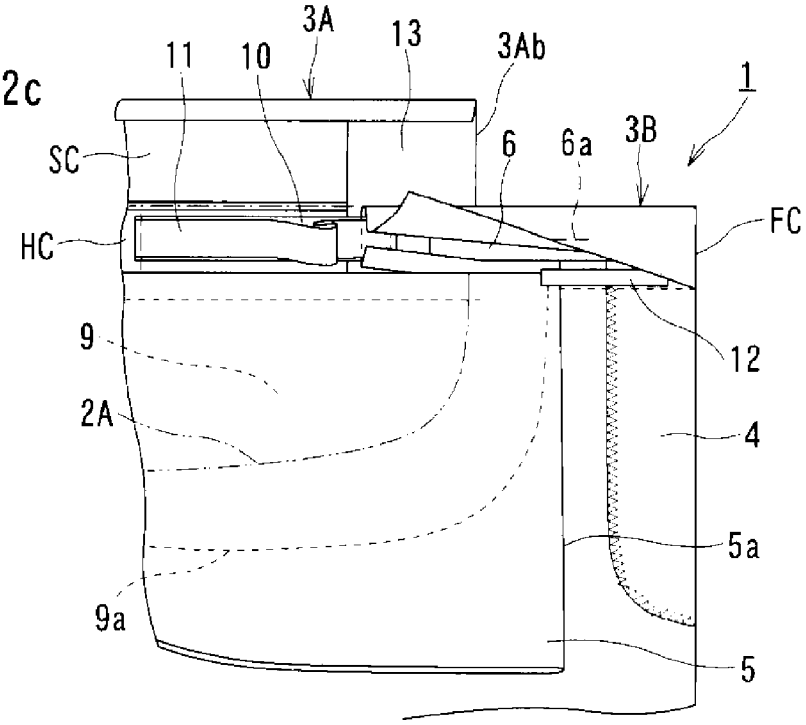

FIG. 2*a*, FIG. 2*b*, and FIG. 2*c* are the part developments which indicate the structure on midway of sewing on the back side of the principal part of a pair of pants with the L pocket which is the result of the first embodiment of this invention.

Figure 3A:
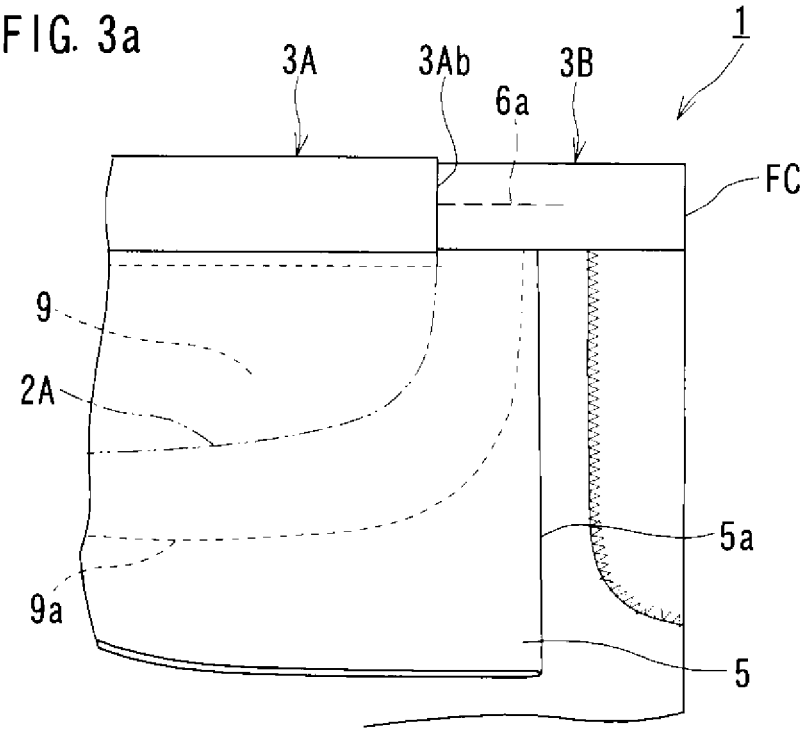
FIG. 3*a* and FIG. 3*b* are partial enlarged drawings which indicate the back side of the condition which the sewing a pair of pants with the L pocket which is the result of the first embodiment of this invention if completed.
Figure 3B:
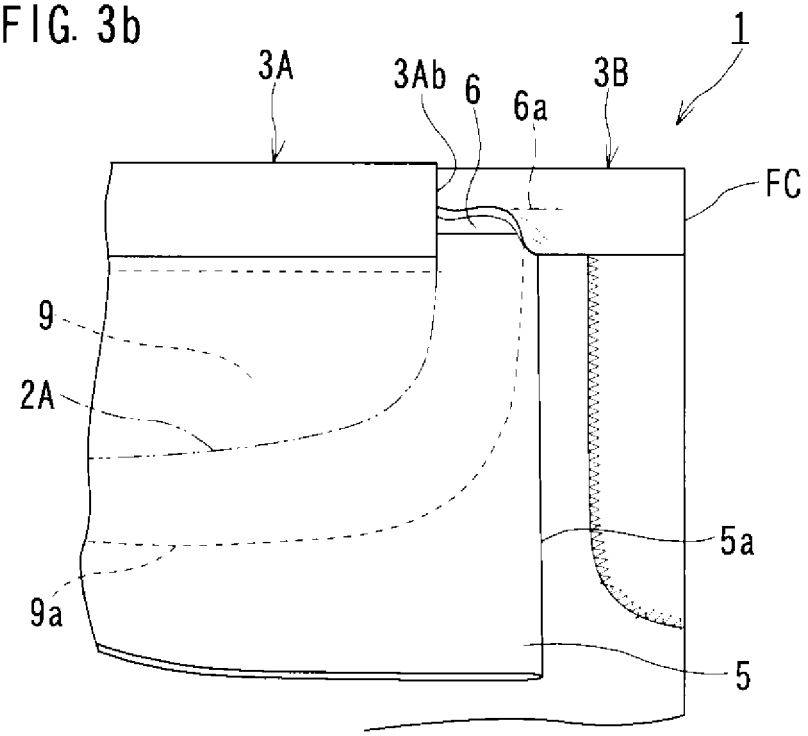

FIG. 3*a* and FIG. 3*b* are partial enlarged drawings which indicate the back side of the condition which the sewing a pair of pants with the L pocket which is the result of the first embodiment of this invention if completed.

FIG. 4*a*, FIG. 4*b*, FIG. 4*c*, FIG. 4*d*, FIG. 4*e* and FIG. 4*f* are explanation drawings which indicate to see the manufacturing procedure of the elastic structure of the left L pocket outer edge of a pair of pants with the L pocket which is the result of the first embodiment of this invention from the front side.

Figure 5A:
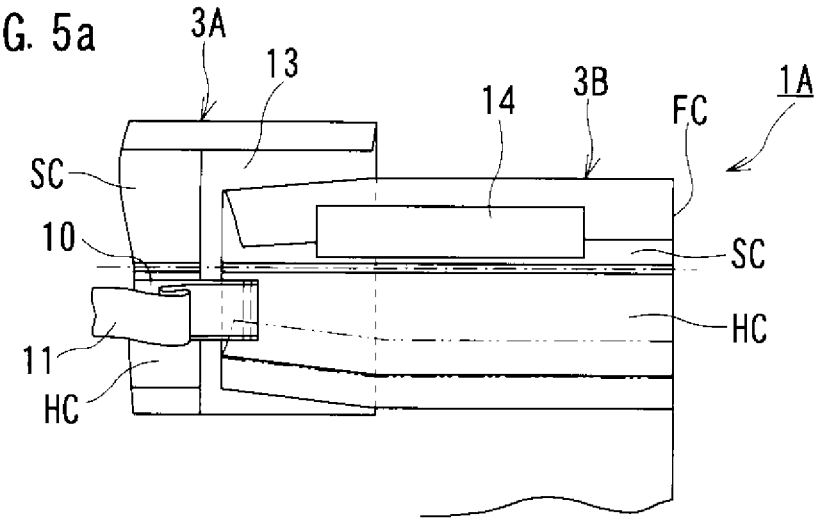
FIG. 5*a* and FIG. 5*b* are the part development which indicate the structure of midway on sewing on the back side of the principal part of a pair of pants with the L pocket which is the result of the first deformation example of the first embodiment of this invention.
Figure 5B:
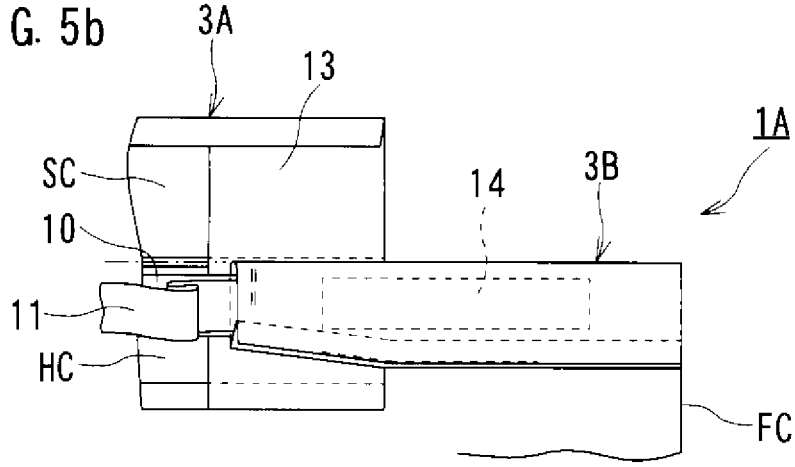

FIG. 5*a* and FIG. 5*b* are the part development which indicate the structure of midway on sewing on the back side of the principal part of a pair of pants with the L pocket which is the result of the first deformation example of the first embodiment of this invention.

Figure 5C:
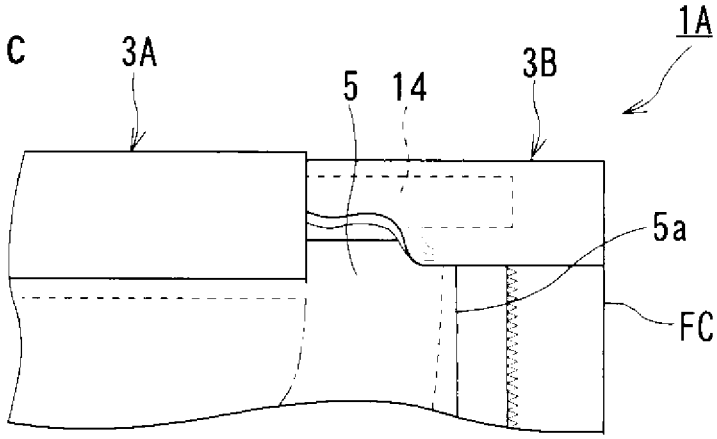
FIG. 5*c* is the partial enlarged drawing which indicates the back side of the condition that sewing of a pair of pants with the L pocket which is the result of the first deformation example of the first embodiment of this invention is completed.

FIG. 5*c* is the partial enlarged drawing which indicates the back side of the condition that sewing of a pair of pants with the L pocket which is the result of the first deformation example of the first embodiment of this invention is completed.

Figure 6A:
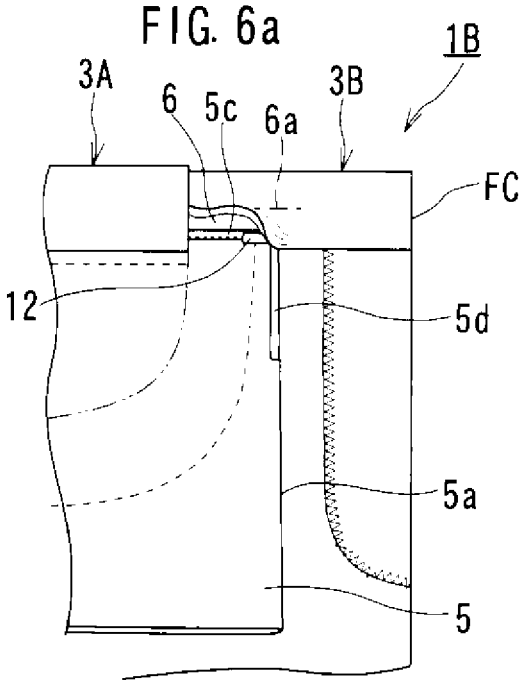
FIG. 6*a*, FIG. 6*b* and FIG. 6*c* are the partial enlarged drawings which indicate the back side of the condition that sewing of a pair of pants with the L pocket which is the result of the second deformation example, the third deformation example and the fourth deformation example of the first embodiment of this invention is completed.
Figure 6B:
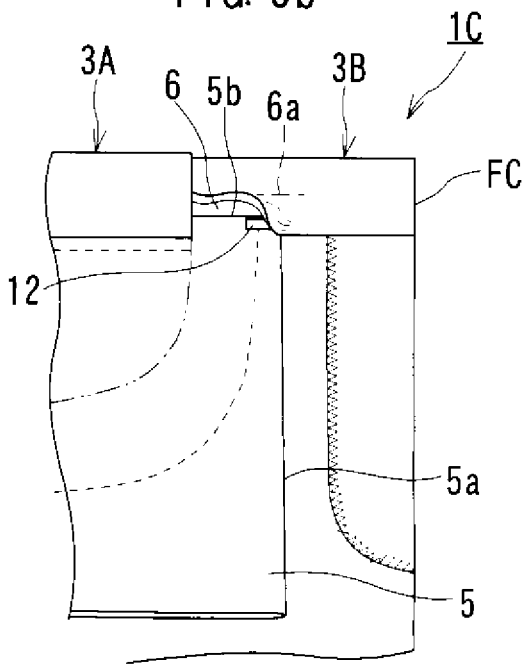
Figure 6C:
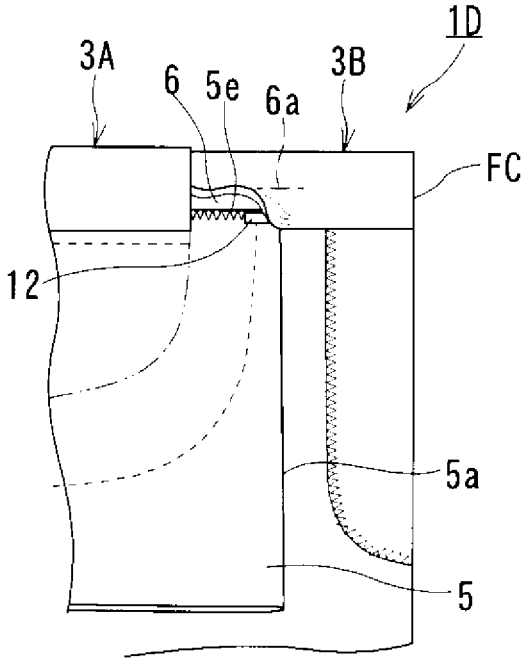

FIG. 6*a*, FIG. 6*b* and FIG. 6*c* are the partial enlarged drawings which indicate the back side of the condition that sewing of a pair of pants with the L pocket which is the result of the second deformation example, the third deformation example and the fourth deformation example of the first embodiment of this invention is completed.

As indicated in FIG. 1*a*, the cotton pants 1, as a pair of pants with the L pocket which is the result of this first embodiment, has the L pocket 2 which is the both sides united near the belt part 3 of the front bodice 4, and it has the structure of expansion and contraction around the waist which is capable of expansion and contraction of the apparent length of the belt part 3 near the part close to the front center FC of pocket entrance outer edge 2A of these the L pocket 2 (the upper part of the outer edge 2A)

That is, as explained in detail later, the doubled part which is made of the storing part 3A and the elongating part 3B which is inserted inside the storing part 3A is formed at the belt part 3 near the pocket entrance outer edge 2A of the both sides united the L pocket, and by the edge of the elongating part 3B and the storing part 3A being connected by the rubber tape as the primary elastic material inside the storing part 3A, the apparent length of the belt part 3 is to be capable of expansion and contraction.

Due to this, in case that the pulling force is not working on the belt part 3, the upper part of the outer edge 2A of The L pocket 2 matches with the edge of the storing part 3A s shown in FIG. 1*b* and the upper part of the outer edge 2A of the L pocket also moves together with the elongating part 3B as shown in FIG. 1*c* when the waist area stretches with the pulling force working on the belt part 3.

Also, a patch cloth 9 which is made of cotton raw fabric as common fabric as the front bodice 4 is sewn on the outer the L pocket 2 which both sides are united in order to make the saccate cloth of The L pocket 2 invisible from the front side.

Moreover, as indicated in FIG. 1*b* and FIG. 1*c*, the belt cloth stitch 3*a* and 3*b* are conducted at the both upper and lower edge of the both the storing part 3A and the elongating part 3B.

Regarding the casual a pair of pants including Jeans and cotton pants, it is common to conduct these belt cloth stitch 3*a* and 3*b*, however there is the case not to conduct the belt cloth stitch on the dressy a pair of pants for ladies' even regarding a pair of pants with the L pocket. Regarding following each drawing, the illustration of the belt cloth stitch except the partial illustration is to be omitted to make the drawing easy to see.

Next, it is to explain regarding the structure which is capable of expansion and contraction around the waist referring to FIG. 2.

FIG. 2 is indicated seeing the neighbor of the L pocket on the Left from the reverse side of the cotton pants 1.

As indicated in FIG. 2*a*, the belt cloth 3A which structures the storing part 3A is the raw cotton fabric which is the common fabric of the front bodice 4 of the cotton pants 1, and also the belt cloth 3Ba which structures the elongating part 3B is the raw cotton fabric which is the common fabric of the front bodice 4 of the cotton pants 1. As shown in FIG. 2*a* the soft padding SC and the hard padding HC are stuck by iron pressing inside of the storing part 3A and the elongating part 3B.

Hereupon, as indicated in FIG. 2*a* and FIG. 2*b*, the both sides of the edge 3Ab of the storing part 3A is perpendicular against the stretching direction and from the edge of the reverse side of the storing part 3A to the edge close to the front center FC of the saccate cloth 5 of the L pocket 2, the upper part of the raw fabric 6 which does not have the rectangular expansion and contraction inside of the elongating part 3B and the lower edge of the raw fabric 6 which does not have expansion and contraction is sewn at the lower edge of the belt part 3. Also, inner side near the opening entrance of the belt cloth 3A which structures the storing part 3A, to make the slide of the elongating part 3B smoother, the adhesive cloth 13 which is made of polyester type raw fabric as the raw fabric which does not have expansion and contraction is stuck over the soft padding SC and the hard padding HC by an iron pressing.

These edges of the elongating part 3B and inside of the storing part 3A re connected by the rubber tape 10 which is wide as the primary elastic material at inside of the storing part 3A.

Moreover, the belt shaped stretch stopper material 11 which is made of the raw fabric which does not expand or contract is sewn on the rubber tape 10, so that it can only stretch up to the length which this stretch stopper material 11 is folded even the pulling force is put on the rubber tape 10.

That is, the maximum stretching length of the rubber tape 10 is stipulated by the stretch stopper material 11. Due to this, it keeps the rubber tape 10 durable by preventing the rubber tape 10 to stretch excessively. Regarding the cotton pants 1 as a pair of pants with the L pocket which is the result of this first embodiment, the length of the folding up part of the stretch stopper material 11 is stated approximately 2 cm and the length of expansion and contraction around waist is stated approximately 2 cm.

Also as shown in FIG. 2*c*, the upper edge of the saccate cloth 5 of the L pocket 2 and the lower edge of the elongating part 3B are connected by the narrow width rubber tape 12 as the supplemental elastic material, due to this it prevents that the form of the saccate cloth 5 of the L pocket 2 gets out of shape when the elongating part 3B moves by the structure that is capable of expansion and contraction around waist area nd the outward to get worse. Moreover, as shown in FIG. 2*c* as dashed lines, at the front side of the saccate cloth 5 of the L pocket 2, to prevent the raw fabric to be seen outside of the outer edge 2A of The L pocket 2 which is indicated with imaginary lines, the patch 9 which is made of the front bodice 5 of the cotton pants 1 and cotton raw fabric is sewn on by the patch cloth stick 9*a*.

To close the storing part 3A which has this type of structure at lower edge by looping it, and also as shown in FIG. 2*b*, to sew the side of the saccate cloth 5 of the L pocket 2 at the Lower edge of the storing part 3A, to close the elongating part 3B and also sew on the side of the front bodice 4 of the cotton pants 1 which forms the outer edge 2A of the L pocket 2 at the Lower edge of the elongating part 3B.

As shown in FIG. 3*a*, the cotton pants 1 as a pair of pants with the L pocket which is the result of this first embodiment which is completed sewing like this is because the edge 3Ab of the front and the reverse side of the storing part 3A is perpendicular against the stretching direction of the belt part 3, all the sewing processes can be done by sewing machine so that the mass productivity can be guaranteed.

Also, the upper edge of the raw fabric 6 which does not have the expansion and contraction is sewn inside the elongating part 3B and the Lower edge of the raw fabric 6 which does not have the expansion and contraction is sewn on the Lower edge of the belt part 3, so that as shown in FIG. 3*b*, even the one who wears it turns the Lower edge of the elongating part 3B over by curiosity, the only part of the raw fabric 6 which does not have the expansion and contraction can be seen and the rubber tape 10 and the inner structure of the stretch stopper material 11 etc., can not be seen that it can definitely prevent the situation that the one who wears it take out the inner structure and destroys the structure which is capable of expansion and contraction.

Moreover, regarding the cotton pants 1 as a pair of pants with the L pocket which is the result of this first embodiment, when the elongating part 3B moves to the direction that gets pulled out from the storing part 3A s waist area stretches by the structure which is capable of expansion and contraction around waist area, the outer edge 2A of the L pocket 2 deforms smoothly without occurring wrinkles etc., around the L pocket 2. This is because the outer edge 2A of the L pocket 2 has expansion and contraction. The sewing method making the outer edge 2A of the L pocket 2 have expansion and contraction is to be explained by referring to FIG. 4. All FIG. 4*a*, FIG. 4*b*, FIG. 4*c*, FIG. 4*d*, FIG. 4*e* and FIG. 4*f* are indication of sewing procedure seeing the Left side the L pocket 2 from the front side.

Figure 4A:
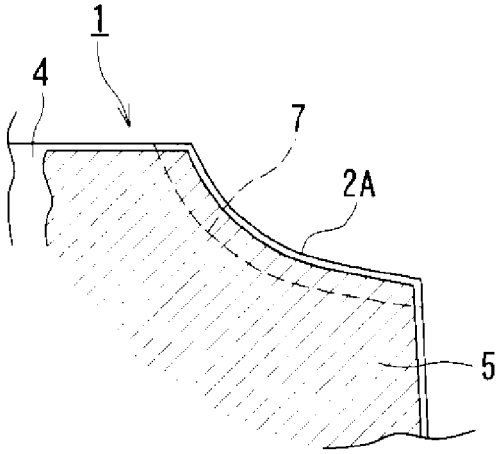
FIG. 4*a*, FIG. 4*b*, FIG. 4*c*, FIG. 4*d*, FIG. 4*e* and FIG. 4*f* are explanation drawings which indicate to see the manufacturing procedure of the elastic structure of the left L pocket outer edge of a pair of pants with the L pocket which is the result of the first embodiment of this invention from the front side.

First, as shown in FIG. 4*a*, to sew on the raw fabric 5 of the saccate cloth by adjusting to the form of the outer edge 2A of the L pocket 2 on the front side of the front bodice 4 of the cotton pants 1 by a plain seaming.

Figure 4B:
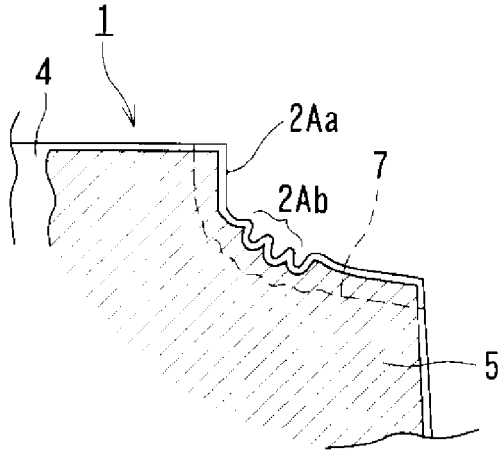

As shown in FIG. 4*b*, with the condition that by putting the upper part 2A of the outer edge 2A perpendicularly and shrinking the center part 1Ab of the outer edge 2A to the Length direction, to compress and press with steam iron over the center part 2Ab of the outer edge. Due to this, the wrinkles of the center part 2Ab of the outer edge at shrunk condition gets crushed nicely and becomes the smooth curved line as shown in FIG. 4*c*.

Figure 4C:
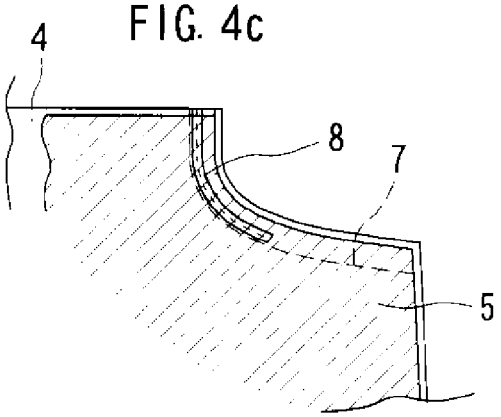

Over this, as shown in FIG. 4*c*, to sew on the belt shaped power net 8 as the raw fabric which has expansion and contraction along with the stitches of a plain seaming 7.

Figure 4D:
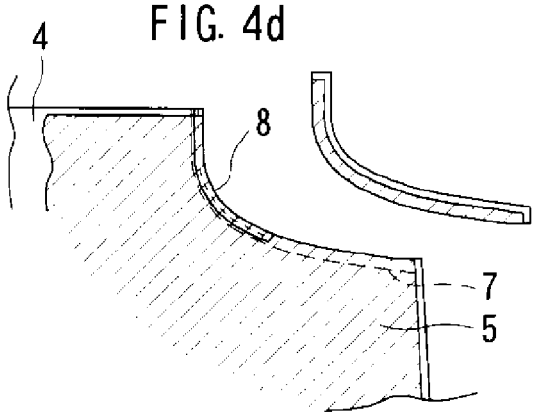

And as shown in FIG. 4*d*, to cut off the surplus part of the outside along with the edge of the belt shaped power net 8.

Figure 4E:
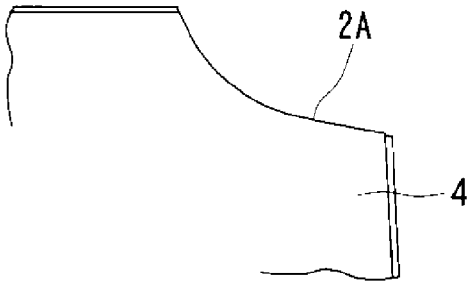
Figure 4F:
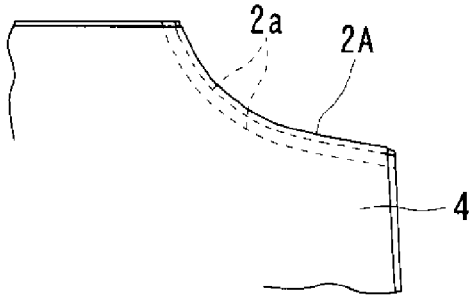

As shown in FIG. 4*e*, to fold over the saccate 5 at the plain seaming 7 part and turn over the saccate 5 to the other side that is the reverse side of the cotton pants 1. Then as shown in FIG. 4*f*, by placing double stitch 2*a* long with the outer edge 2A of new The L pocket 2, the structure of the L pocket 2 which is capable of expansion and contraction at center part 2Ab of the outer edge completes.

In addition, regarding this first embodiment, because the margin for a seam from the outer edge 2A of the plain seaming 7 is taken widely as 1.0 cm to make the plain seaming 7 easier to sew, as indicated in FIG. 4*d*, the process which is to cut off the surplus part of the outer edge along with the edge of the belt shaped power net 7 is needed, however the process which is to cut off the surplus part of the outer edge becomes unnecessary if the margin for a seam from the outer edge 2A of the plain seaming 7 is set narrow as 0.5 cm from the beginning, so this method can be taken.

Thus, regarding the cotton pants 1 as a pair of pants with the L pocket which is the result of this first embodiment, the doubled part of the elongating part 3B and the storing part 3A which structures the structure which is capable of expansion and contraction around waist area positions near the outer edge 2A close to the front center FC of the L pocket 2, therefore the edge of the storing part 3A becomes an appearance as smoothly connecting to the outer edge 2A close to the front center FC of the L pocket 2 and the beauty will not be lost even though the edge of the storing part 3A is not hidden.

Also, because the center part 2Ab of the outer edge is pressed by steam iron from the reverse side at the condition of shrunk at length direction and the belt shaped power net 8 as the raw fabric which has the expansion and contraction is sewn on over it, the upper part 2A of the outer edge of the L pocket 2 gets pulled to the front center FC direction when the elongating part 3B moves to the direction which the storing part 3A gets pulled out as waist area stretches by the structure which is capable of expansion and contraction around waist area, however the center part 2Ab of the outer edge is made as the structure as mentioned above which is capable of expansion and contraction so that it smoothly stretches and follows and the outward appearance will not be lost by wrinkling as previous around the L pocket 2.

Then, the elongating part 3B moves again to the direction being stored into the storing part 3A by the rubber tape 10 as the primary elastic material which the both edges are connected between the elongating part 3B and the storing part 3A when the force which tries to stretch waist area is released, however also on this occasion the center part 2Ab of The L pocket 2 smoothly shrinks and follows because its structure is capable of expansion and contraction and finely returns to the previous condition.

Thus, regarding the cotton pants 1 as a pair of pants with the L pocket which is the result of this first embodiment, it is to make possible to add the structure which is capable of expansion and contraction around waist area to a pair of pants with the L pocket which was previously thought impossible to do by the simple structure.

Thus, regarding the cotton pants 1 as a pair of pants with the L pocket which is the result of this first embodiment, the waist size can be capable of expansion and contraction by positioning the borderline of the elongating part and the storing part at the side close to the front center of the L pocket, by keeping the outward appearance and beauty finely and without losing the mass productivity.

Next, regarding the cotton pants 1A s a pair of pants with the L pocket which is the result of the first deformation example of this first embodiment is to be explained referring to FIG. 5.

The basic structure of the cotton pants 1A which is the result of the first deformation example of this first embodiment is the same as the cotton pants 1 which is the result of this first embodiment as mentioned above, therefore the explanation of the same part is to be omitted by putting the same correspondence.

As indicated in FIG. 5*a* and FIG. 5*b*, what the cotton pants 1A which is the result of the first deformation example differs from the cotton pants 1 is the point that the cuff part of the elongating part 3B is adhered to inner part of the cuff part of the elongating part by pressing with iron putting the both sides adhesive padding 14 between instead of sewing on the raw fabric 6 which does not have the expansion and contraction inside the elongating part 3B. The cotton pants 1A s a pair of pants with the L pocket which is sewn in this way is because the edge 3Ab of the both front and reverse of the storing part 3A is perpendicular against the stretching direction of the belt part 3. All the sewing processes can be done by sewing machine so that the mass productivity can be guaranteed.

Also, because the cuff part of the elongating part 3B is adhered by pressing with iron putting the both side adhesive padding 14 between inside the elongating part 3B, as indicated in FIG. 5*c* only the upper edge of the saccate cloth 5 can be visible even if the one who wears it turns the Lower edge of the elongating part 3B over by curiosity, the inner structure of the rubber tape 10 and the stretch stopper material 11 etc. can not be visible therefore the situation that the one who wears it pulls out the inner structure and destroys the structure which is capable of expansion and contraction can definitely be prevented.

Thus, regarding the cottons pants 1A s a pair of pants with the L pocket which is the result of the first deformation example of this first embodiment, the waist size can be made capable of expansion and contraction by positioning the borderline of the elongating part and the storing part at the side close to the front center of the L pocket, by keeping the outward appearance and beauty finely and without losing mass productivity.

Next, regarding the cotton pants as a pair of pants with the L pocket which is the result of the second deformation example to the fourth deformation example of this first embodiment, it is to be explained referring to FIG. 6.

Because the basic structure of the cotton pants which is the result of the second deformation example to the fourth deformation example of this first embodiment is the same as the cotton pants 1 which is the result of this first embodiment as mentioned above, the explanation is to be omitted by outing the same correspondence at the same part. That is, as indicated in FIG. 6*a*, FIG. 6*b* and FIG. 6*c*, even regarding the cotton pants 1B, 1C and 1D which are the results of the second deformation example to the fourth deformation example, the raw fabric 6 which does not have expansion and contraction is sewn on inside of the elongating part 3B.

What the cotton pants 1B, 1C and 1D which are the results of the second deformation example to the fourth deformation example differ from the cotton pants 1 is only the way of managing the upper edge of the saccate cloth 5 of the L pocket 2. That is, as indicated in FIG. 6*a*, regarding the cotton pants 1B which is the result of the second deformation example of this slits etc. at the upper part of the cuff part 5*a* of the front center FC side of the saccate cloth 5 of the L pocket 2 and conducting the piping 5*d* to the upper and lower directions of the saccate cloth 5 and conducting the piping 5C at the upper edge of the saccate cloth 5.

Due to this, it prevents to lose the outward appearance by wrinkling around the L pocket 2 caused by that the divided part which piping 5*d* is conducted accompanying the movement of the elongating part 3B and the saccate cloth 5 is twisted, also the upper edge of the saccate cloth 5 gets more strengthen by conducting the piping 5 at the upper edge of the saccate 5, the resistance when the elongating part 3B moves so that the waist area smoothly stretches and also the outward appearance of reverse side when the cotton pants 1B is displayed on the shelf as merchandise can be improved.

Also, as indicated in FIG. 6*b*, regarding the cotton 1C which is the result of the third deformation example of this first embodiment, the upper edge of the saccate cloth 5 is to be cut 5*b* as the raw fabric of the saccate cloth 5 is cut. Due to this, the sewing process of the cotton pants 1C is simplified and it can be manufactured at low cost. Moreover, as indicated in FIG. 6*c*, regarding the cotton pants 1D which is the result of the fourth deformation example of this first embodiment, the upper edge of the saccate cloth 5 is to be lock management 5*e*. Due to this, without complicating the sewing process, the upper edge of the saccate cloth 5 can be more strengthen than the case of the cut 5*b*.

In addition, regarding the cotton pants 1B, 1C and 1D as a pair of pants with the L pocket which is the result of the second deformation example to the fourth deformation example of this first embodiment, the raw fabric 6 which does not have expansion and contraction is sewn on inside of the elongating part 3B as well as the cotton pants 1, however instead of that, as well as the cotton pants 1A which is the result of the first deformation example of this first embodiment, by pressing with iron putting the both sides adhesive padding 14 between inside of the elongating part 3B, it can be the structure to adhere the elongating part 3B.

Also, regarding this first embodiment, the patch cloth 9 which is made of the cotton raw fabric as common as the front bodice 4 of cotton pants 1, 1A, 1B, 1C and 1D at the front side of the saccate cloth 5 of The L pocket 2, however, depends on the material or thickness of the front bodice 4, the saccate cloth 5 itself of the L pocket can be structured by the cotton raw fabric as common as the front bodice 4.

Second Embodiment

Next, regarding a pair of pants with the L pocket which is the result of the second embodiment of this invention, it is to be explained referring to FIG. 7.

Figure 7A:
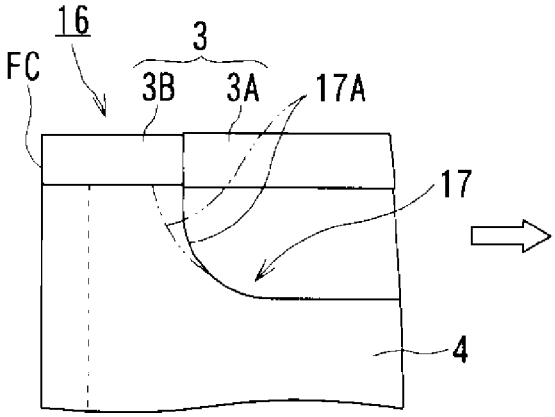
FIG. 7*a* is the partial enlarged drawing which indicated the condition that the left the L pocket and the neighbor waist area of the cotton pants as a pair of pants with The L pocket which is the result of the second embodiment of this invention is shrunk.

FIG. 7*a* is the partial enlarged drawing which indicated the condition that the left the L pocket and the neighbor waist area of the cotton pants as a pair of pants with The L pocket which is the result of the second embodiment of this invention is shrunk.

Figure 7B:
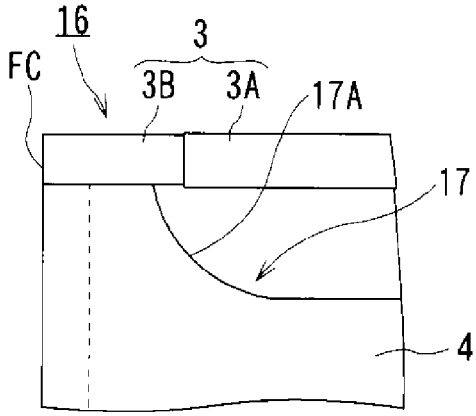
FIG. 7*b* is the partial enlarged drawing which indicated the condition that the waist area is stretched.

FIG. 7*b* is the partial enlarged drawing which indicated the condition that the waist area is stretched.

Figure 7C:
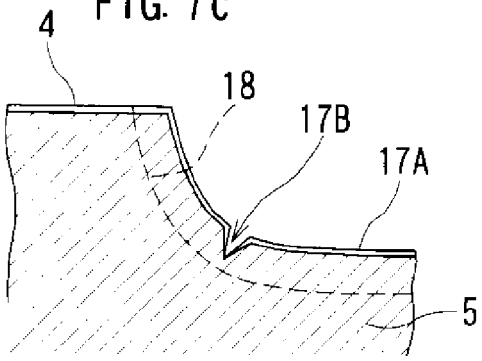
FIG. 7*c* and FIG. 7*d* are the explanation drawing which indicate the manufacturing procedures of the structure of expansion and contraction of the outer edge of the Left pocket seeing from the front side.
Figure 7D:
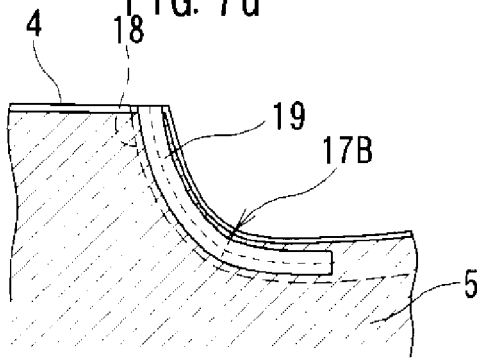

FIG. 7*c* and FIG. 7*d* are the explanation drawing which indicate the manufacturing procedures of the structure of expansion and contraction of the outer edge of the Left pocket seeing from the front side.

Figure 7E:
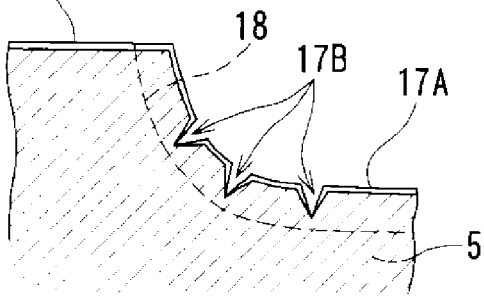
FIG. 7*e* is the explanation drawing which indicates the structure of expansion and contraction of the outer edge of the left the L pocket of the cotton pants which is the result of the deformation example of the second embodiment of this invention seeing from the front side.

FIG. 7*e* is the explanation drawing which indicates the structure of expansion and contraction of the outer edge of the left the L pocket of the cotton pants which is the result of the deformation example of the second embodiment of this invention seeing from the front side.

The cotton pants 16 as a pair of pants with the L pocket which is the result of this second embodiment has the L pocket 17 which the left and right are united neat the belt part of the front bodice as well as the cotton pants 1 as a pair of pants with the L pocket which is the result of the first embodiment and it has the structure which is capable of expansion and contraction around waist area which the apparent length of the belt part 3 is capable of expansion and contraction near the part (the upper part of the outer edge 17A) close to the front center FC of the pocket entrance outer edge 17A of these The L pocket 17.

That is, as well as the first embodiment, the doubled part which is made by the storing part 3A and the elongating part 3B which is to be inserted inside the storing part 3A near the pocket entrance outer edge 17 of the L pocket 17 which the left and right are united at the belt part 3 and the apparent length of the belt part 3 is to be capable of expansion and contraction by connecting the edge of the elongating part 3B and the storing part 3A with the rubber tape 10 as the primary elastic material at inside of the storing part 3A.

Also, the point that the both front and reverse of the edge part of the storing part 3A re perpendicular against the stretching direction, the point that the raw fabric 6 which does not have expansion and contraction inside of the elongating part 3B is sewn, moreover the point that the upper edge of the saccate cloth 5 of the L pocket 17 and the Lower edge of the elongating part 3B are connected by thin rubber tape 12 as the supplemental elastic material, the point that the belt shaped stretch stopper material 11 which is made of the raw fabric which does not have expansion and contraction is sewn on to the rubber tape 10 etc., are the same as the cotton pants 1 which is the result of the first embodiment.

Due to this, in case that the pulling force is not applied at the belt part 3, as indicated in FIG. 7*a*, the upper part of the outer edge 17A of the L pocket 17 corresponds to the edge of the storing part 3A and if the waist area stretches by applying the pulling force to the belt part 3, as indicated in FIG. 7*b*, also the upper part of the outer edge 17A of the L pocket moves united with the elongating part 3B and the outer edge 17A of the L pocket 17 smoothly deforms without occurring wrinkles etc. around the L pocket 17.

This is because the outer edge 17A of the L pocket has expansion and contraction.

Regarding the sewing method to make the outer edge 17A of this the L pocket have expansion and contraction, it is to be explained referring to FIG. 7*c* and FIG. 7*d*.

First, as indicated in FIG. 7*c*, the raw fabric 5 of the saccate cloth which is cut adjusting to the form of the outer edge 17A of The L pocket 17 is sewn on at the front side of the front bodice 4 of the cotton pants 16 by the plain seaming 18. Next, the slit 17B is set at the center part of the outer edge 17A.

Then as indicating in FIG. 7*d*, with the condition that putting the upper part of the outer edge 17A perpendicularly and shrinking the slit 17B of the outer edge center part, the belt shaped power net 19 as the raw fabric which has expansion and contraction is sewn over the outer edge center part along with the stitches of the plain seaming 18.

In addition, regarding this second embodiment, because the margin for a seam of the plain seaming 18 is taken as small as 0.5 cm from the beginning, the process which is to cut off the edge of the outer edge 17A s this first embodiment will not be necessary, however, the method which by taking the margin for a seam of the plain seaming 18 as well as this first embodiment as 1.0 cm, then cutting off the edge of the outer edge 17A after sewing on the belt shaped power net 19 can also be taken.

The rest is as same as indicating in FIG. 4*e* of first embodiment, folding back the saccate cloth 5 at the part of the plain seaming 18 and turn over the saccate cloth 5 to the other side that is the reverse side of the cotton pants 16.

Then as indicated in FIG. 4*f*, by applying double stitching 2*a* long with the outer edge 17A of the new The L pocket 17, the structure of the L pocket 17 which outer edge center part is capable of expansion and contraction gets completed.

Thus, regarding this second embodiment, it is set as the L pocket 17 which is capable of expansion and contraction at the center part of the outer edge 17A by applying the slit 17B at the center part of the outer edge 17A, therefore the process which is to press with steam iron as the first embodiment can be omitted and it can make the outer edge 17A of the L pocket 17 have expansion and contraction with much easier way and shorter time. In addition, the slit 17B is not limited to one, as indicated in FIG. 7*e*, to apply the slit 17B at three parts and with the condition which the 3 slits 17B are shrunk, the belt shaped power net 19 as raw fabric which has the expansion and contraction can be sewn on over the outer edge center part along with the stitches of the plain seaming 18.

Thus, when the elongating part 3B moves to the direction which waist area stretches by the structure which is capable of expansion and contraction and the elongating part 3B gets pulled out from the storing part 3A, the upper part 17A of the outer edge of the L pocket 17 also gets pulled to the center FC direction, however the center part 17A of the outer edge as mentioned above is being the structure so that it smoothly stretches and follows and it does not get wrinkled around the L pocket 17 or lose outward appearance.

Then when the force which tries to stretch around waist area is released, the elongating part 3B moves again to the direction which is stored inside the storing part 3A by the rubber tape 10 as the primary elastic material which its both edges are connected between the elongating part 3B and the storing part 3A, however at this time as well the center part 17A of the outer edge of The L pocket 17 smoothly shrinks and follows because it is made to be the structure which is capable of expansion and contraction and returns to the existed condition finely.

Thus, regarding the cotton pants 16 a pair of pants with the L pocket which is the result of this second embodiment, it made it possible to add the structure which is capable of expansion and contraction around waist area to a pair of pants with The L pocket which was thought to be impossible by the simple structure.

Thus, regarding the cotton pants 16 as a pair of pants with the L pocket which is the result of this second embodiment, it can make waist size capable of expansion and contraction by positioning the borderline of the elongating part 3B and the storing part 3A t the side close to the front center FC of the L pocket 17 by keeping the outward appearance and beauty finely without losing the mass productivity.

Third Embodiment

Next, regarding a pair of pants with The L pocket which is the result of the third embodiment of this invention.

Figure 8A:
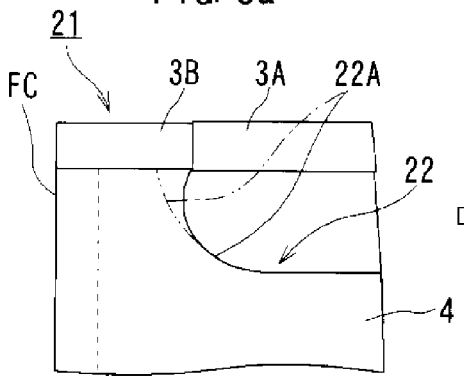
FIG. 8*a* is the partial enlarged drawing indicating the condition which the Left pocket of the cotton pants as a pair of pants with the L pocket which is the result of the third embodiment of this invention and waist area near that are shrunk.

FIG. 8*a* is the partial enlarged drawing indicating the condition which the Left pocket of the cotton pants as a pair of pants with the L pocket which is the result of the third embodiment of this invention and waist area near that are shrunk.

Figure 8B:
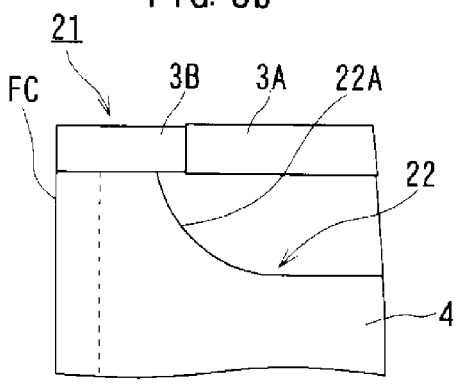
FIG. 8*b* is the partial enlarged drawing indicating the condition which the waist area is stretched.

FIG. 8*b* is the partial enlarged drawing indicating the condition which the waist area is stretched.

The cotton pants 21 as a pair of pants with the L pocket which is the result of this third embodiment has The L pocket 22 which the right and left are united near the belt part 3 of the front bodice and has the structure which is capable of expansion and contraction around waist area which is capable of expansion and contraction on apparent length of the belt part 3 near the part (the upper part of the outer edge 22A close to the front center FC of the outer edge 22A of the pocket entrance of these The L pocket 22.

That is, as well as the first embodiment and the second embodiment, the doubled part which is made of the storing part 3A and the elongating part 3B which is to be inserted inside the storing part 3A near the outer edge 22A of pocket entrance of the L pocket 22 that the Left and right are united is formed at the belt part 3 and by connecting the edge of the elongating part 3B and the storing part 3A by the rubber tape 10 as the primary elastic material inside the storing part 3A, the apparent length of the belt part 3 is made to be capable of expansion and contraction.

Also, which is the result of the first embodiment which are the point that the both front and reverse of the edge part of the storing part 3A re perpendicular against the stretching direction of the belt part 3, that the raw fabric 6 which does not have expansion and contraction is sewn on inside the elongating part 3B, moreover the upper edge of the saccate cloth 5 of the L pocket 22 and the Lower edge of the elongating part 3B are connected by the thin rubber tape as supplemental elastic material, that the stretch stopper material 11 which is made of the raw fabric which does not have expansion and contraction is sewn on the rubber tape 10 etc. are all as same as the cotton pants 1.

Thus, in case that the pulling force is not applied on the belt part 3, as indicated in FIG. 8*a*, the upper part of the outer edge 22A of the L pocket 22 is corresponded to the edge of the storing part 3A. When the pulling force applies at the belt part 3 and waist area stretches.

As indicated in FIG. 8*b*, the upper part of the outer edge 22A of the L pocket 22 moves as well with the elongating part 3B and the outer edge 22A of the L pocket 22 smoothly deforms without occurring wrinkles etc. around The L pocket 22.

This reason, as indicated in FIG. 8*a*, is to make a form that is curved as projecting to the front center direction FC as the outer edge 22A of the L pocket 22 goes from upper part that is connected to the belt part 3 to the Lower part.

Due to this, when the elongating part 3B moves to the direction which gets pulled out from the storing part 3A by stretching the waist area by the structure which is capable of expansion and contraction around waist area, the upper part of the outer edge 22A of the L pocket 22 as well gets pulled to the direction of the front center FC, however because the center part of the outer edge 22A is projecting more than the upper part of the outer edge 22A to the direction of the front center FC, the upper edge of the outer edge 22A can smoothly follow so that it does not lose the outward appearance by wrinkling as present around The L pocket 22.

Moreover, it is not necessary to press with iron from reverse at the condition which is shrinking the center part of the outer edge 22A to the Length direction or to insert slit more than one at the center part of the outer edge 22A nd to sew on the raw fabric which has expansion and contraction over it at the belt shape at the condition which is shrinking the slit. Only changing the form of the raw fabric can do, therefore the manufacturing process becomes much simpler and can be manufactured in short period of time.

And when the force which tries to stretch the waist area is released, the elongating part 3B again moved to the direction which is stored inside the storing part 3A by the rubber tape 10 as the primary elastic material which the both edges are connected between the elongating part 3B and the storing part 3A, however, at that time the upper part of the outer edge 22A of the L pocket 22 can smoothly follow and it returns to the previous form of the L pocket 22 finely. Thus, regarding the cotton pants 21 as a pair of pants with the L pocket which is the result of this third embodiment, it made possible by extremely simply structure to add the structure which is capable of expansion and contraction around waist area to a pair of pants with the L pocket which was thought to be impossible.

Thus, regarding the cotton pants 21 as a pair of pants with the L pocket which is the result of this third embodiment, it can make the waist size capable of expansion and contraction by positioning the borderline of the elongating part 3B and the storing part 3A t the side close to the front center FC of the L pocket 22 keeping the outward appearance and beauty finely without losing the mass productivity.

Moreover, regarding to this third embodiment, the patch cloth 9 which is made of the cotton raw fabric which is common as the front bodice 4 of the cotton pants 21 is sewn at the front side of the saccate cloth 5 of the L pocket 22, however the saccate cloth 5 itself of the L pocket 22 can be structured by the cotton raw fabric which is common as the front bodice 4 depends on the material and thickness of the front bodice 4.

Fourth Embodiment

Next, it is to explain regarding a pair of pants with the L pocket that is the result of the fourth embodiment of this invention referring to FIG. 9 and FIG. 10.

Figure 9A:
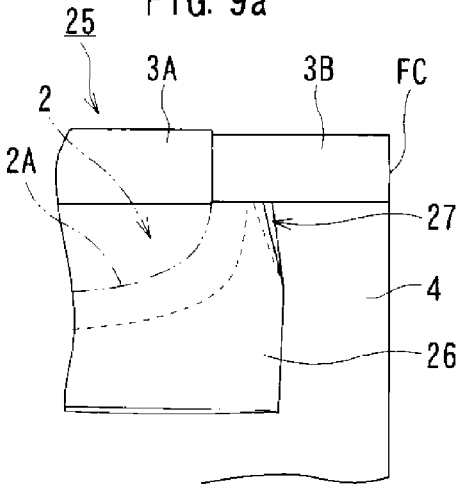
FIG. 9*a* is the partial enlarged drawing which indicates the condition that the left L pocket of the cotton pants as a pair of pants with the L pocket which is the result of the fourth embodiment of this invention and the neighbor waist area are shrunk seen from the reverse side.

FIG. 9*a* is the partial enlarged drawing which indicates the condition that the left L pocket of the cotton pants as a pair of pants with the L pocket which is the result of the fourth embodiment of this invention and the neighbor waist area are shrunk seen from the reverse side.

Figure 9B:
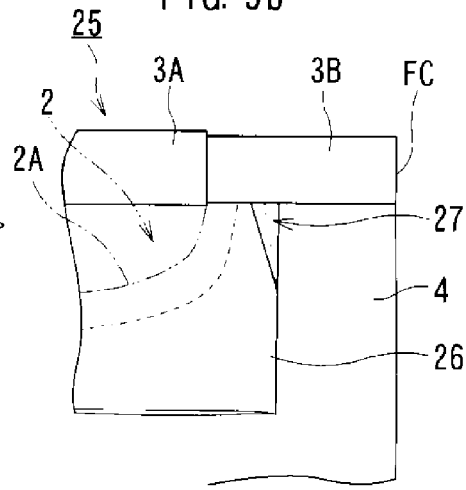
FIG. 9*b* is the partial enlarged drawing which indicates the condition that waist area is shrunk from seen from the reverse side.

FIG. 9*b* is the partial enlarged drawing which indicates the condition that waist area is shrunk from seen from the reverse side.

Figure 10A:
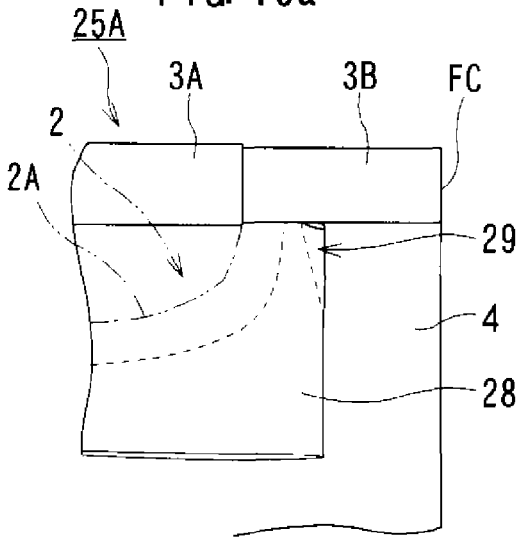
FIG. 10*a* is the partial enlarged drawing which indicates the right pocket of the cotton pants as a pair of pants with The L pocket which is the result of the deformation example of the fourth embodiment of this invention and the neighbor waist area re shrunk seen from the reverse side.

FIG. 10*a* is the partial enlarged drawing which indicates the right pocket of the cotton pants as a pair of pants with The L pocket which is the result of the deformation example of the fourth embodiment of this invention and the neighbor waist area re shrunk seen from the reverse side.

Figure 10B:
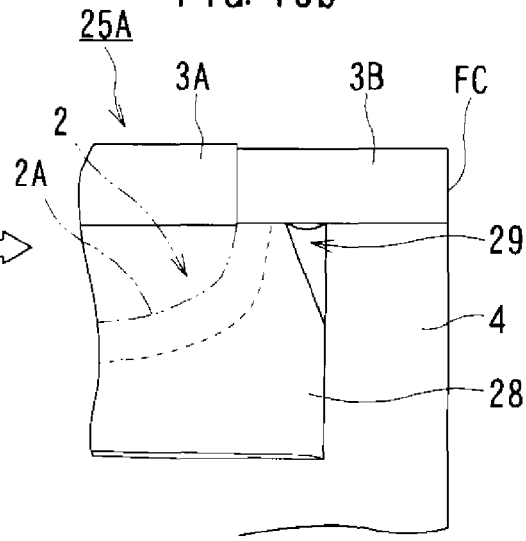
FIG. 10*b* is the partial enlarged drawing which indicates the condition that the waist area is stretched seen from the reverse side.

FIG. 10*b* is the partial enlarged drawing which indicates the condition that the waist area is stretched seen from the reverse side.

The cotton pants as a pair of pants with the L pocket which is the result of this the fourth embodiment has the L pocket which the right and left are united near the belt part of the front bodice as well as the cotton pants 1 as a pair of pants with the L pocket which is the result of the first embodiment and has the structure which is capable of expansion and contraction around waist area which is capable of expansion and contraction on the apparent length of the belt part 3 near the part close to the front center of the pocket entrance outer edge of these the L pocket.

That is, as well as the first embodiment, the doubled part which is made of the storing part 3A and the elongating part 3B which is to be inserted inside the storing part 3A is formed near the pocket entrance outer edge of the L pocket which the right and left are united at the belt part 3 and it is to make the apparent length of the belt part 3 capable of expansion and contraction by connecting the edge of the elongating part 3B and the storing part 3A inside the storing part by the rubber tape 10 as the primary elastic material.

Also, those below points are the same as the cotton pants 1 which is the result of the first embodiment which are both the front and the reverse of the edge part of the storing part 3A re perpendicular against stretching direction of the belt part 3, the raw fabric 6 which does not have expansion and contraction is sewn on inside the elongating part 3B, moreover the upper edge of the saccate cloth of the L pocket and the Lower edge of the elongating part 3B are connected with the thin rubber tape 12 as the supplemental elastic material, and the belt shaped stretch stopper 11 which is made of the raw fabric which does not have expansion and contraction is sewn on to the rubber tape 10 etc.

As indicated in FIG. 9*a*, regarding the cotton pants 25 as a pair of pants with the L pocket which is the result of this the fourth embodiment, the tuck 27 is applied at the upper part of the cuff part of the edge of the front center FC side of the L pocket saccate cloth 26 and near this tuck 27 the borderline of the storing part 3A which structures the structure which is capable of expansion and contraction around waist area and the elongating part 3B is positioned. Therefore, positioning in case of forming the tuck 27 is extremely easy and also the upper part of the outer edge 2A of the L pocket corresponds to the edge of the storing part 3A t the front side, so the beauty can not be lost even by not hiding with the belt hole.

Then, in case of that the elongating part 3B moves by the structure of waist expansion and contraction, as indicated in FIG. 9*b*, the tuck 27 opens following the saccate cloth 26 of the L pocket moves accompanied with that, the saccate cloth 26 of the L pocket does not get twisted or go tight and it can definitely be prevented to lose the outward appearance by influence of twist or pulling. Hereupon, the width of the pleats of the tuck 27 is desirable to be larger than the shrinking portion by the structure that is capable of expansion and contraction around waist area. Due to this, the pulling force definitely can be released because the tuck 27 can be opened with ease even in case of that the waist area of a pair of pants 25 with the L pocket stretches up to full of the structure which is capable of expansion and contraction of the waist area Such structure of the saccate cloth 26 of The L pocket which the tuck 27 is applied can release the pulling force sufficiently even by itself when the waist area of the cotton pants 25 as a pair of pants with the L pocket expands and contracts and can effectively prevent from occurring wrinkles etc. around the L pocket 2 seen from the front. Also in case of combining with structure of outer edge of the L pocket at cotton pants 1, 16 and 21 as a pair of pants with the L pocket which is the result of mentioned above first embodiment to the third embodiment, it can prevent much more effectively from occurring the wrinkles etc. around the L pocket seen from the front when waist area of a pair of pants 1, 16 and 21 with the L pocket stretches and contracts.

Also, as indicated in FIG. 10*a*, regarding the cotton pants 25A s a pair of pants with the L pocket which is the result of the deformation example of this embodiment, the tuck 29 without pleats is applied by making surpassing the upper part of the cuff part of the edge of the front center FC of the saccate cloth 28 of the L pocket and the borderline of the storing part 3A which structures the structure which is capable of expansion and contraction around waist area near this tuck 29 and the elongating part 3B is positioned. Therefore positioning when forming the tuck 29 is extremely easy and also the upper part of the outer edge 2A of the L pocket corresponds to the edge of the storing part 3A t the front side so that the beauty will not be lost without hiding by the belt hole.

Then, in case of that the elongating part 3B moves by the structure of expansion and contraction of waist, as indicated in FIG. 10*b*, because the tuck 29 opens following the saccate cloth 28 of the L pocket moves, the saccate cloth 28 of the L pocket does not get twisted or go tight so that it can definitely prevent to lose the outward appearance influenced by such twist and puling. Hereupon, the opening width of the tuck 29 is desirable to be larger than the portion of expansion and contraction by the structure that is capable of expansion and contraction around waist area. Due to this, the pulling force definitely can be released because the tuck 29 opens with ease even in case that the waist area of a pair of pants 25A with the L pocket stretches up to full of the structure which is capable of expansion and contraction around waist area.

The structure of the saccate cloth 28 of the L pocket which applies such tuck 29 can sufficiently even by itself release the pulling force when the waist area of the cotton 25A s a pair of pants with the L pocket expands and contracts and occurring wrinkles etc. around the L pocket 2 seen from the front can effectively be prevented. Also, occurring wrinkles around the L pocket seen from the front can be prevented much more effectively when waist area of a pair of pants 1, 16 and 21 with the L pocket expands and contracts in case of using the structure of the outer edge of the L pocket at the cotton pants 1, 16 and 21 as a pair of pants with L pocket which is stated in the first embodiment, the second embodiment and the third embodiment.

Thus, regarding the cotton pants 25 and 25A s a pair of pants with the L pocket which is the result of this the fourth embodiment, the waist size can be capable of expansion and contraction by positioning the borderline of the elongating part and the storing part at the side close to the front center of the L pocket without losing the outward appearance and beauty.

Fifth Embodiment

Next, it is to explain about a pair of pants with The L pocket which is the result of the fifth embodiment of this invention referring to FIG. 11 and FIG. 12.

Figure 11A:
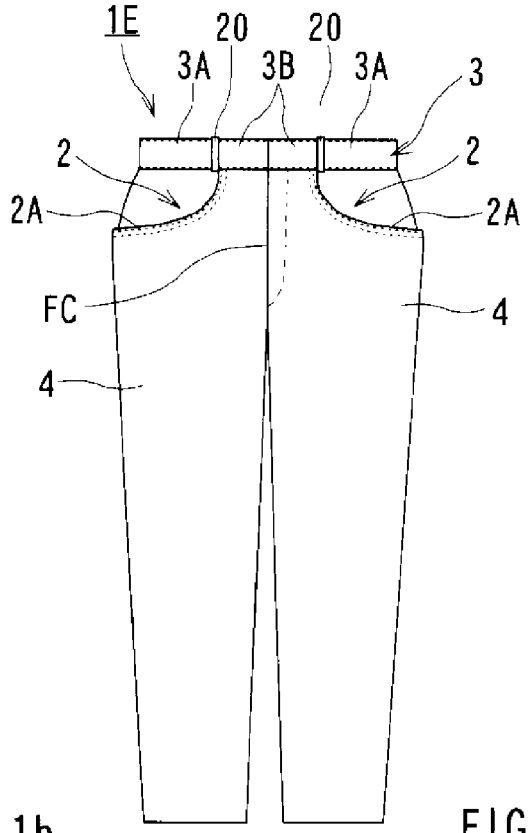
FIG. 11*a* is the front view which indicates the whole structure of the cotton pants as a pair of pants with the L pocket which is the result of the fifth embodiment of this invention.

FIG. 11*a* is the front view which indicates the whole structure of the cotton pants as a pair of pants with the L pocket which is the result of the fifth embodiment of this invention.

Figure 11B:
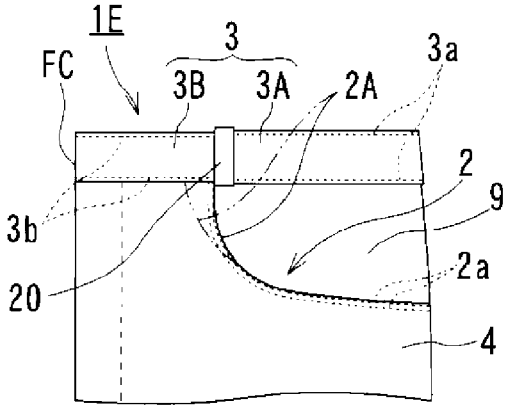
FIG. 11*b* is the partial enlarged drawing which indicates the condition that the left the L pocket of the cotton pants and the waist area re shrunk.

FIG. 11*b* is the partial enlarged drawing which indicates the condition that the left the L pocket of the cotton pants and the waist area re shrunk.

Figure 11C:
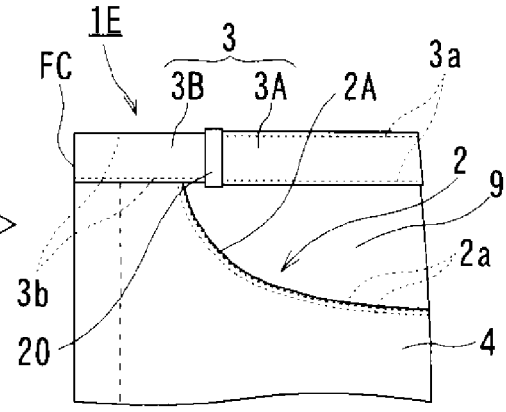
FIG. 11*c* is the partial enlarged drawing which indicates the condition that waist area is stretched.

FIG. 11*c* is the partial enlarged drawing which indicates the condition that waist area is stretched.

Figure 12A:
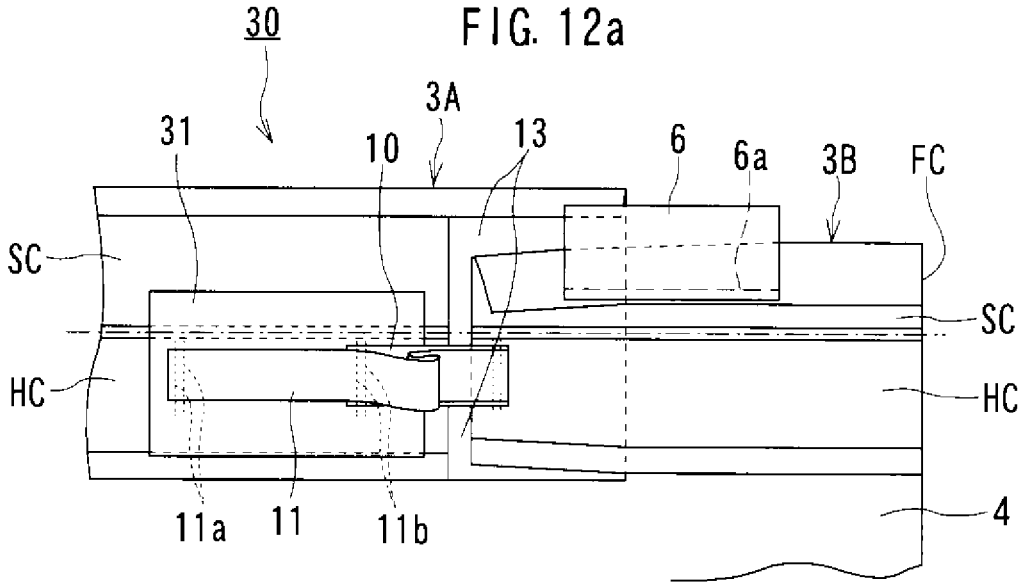
FIG. 12*a* is the partial development enlarged drawing which indicates deploying the inner structure of the belt part near the L pocket which a pair of pants with the L pocket which is the result of the deformation example of the fifth embodiment of this invention.

FIG. 12*a* is the partial development enlarged drawing which indicates deploying the inner structure of the belt part near the L pocket which a pair of pants, with the L pocket which is the result of the deformation example of the fifth embodiment of this invention.

Figure 12B:
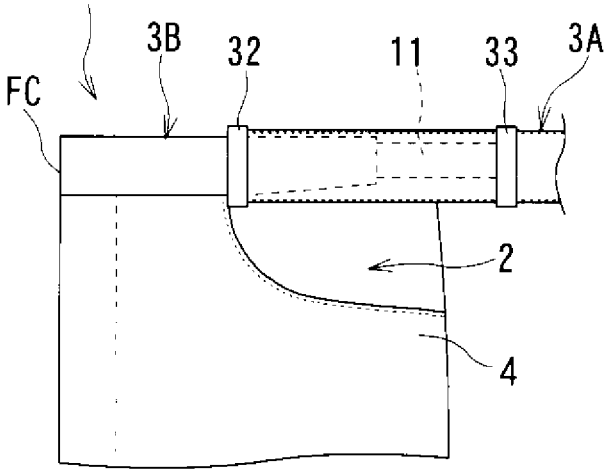
FIG. 12*b* is the partial enlarged drawing which indicates neighbor of the L pocket of a pair of pants with the L pocket which is the result of the deformation example of the fifth embodiment of this invention seen from the front.

FIG. 12*b* is the partial enlarged drawing which indicates neighbor of the L pocket of a pair of pants with the L pocket which is the result of the deformation example of the fifth embodiment of this invention seen from the front.

Figure 12C:
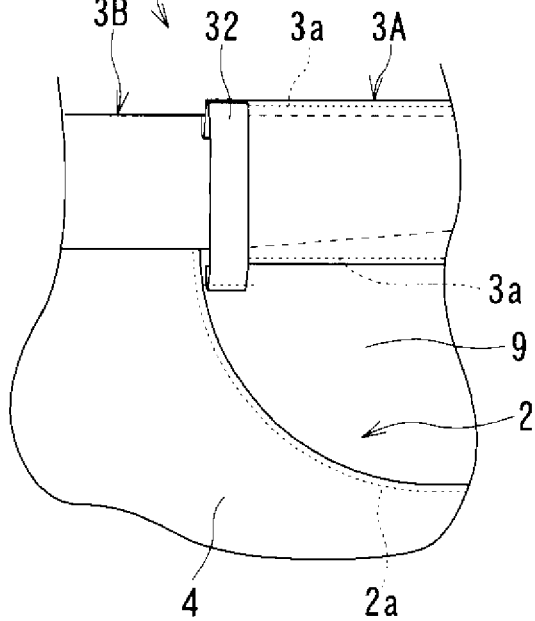
FIG. 12*c* is the partial enlarged drawing which indicates neighbor of The L pocket of the pair of pants with the L pocket which is the result of the fifth embodiment of this invention seen from the front is much more enlarged.

FIG. 12*c* is the partial enlarged drawing which indicates neighbor of The L pocket of the pair of pants with the L pocket which is the result of the fifth embodiment of this invention seen from the front is much more enlarged.

In addition, the L pocket and that outer edge of the cotton 1E as a pair of pants with the L pocket which is the result of this the fifth embodiment and the structure of the structure which is capable of expansion and contraction of waist are the same as the cotton pants 1 which is the result of the first embodiment indicated in FIG. 1, FIG. 2, FIG. 3 and FIG. 4, therefore the explanation will be omitted by adding the same sign to the same part.

As indicated in FIG. 11, the point which the cotton pants 1E as a pair of pants with the L pocket which is the result of this the fifth embodiment differs from the cotton pants 1 which is the result of the first embodiment is that the belt hole 20 is applied at the belt part 3.

That is, as indicated in FIG. 11*a*, regarding the cotton pants 1E which is the result of this the fifth embodiment, one pair of belt hole 20 is sewn on at the border between the both sides of the storing part 3A and the elongating part 3B of the belt part 3. Needless to say, it is unnatural when the belt hole 20 is only one pair so that the same type of belt holes 20 are sewn at adequate intervals to the both side parts and the back part of the belt part 3 of the cotton pants 1E. Due to this, the edge of the storing part 3A can be hidden completely by the belt hole, so it becomes a pair of pants with the L pocket which has much superior outward appearance and beauty.

Next, it is to explain regarding a pair of pants with the L pocket which is the result of the deformation example of this the fifth embodiment referring the FIG. 12.

As indicated in FIG. 12*a*, regarding the Jeans 30 as a pair of pants with the L pocket which is the result of the deformation example of this first embodiment, the adhesive cloth 6 is sewn on with the stitch 6 at inside of the elongating part 3B as well as the cotton pants 1 which is the result of the first embodiment and one side edge of the rubber tape 10 as the primary elastic material is sewn on with one side edge of the stretch stopper material 11 at neighbor of the edge of the elongating part 3B.

Moreover, the stretch stopper material 11 gets sewn on to the adhesive cloth padding 31 with the other edge of the rubber tape 10 by loosening as much length as the range of stretching of the rubber tape 10 and this adhesive cloth padding 31 gets adhered inside of the storing part 3A with adhesive. Then the other edge of the stretch stopper material 11 gets sewn on piercing the belt cloth with the adhesive cloth padding 31 by two stitches 11. Therefore, two stitches 11*a* becomes visible from the front side of Jeans 30.

However, as indicated in FIG. 12*b*, the belt holes are attached at total 5 parts including the belt hole 32 and 33 to Jeans 30. Among these, the belt hole 33 is attached as positioning right above of two stitches 117*a*, therefore two stitches becomes invisible from the front as it is hidden behind the belt hole 33, so the beauty of Jeans 30 will not be lost.

That is, regarding a pair of pants with the L pocket, previously the belt holes were applied at 7 parts however it is becoming the mainstay to apply the belt hole at 5 parts a circumference in recent years, so the intervals between the belt hole 32 and the belt hole 33 tend to be winder. It is that the stretch stopper material 11 to be extended as indicated in FIG. 12*a* in order to be able to hide two stitches 11*a* by the belt hole 33 that is apart from the belt hole 32.

And the purpose that the adhesive cloth padding 31 is set is to strengthen the storing part 3A that can be able to endure the impact of such bio-washing because especially Jeans 30 is processed a lot of times to get feel of worn out vintage jeans by taking fluff off instantly destroying the surface of the cloth with enzyme by bio-washing (bio-process) or washing by adding pumice stones. This sort of bio-washing (bio-process) is enforced not only to Jeans but also to the other casual a pair of pants with the L pocket such as the cotton pants and chino pants.

Moreover as indicated in FIG. 12*c*, the belt hole 32 gets sewn on by the stitch 3*a* of the belt cloth above part the storing part 3A. That is, the upper edge of the belt hole 32 gets sewn by the plain sewing at the part close to the upper edge of the storing part 3A and the upper belt cloth stitch 3*a* is applied at the condition that the upper edge of the belt hole 32 is up. Then by turning the belt hole 32 over to the Lower side at the part of the belt cloth stitch 3*a* and the Lower edge of the belt hole 32 gets sewn to the patch cloth 9 of The L pocket.

Thus, regarding Jeans 30 as a pair of pants with the L pocket which is the result of the deformation example of this the fifth embodiment, the storing part 3A gets strengthened by the adhesive cloth padding 31 and it can endure the impact of the bio-washing as well as indicated in FIG. 12*b* stitch 11*a* which stops the edge of the stretch stopper material 11 is hidden by the belt hole 33 and as indicated in FIG. 12*c* the exit of the storing part 3A gets hidden by the belt hole 32. Therefore it becomes a pair of pants with the L pocket which has fine outward appearance.

Sixth Embodiment

Next, it is to explain regarding a pair of pants with the L pocket which is the result of the sixth embodiment of this invention referring to FIG. 13 and FIG. 14.

Figure 13A:
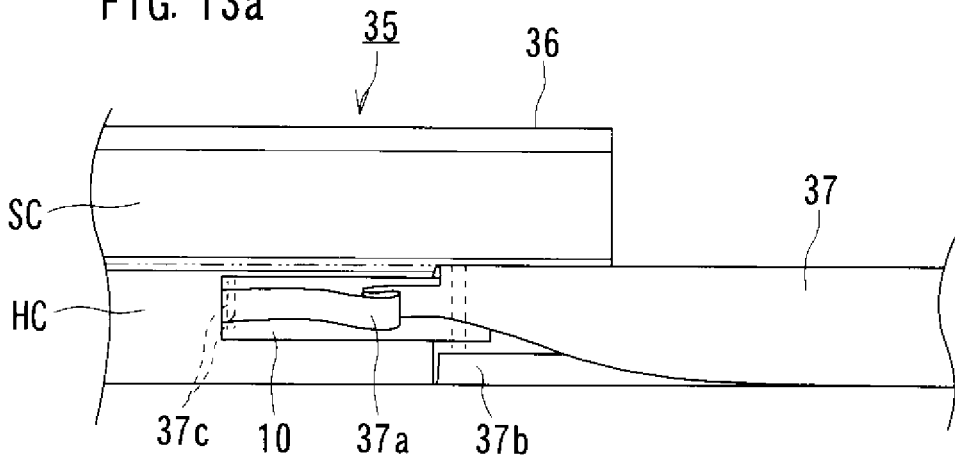
FIG. 13*a* is the partial development enlarged drawing that indicates the inner structure of the belt part near the L pocket of a pair of pants with the L pocket which is the result of the sixth embodiment of this invention by developing.

FIG. 13*a* is the partial development enlarged drawing that indicates the inner structure of the belt part near the L pocket of a pair of pants with the L pocket which is the result of the sixth embodiment of this invention by developing.

Figure 13B:
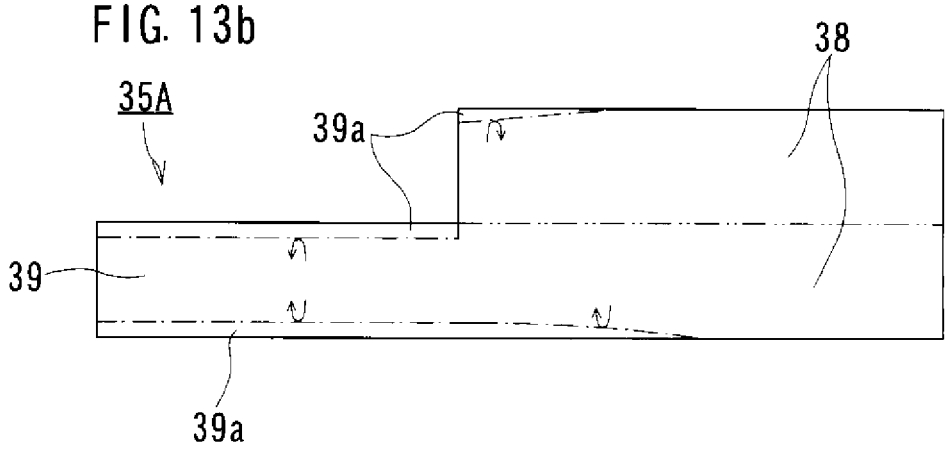
FIG. 13*b* is the partial enlarged drawing that indicates the cutting form of the raw fabric of the belt part near the L pocket of a pair of pants with The L pocket which is the result of the first deformation example of the sixth embodiment of this invention.

FIG. 13*b* is the partial enlarged drawing that indicates the cutting form of the raw fabric of the belt part near the L pocket of a pair of pants with The L pocket which is the result of the first deformation example of the sixth embodiment of this invention.

Figure 13C:
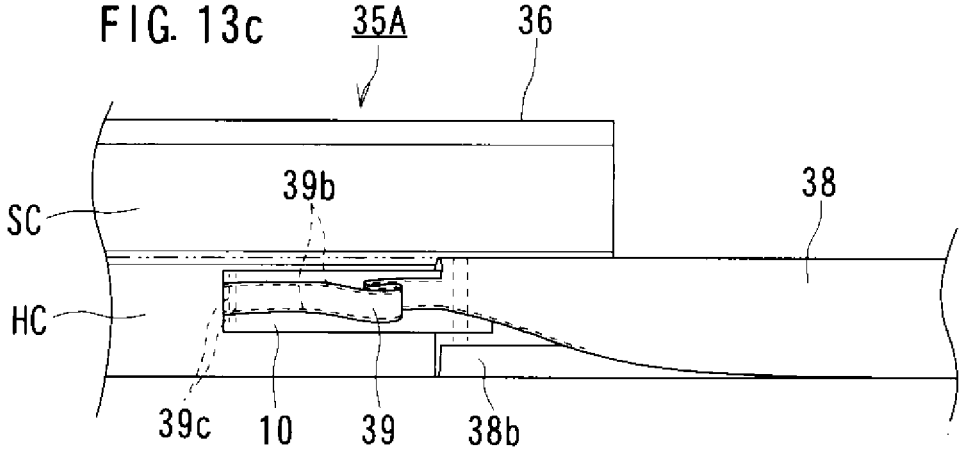
FIG. 13*c* is the partial development enlarged drawing that indicates the inner structure of the belt part near the L pocket of a pair of pants with the L pocket which is the result of the first deformation example of the sixth embodiment of this invention by developing.

FIG. 13*c* is the partial development enlarged drawing that indicates the inner structure of the belt part near the L pocket of a pair of pants with the L pocket which is the result of the first deformation example of the sixth embodiment of this invention by developing.

Figure 14A:
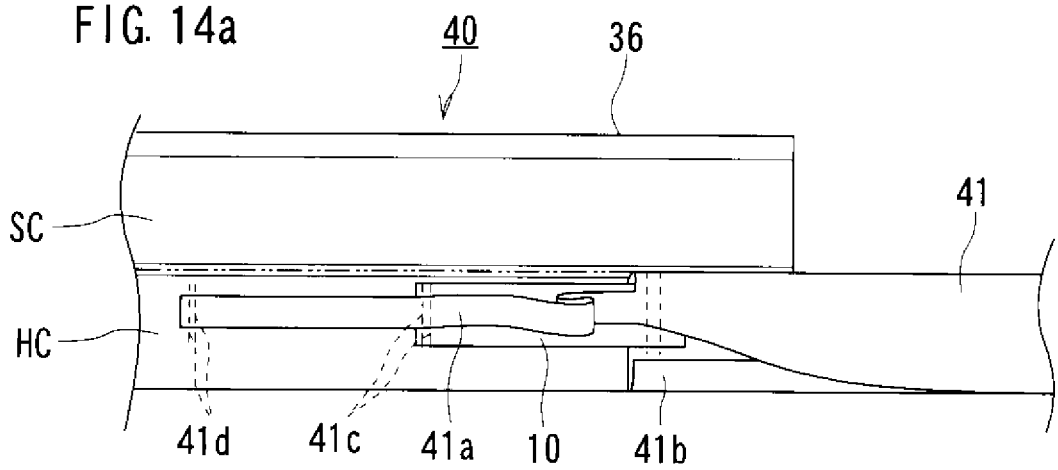
FIG. 14*a* is the partial development enlarged drawing that indicates by developing the inner structure of the belt part near the L pocket of a pair of pants with the L pocket which is the result of the second deformation example of the sixth embodiment of this invention.

FIG. 14*a* is the partial development enlarged drawing that indicates by developing the inner structure of the belt part near the L pocket of a pair of pants with the L pocket which is the result of the second deformation example of the sixth embodiment of this invention.

Figure 14B:
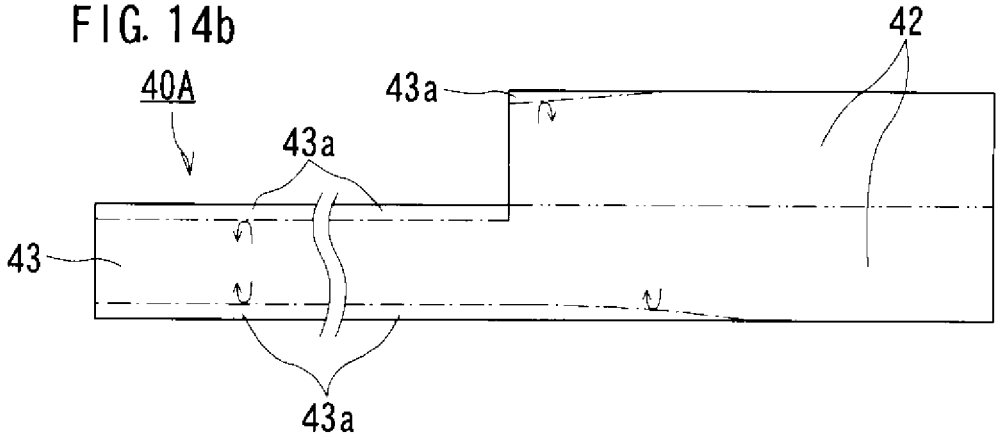
FIG. 14*b* is the partial enlarged drawing that indicates the cutting form of the raw fabric of the belt part near the L pocket of a pair of pants with the L pocket which is the result of the third deformation example of the sixth embodiment of this invention.

FIG. 14*b* is the partial enlarged drawing that indicates the cutting form of the raw fabric of the belt part near the L pocket of a pair of pants with the L pocket which is the result of the third deformation example of the sixth embodiment of this invention.

Figure 14C:
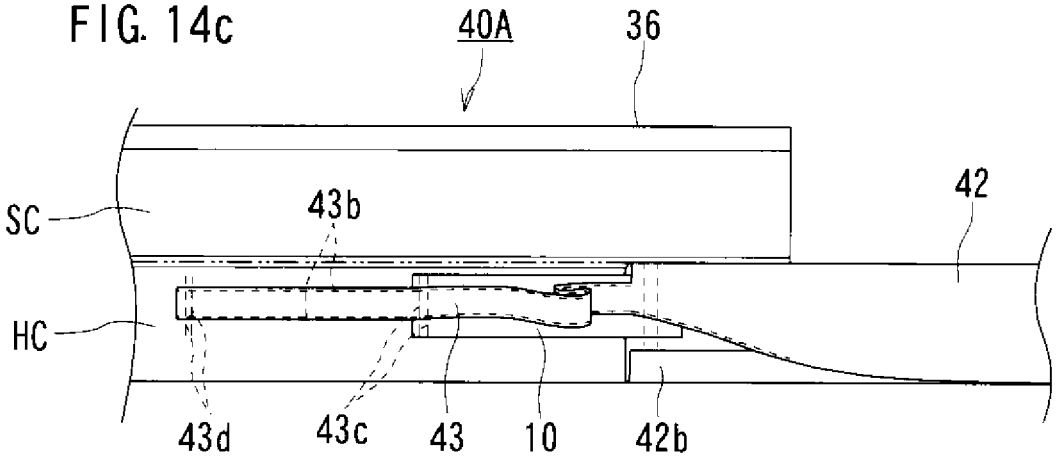
FIG. 14*c* is the partial development enlarged drawing that indicates by developing the inner structure of the belt part near the L pocket of a pair of pants with the L pocket which is the result of the third deformation example of the sixth embodiment of this invention.

FIG. 14*c* is the partial development enlarged drawing that indicates by developing the inner structure of the belt part near the L pocket of a pair of pants with the L pocket which is the result of the third deformation example of the sixth embodiment of this invention.

As indicated in FIG. 13 and FIG. 14, regarding a pair of pants 35, 35A, 40, 40A with the L pocket which is the result of this the sixth embodiment, it is characterized that the stretch stopper material is united by making the common fabric as the belt cloth of the elongating part 37 and 41. That is as indicated in the FIG. 13 (*a*), regarding a pair of pants 35 with the L pocket which is the result of this the sixth embodiment, it is to be the stopper part 37*a* which roles as well as the stretch stopper material by extending the Left edge of the elongating part 37 instead of separately applying the stretch stopper material which restricts the stretch of the rubber tape 10 as the primary elastic material.

The Left edge of the stopper part 37*a* is sewn on to the storing part 36 by two stitches 37*c* with the Left edge of the rubber tape 10. Therefore two stitches 37*c* is visible from the front side of the storing part 36, but seven belt holes are applied to a pair of pants 35 with the L pocket and It Is to cover two stitches 37*c* by the next belt hole that is applied at the close distance from, the belt hole that is near the L pocket. Therefore the outward appearance of a pair of pants 35 with the L pocket will not be lost.

However as indicated in FIG. 13*b*, regarding a pair of pants 35A with the L pocket which is the result of the first deformation example of this the sixth embodiment, it is to be the stopper part 39 which roles as well as the stretch stopper material as well by extending the Left edge of the elongating part 38, but the cuff part 39*a* is applied at both upper and lower, not cutting off as the stopper part 37*a* After turning over this cuff part 39 as indicated by the arrow, as indicated in FIG. 13*c* it is held by applying stitches 39*b* at both upper and lower.

Due to this, in addition to the function effect at a pair of pants 35 with the L pocket which is the result of the mentioned above the sixth embodiment, the both upper and lower edges of the stopper part 39 are not cut off but turned over and held with stitches 3, so there is not concern such as weaken by being frayed from the edge by repeating laundering many times like the case cutting off and the function effect that it becomes extremely robust stopper part 39 can be obtained.

Next, as indicated in FIG. 14*a*, regarding a pair of pants 40 with the L pocket which is the result of the second deformation example of this the sixth embodiment, five belt holes are attached. Therefore because the belt hole next to the belt hole near the L pocket is positioned apart, it is made to extend more the stopper part 41*a* which roles as same as the stretch stopper material from the Left edge of the rubber tape 10 as the primary elastic material and cover to be able to hide two stitches 41*d* with the nest belt hole. In addition, two stitches 41*c* which sew the middle part of the left edge of the rubber tape 10 and the stopper part 41*a* is not sewn on the storing part 36 and it can not be seen from the front side.

However as indicated in FIG. 14*b*, regarding a pair of pants 40A with the L pocket which is the result of the third deformation example of this the sixth embodiment, as well as a pair of pants 40 with the L pocket which is the result of the second deformation example of the mentioned above the sixth embodiment, it is to be the stopper part 43 which roles as the stretch stopper material by extending more the Left edge of the elongating part 42, but it is not cut off like the stopper part 41*a*, the cuff part 43*a* is applied at both upper and lower. The stitches 43*b* is applied at both upper and lower as indicated in FIG. 14*c* after turning the cuff part 43*a* over as indicated by the arrow.

Due to this, in addition to the function effect of a pair of pants 40 with the L pocket which is the result of the second deformation example of the mentioned above the sixth embodiment, because the edges of the upper and lower of the stopper part 43 is not cut off but folded over and stitched by stitch 43*b*, there is no concern such as the edge frays and weaken from the edge as the case of cut off even if laundering is repeatedly done many times and it can obtain the function effect such as becoming extremely robust stopper part.

Thus, regarding a pair of pants 35, 35A, 40, 40A with the L pocket which is the result of this the sixth embodiment, it can seek low cost because the stopper part 37*a*, 39, 41*a* and 43 which role as stretch stopper material are united with the belt cloth of the elongating part 37, 38, 41 and 42 by making it common fabric, so the sewing process gets simplified and can be done easily.

Seventh Embodiment

Next, it is to explain regarding a pair of pants with the L pocket which is the result of the seventh embodiment of this invention referring to FIG. 15, FIG. 16, FIG. 17, FIG. 18 and FIG. 19.

Figure 15A:
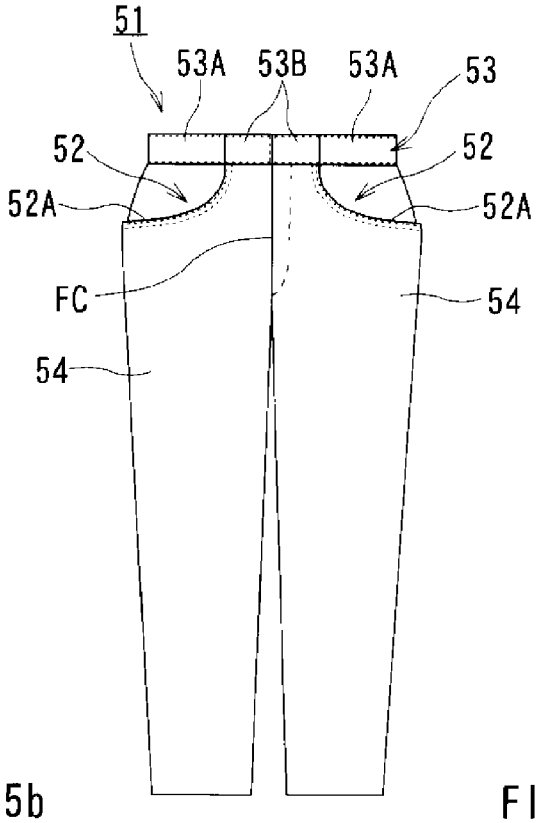
FIG. 15*a* is the front view which indicates the whole structure of the cotton pants as a pair of pants with the L pocket which is the result of the seventh embodiment of this invention.

FIG. 15*a* is the front view which indicates the whole structure of the cotton pants as a pair of pants with the L pocket which is the result of the seventh embodiment of this invention.

Figure 15B:
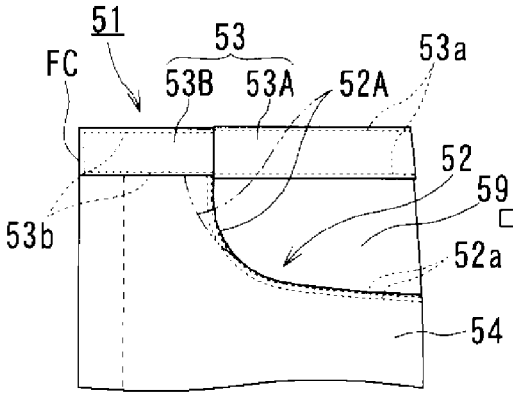
FIG. 15*b* is the partial enlarged drawing which indicates the condition that the left the L pocket of the cotton pants and the waist area neat that are shrunk.

FIG. 15*b* is the partial enlarged drawing which indicates the condition that the left the L pocket of the cotton pants and the waist area neat that are shrunk.

Figure 15C:
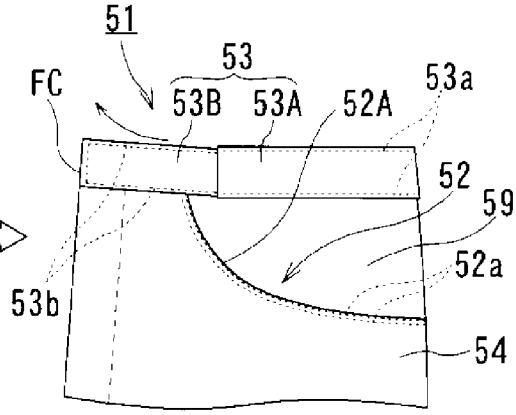
FIG. 15*c* is the partial enlarged drawing which indicates the condition that the waist area is stretched.

FIG. 15*c* is the partial enlarged drawing which indicates the condition that the waist area is stretched.

Figure 16A:
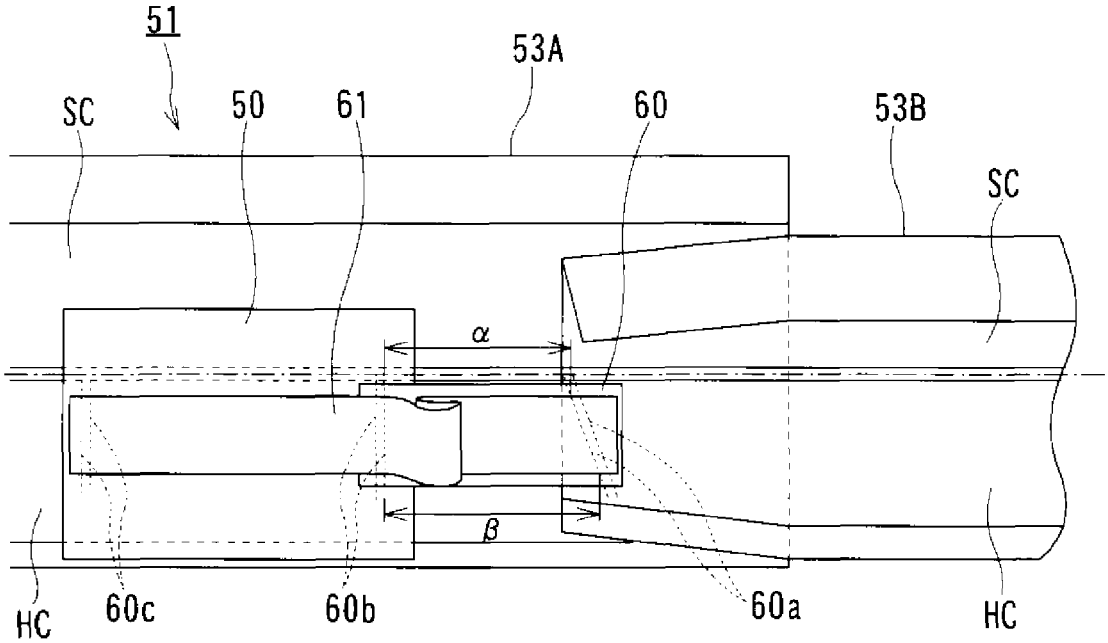
FIG. 16*a* is the part development drawing which indicates the structure that the reverse side of principal part of left L pocket of cotton pants as a pair of pants with The L pocket which is the result of the seventh embodiment of this invention is being midway sewn.

FIG. 16*a* is the part development drawing which indicates the structure that the reverse side of principal part of left L pocket of cotton pants as a pair of pants with The L pocket which is the result of the seventh embodiment of this invention is being midway sewn.

Figure 16B:
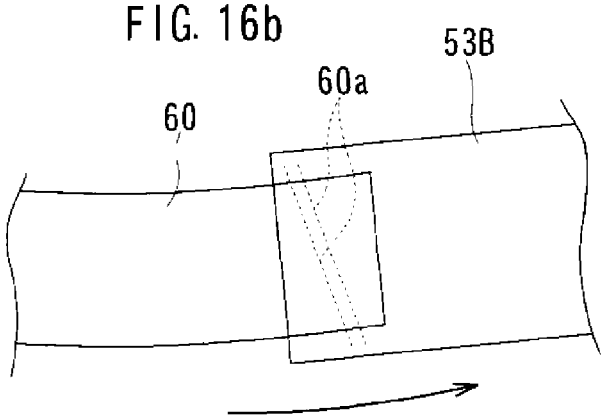
FIG. 16*b* is the diagram which indicates the function effect of a pair of pants with the L pocket which is the seventh embodiment of this invention.

FIG. 16*b* is the diagram which indicates the function effect of a pair of pants with the L pocket which is the seventh embodiment of this invention.

Figure 17A:
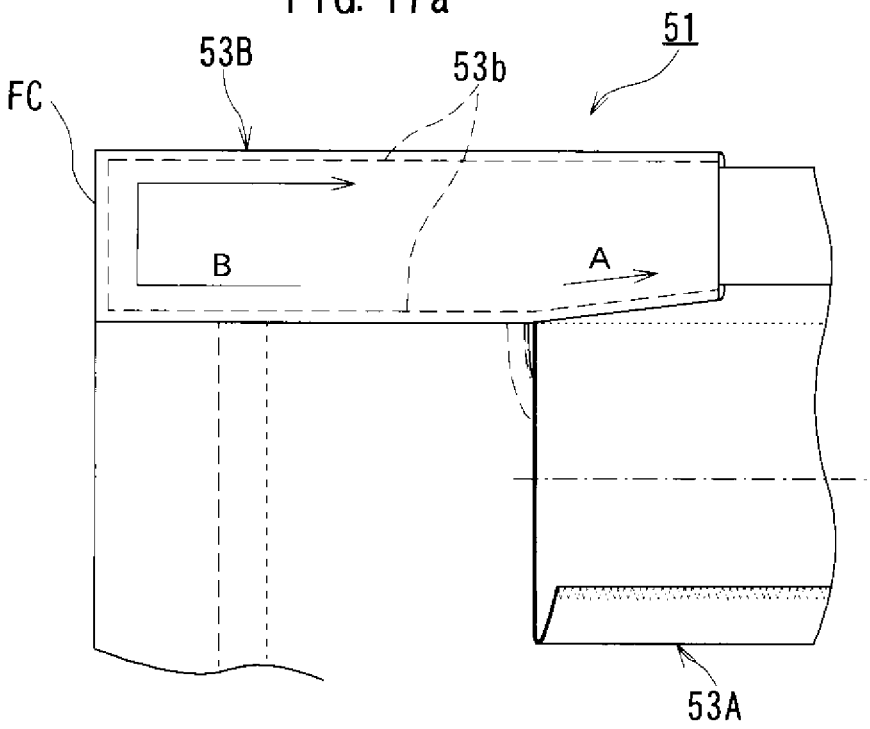
FIG. 17*a* and FIG. 17*b* are the partial enlarged drawings which indicate the procedure to stitch the belt cloth on the cotton pants which is the result of the seventh embodiment of this invention.
Figure 17B:
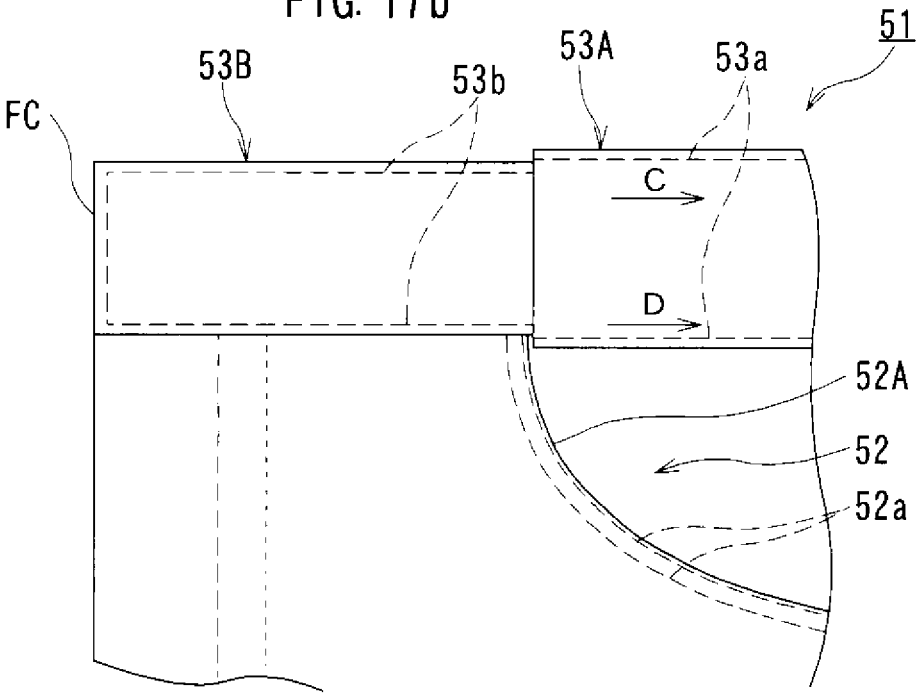

FIG. 17*a* and FIG. 17*b* are the partial enlarged drawings which indicate the procedure to stitch the belt cloth on the cotton pants which is the result of the seventh embodiment of this invention.

FIG. 18*a*, FIG. 18*b*, FIG. 18*c*, FIG. 18*d*, FIG. 18*e* and FIG. 18*f* are the diagrams which indicate the manufacturing procedure of the expansion and contraction structure of the outer edge of the left L pocket of a pair of pants with the L pocket which is the result of the seventh embodiment of this invention seen from the front side.

FIG. 19*a* is the partial development drawing which indicates the structure which the reverse side of the principal part of a pair of pants with the L pocket which is the result of the first deformation example of the seventh embodiment of this inventions being midway sewn.

FIG. 19*b* is the partial development drawing which indicates the structure that the reverse side of principal part of a pair of pants with the L pocket which is the result of the second deformation example of the seventh embodiment of this invention is being midway sewn.

FIG. 19*c* is the partial development drawing which indicates the structure that the reverse side of the principal part of a pair of pants with the L pocket which is the result of the third deformation example of the seventh embodiment of this invention is being midway sewn.

FIG. 19*d* is the partial development drawing which indicates the structure that the reverse side of the principal part of a pair of pants with the L pocket which is the result of the fourth deformation example of the seventh embodiment of this invention is being midway sewn.

As indicated in FIG. 15*a*, the cotton pants 51 as a pair of pants with the L pocket which is the result of this the seventh embodiment has the L pocket 52 which the right and left are united near the belt part 53 (i.e., the belt section) of the front bodice 54. And it has the structure which is capable of expansion and contraction around waist area which is capable of expansion and contraction on apparent length of the belt part 53 near the part (the upper part of the outer edge 52A) close to the front center FC of the outer edge 52A of the pocket entrance of these L pocket 52.

That is the doubled part (i.e., the doubled section) which is made of two sections, the storing part 53A (i.e., the storing section) and the elongating part 53B (i.e., the elongating section) that is inserted inside (i.e., at an inside space of) the storing part 53A is formed near the outer edge 52A of pocket entrance of the L pocket 52 which the right and left are united at the belt part 53. And it is to be capable of expansion and contraction on apparent length of the belt part 53 because the edge of the elongating part 53B and the storing part 53A get connected by the rubber tape as the primary elastic material inside (i.e., at the inside space of) the storing part 53A also, the patch cloth 59 which is made of cotton raw fabric which is common as the front bodice 54 is sewn at outside of the L pocket that the right and left are paired. In other words, the elongating part/section 53B is connected to the storing part/section 53A via the rubber tape 60 as the primary elastic material so that the elongating part/section 53B is movable to allow the belt part/section 53 to expand and contract.

Hereupon, as indicated in FIG. 15*b* and FIG. 15*c*, the belt cloth stitch 53*a* and 53*b* are conducted at the upper and the lower edges of the storing part 53A and the elongating part 53B. Regarding to the casual a pair of pants with the L pocket including Jeans and cotton pair of pants, it is common to conduct these belt cloth stitch 53*a* and 53*b*. However, there are cases the belt cloth stitch is not conducted on a pair of pants with the L pocket regarding to the dressy ladies' a pair of pants which is not casual.

Figure 34A:
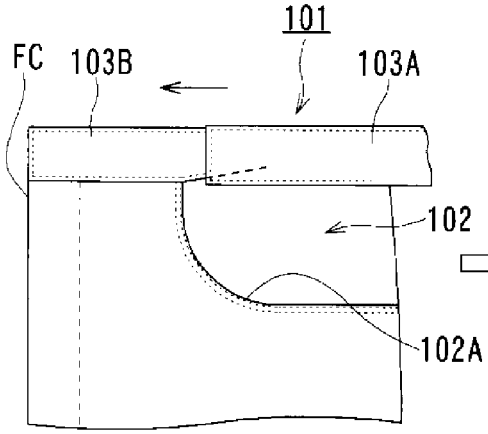
FIG. 34*a* and FIG. 34*b* are diagrams which indicate the issue areas in the event of the elongating part to be pulled out as the elongating part of pants which have the L pocket, adopted the structure of being capable of expansion and contraction on waist size, is rubbed and moved against the storing part.
Figure 34B:
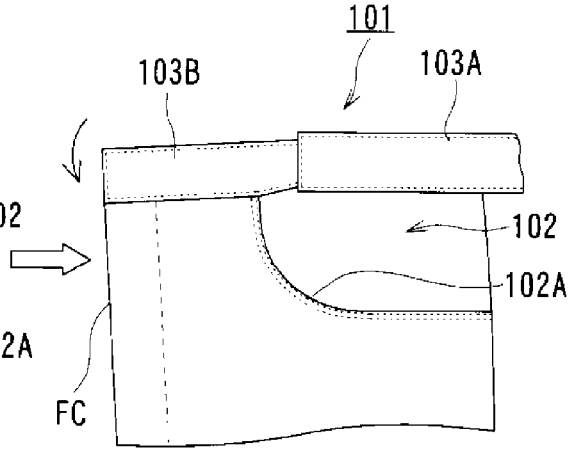
Figure 34C:
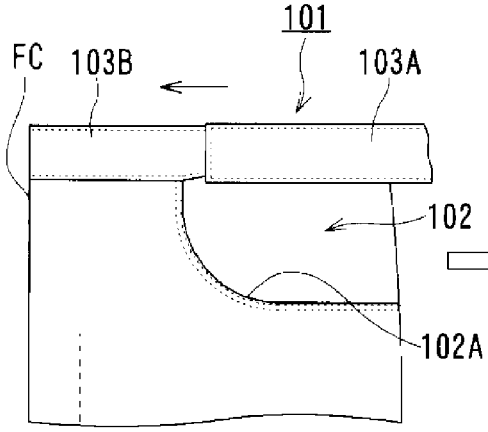
FIG. 34*c* and the FIG. 34*d* are the diagrams which indicate a solution of the issue in the event of the elongating part to be pulled out as the elongating part of pants which have the L pocket is adopted the structure of being capable of expansion and contraction on waist size, is rubbed and moved against the storing part.
Figure 34D:
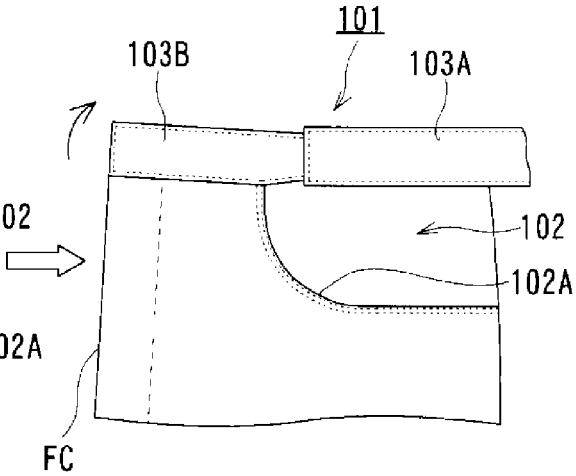
Figure 35A:
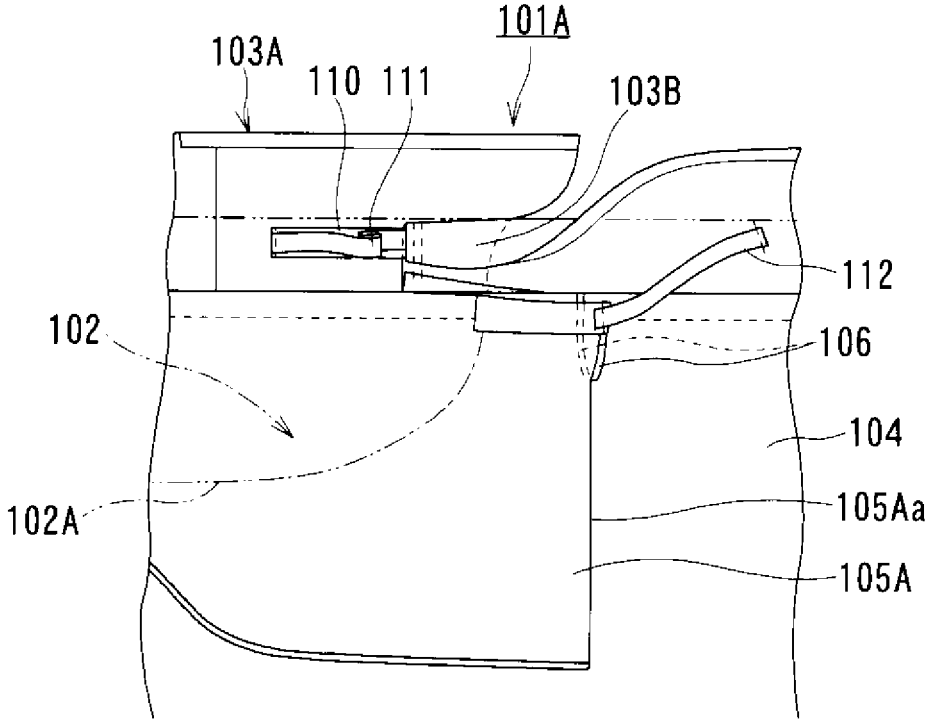
FIG. 35*a* is a partially enlarged drawing which shows around the L pocket from the reverse before sewing on to the elongating part and the storing part of the pants which has the L pocket which adopted the structure that is capable of expansion and contraction for a waist size.
Figure 35B:
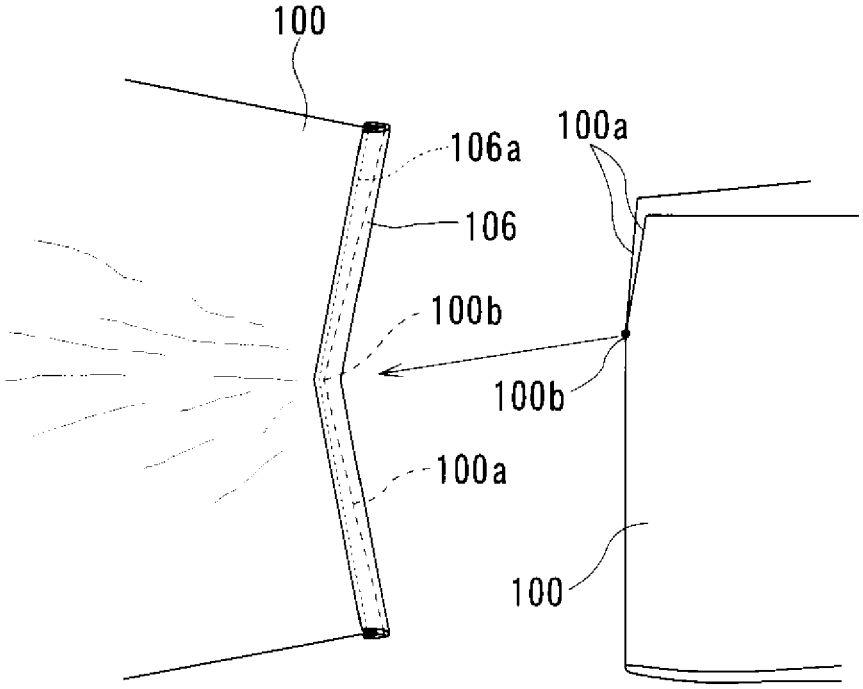
FIG. 35*b* is a diagram which shows issues when conducting the piping on the L pocket saccate cloth.
Figure 36A:
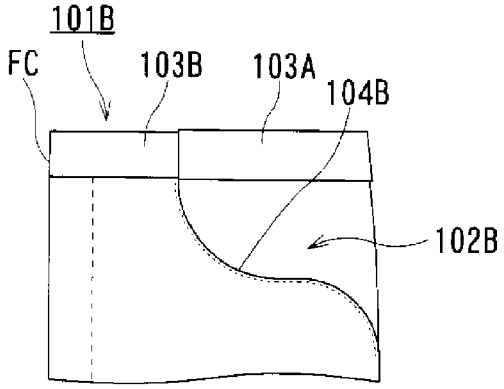
FIG. 36*a* and FIG. 36*b* are the diagrams which show the pocket which has the Letter S shaped line and it is a kind of the L pockets.
Figure 36B:
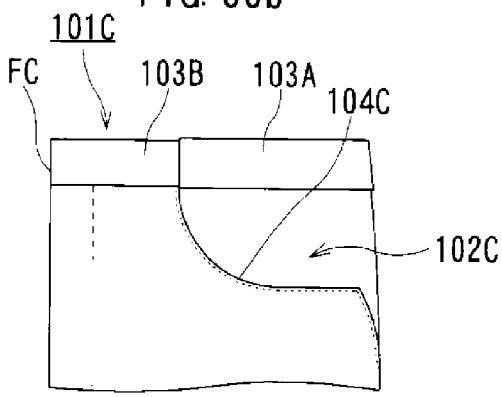
Figure 36C:
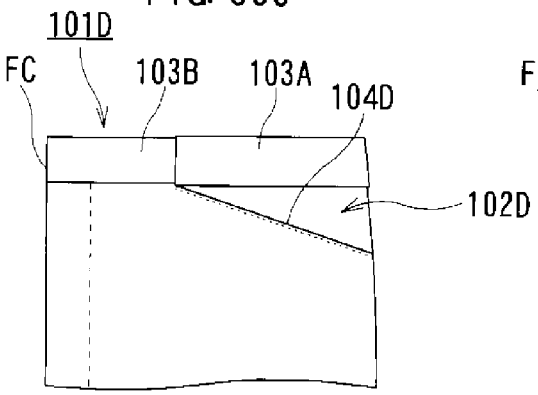
FIG. 36*c* and FIG. 36*d* are the diagrams which show the pocket which has straight line and it is a kind of The L pockets.
Figure 36D:
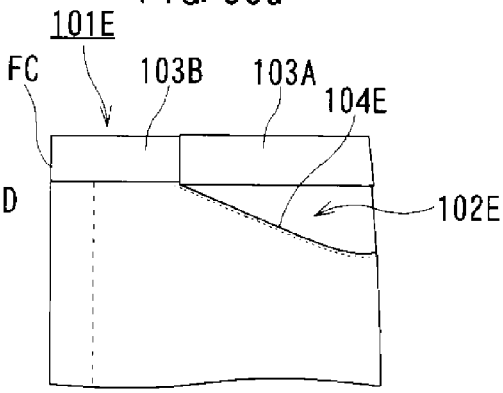

By conducting these belt cloth stitch 53*a* and 53*b*, as indicated in FIG. 15*b* and FIG. 15*c*, it is necessary to shorten the width of the elongating part 53B than the width of the storing part 53A by approximately 2 mm because the width which is capable of storing is narrowed down by the portion of the belt cloth stitch 53*a* inside the storing 53B. Due to this, as explained regarding FIG. 34*a* and FIG. 34*b* at the beginning, it results as the step, between the elongating part 103B and the storing part 103A occurred by lowering the elongating part 103B when the elongating part 103B gets pulled out from the storing part 103A, stands out much more.

Thereupon, regarding the cotton pants 51 as a pair of pants with the L pocket which is the result of this the seventh embodiment, as indicated in FIG. 15*c* with arrow, the step which is mentioned above becomes less noticeable by making the elongating part 53B raise when the elongating part 53B gets pulled out from the storing part 53A (i.e., the elongating part/section 53B is pulled out of the storing part/section 53A in a raised manner) and the outward appearance of a pair of pants with the L pocket which has the structure which is capable of expansion and contraction around waist area improves remarkably.

That is, in case that the pulling force is not working at the belt part 53, as indicated in FIG. 15*b*, the upper part of the outer edge 52A of the L pocket 52 matches with the storing part 53A and if the waist area stretches by working the pulling force to the belt part 53, as indicated in FIG. 15*c*, also the upper part of the outer edge 52A of the L pocket 52 moves as paired with the elongating part 53B, however as indicated with arrow, the mentioned above steps becomes unnoticeable by the elongating part 53B moving upward.

Next, it is to explain regarding the inner structure to make the elongating part 53B raise when thus the elongating part 53B gets pulled out from the storing part 53A referring to FIG. 16. As indicated in FIG. 16*a*, regarding the cotton pants 51 which is the result of this the seventh embodiment, the adhesive cloth padding 50 is adhered inside the storing part 53A and the rubber tape 60 as the primary elastic material and one edge of the stretch stopper material 61 are sewn on at this adhesive cloth padding 50. In other words, the rubber tape 60 as the primary elastic material has one longitudinal end fixed on the storing part/section 53A, and the adhesive cloth padding 50 is fixed inside the storing part/section 53A, the one end of the rubber tape 60 as the primary elastic material being sewn on the adhesive cloth padding 50. FIG. 16*a* further illustrates that the storing part/section 53A has an inner sheet and an outer sheet so as to form the inside space therein, that the storing part/section 53A has an opening end of the inner sheet and an opening end of the outer sheet formed into a vertical line, respectively, so as to be substantially perpendicular to a longitudinal direction of the belt part/section 53, and that the elongating part/section 53B has one longitudinal portion inserted in the inside space of the storing part/section 53A so as to be covered by the storing part/section 53A, and an other longitudinal portion protruded from the storing part/section 53A.

Then, the rubber tape 60 and the other edge of the stretch stopper material 61 are sewn on at the edge part of the elongating part 53B diagonally as the upper edge inclines to the side of the storing part 53A by the diagonal stitch 60*a* as indicated in FIG. 16*a*. In other words, the rubber tape 60 as the primary elastic material has an other longitudinal end fixed on the elongating part/section 53B, and the diagonal stitch 60*a* is formed in an inclined manner to the vertical line of the storing part/section 53A to fix the other longitudinal end of the rubber tape 60 as the primary elastic material at an edge part of the elongating part/section 53B. Due to this, the Length of the part which is capable of expansion and contraction of the rubber tape 60, at the upper edge, becomes the Length $\alpha$ (i.e., a first length) between the upper edge of the stitch 60*b*, by which one edge of the rubber tape 60 and a center of the stretch stopper material 61 are sewn on to the adhesive cloth padding 50 and the stretch stopper 61, and the upper edge of the diagonal stitch 60*a* and, at the lower edge, becomes the Length $\beta$ (i.e, a second length) between the lower edge of the stitch 60*b* and the lower edge of the diagonal stitch 60*a*. As illustrated in FIG. 16*a*, the stitch 60*b* is a second stitch, such that the one longitudinal end of the rubber tape 60 as the primary elastic material has the second stitch 60*b* parallel to the vertical line of the storing part/section 53A and is fixed on the storing part/section 53A by the second stitch 60*b*, the first length (i.e., Length $\alpha$) is defined between an upper end of the second stitch 60*b* at the one end of the rubber tape 60 as the primary elastic material and an upper end of the diagonal stitch 60*a* at the other end of the rubber tape 60 as the primary elastic material, the second length (i.e., Length $\beta$) is defined between a lower end of the second stitch 60*b* at the one end of the rubber tape 60 as the primary elastic material and a lower end of the diagonal stitch 60*a* at the other end of the rubber tape 60 as the primary elastic material, the first length (i.e., Length α) is set smaller than the second length (i.e., Length β), and the rubber tape 60 as the primary elastic material has an upper edge part shorter than a lower edge part thereof between the diagonal stitch 60*a* and the second stitch 60*b*.

Hereupon, due to the result that the Lower edge of the rubber tape 60 stretches longer than the upper edge of the rubber tape 60 when the elongating part 53B moves to the direction pulling out of the storing part 53A s indicated in FIG. 16*b* because the Length β is longer than the Length α, the elongating part 53B, as indicated by arrow, ends up moving up to the upper. Thus, the elongating part 53B raises when the elongating part 53B gets pulled out of the storing part 53A.

In addition, the stretch stopper material 61 is sewn on the adhesive cloth padding 50 by loosening as much as the tolerance of the rubber tape 60 allows (For example, 2 cm) with the other edge of the rubber tape 60, and this adhesive cloth padding 50 is adhered over the soft padding SC and the hard padding HC inside the storing part 53A by the adhesive. Then the other edge of the stretch stopper material 61 pierces the belt cloth with the adhesive cloth padding 50 by two stitches 60*c* to be sewn on. Therefore, two stitches 60*c* can be visible from the front side of the cotton pants 51.

However the belt hole is attached at total 5 parts of the cotton pants 51. one of the belt hole is attached positioning right above of the two stitches 60*c*, therefore two stitches 60*c* hide behind the belt hole and become invisible from the front so that the beauty of the cotton pants 51 can not be lost. That is, as mentioned above, regarding a pair of pants with the L pocket, the belt hole was attached at 7 parts a circumference previously, but in recent years it became the main current to attach the belt hole at 5 parts a circumference, so the intervals between the adjoined belt holes tend to be longer. Even in such case, as indicated in FIG. 16*a* it is that the edge of the stretch stopper material 61 is extended in order to be able to hide those two stitches 60*c* by the belt hole which is apart from the belt hole.

And the reason why the adhesive cloth padding 50 is set had the purpose to strengthen the storing part 53A in order to be able to resist the impact of the bio-washing (bio-process) because especially in case of Jeans, there is a lot of times that by the bio-washing (bio-process) the fluff is taken off by the enzyme destroying the surface of the cloth instantly or getting the feel of worn out vintage jeans by washing with the pumice stones. Such bio-washing (bio-process) is enforced not only for Jeans but also the cotton pants 51.

Therefore, regarding a pair of pants with the L pocket such as the cotton pants etc. that does not practice bio-washing or enzyme washing, there is no need to set the adhesive cloth padding 50. In this case, the other edge of the stretch stopper 61 pierces the belt cloth including the hard padding HC by two stitches 60*c* and sewn on. Even in this case, the edge of the stretch stopper material 61 is to be extended as indicated in FIG. 16*a* in order to be able to hide two stitches 60*c* by the belt hole which is apart from the belt hole.

Hereupon, it is to explain regarding the procedure to sew on the belt cloth stitch 53*a* and 53*b* referring to FIG. 17. As indicated in FIG. 17*a*, first the belt cloth stitch 53*b* is applied at the Lower edge of the elongating part 53B as indicated by the arrow A at the condition that the storing part 53A is expanded, then the belt cloth stitch 53*b* is applied at the upper edge of the elongating part 53B turning around the front center FC side of the elongating part 53B by doubling the Lower edge of the elongating part 53B as indicated by the arrow B. And the storing part 53A is folded in and the belt cloth stitch 53*a* is applied to the direction which going apart from the elongating part 53B as indicated by the arrow C and the arrow D along with the upper edge and the Lower edge of the storing part 53A.

Moreover, regarding the cotton pants 51 as a pair of pants with the L pocket which is the result of this the seventh embodiment, the outer edge 52A of the L pocket smoothly deforms without occurring wrinkles around the L pocket 52 when waist area stretches by the structure which is capable of expansion and contraction around waist area and the elongating part 53B moves to the direction that is pulled out from the storing part 53A. This is because the outer edge 52A of the L pocket 52 has expansion and contraction. It is to explain regarding the sewing method which is to make the outer edge 52A of this The L pocket 52 have expansion and contraction referring to FIG. 18. All FIG. 18*a*, FIG. 18*b*, FIG. 18*c*, FIG. 18*d*, FIG. 18*e* and FIG. 18*f* indicate the procedure of sewing seen the left side the L pocket 52 from the front side.

Figure 18A:
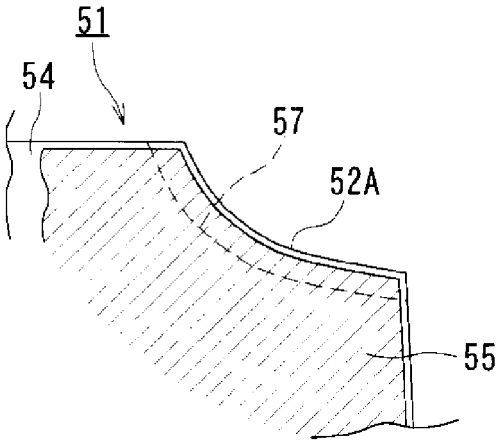
FIG. 18*a*, FIG. 18*b*, FIG. 18*c*, FIG. 18*d*, FIG. 18*e* and FIG. 18*f* are the diagrams which indicate the manufacturing procedure of the expansion and contraction structure of the outer edge of the left L pocket of a pair of pants with the L pocket which is the result of the seventh embodiment of this invention seen from the front side.
Figure 18B:
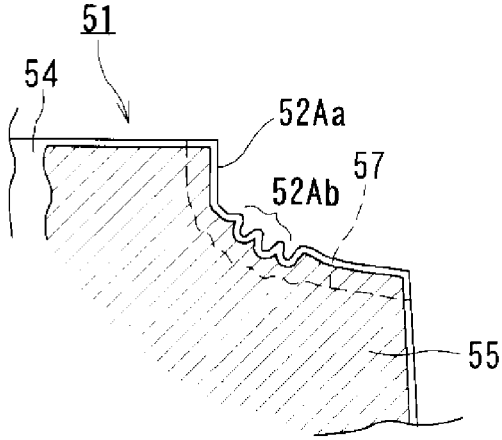

First as indicated in FIG. 18*a*, the raw fabric 55 that is cut adjusting with the form of the outer edge 52A of the L pocket 52 at the front side of the front bodice 54 of the cotton pants 51 is sewn on by the plain seaming 57. Next as indicated in FIG. 18*b*, it is to compress and press over the outer edge center part 52Ab with the steam iron at the condition that the upper part 52A of the outer edge 52A is put diagonally and the center part 52Ab of the outer edge 52A is shrunk to the Length direction. Due to this, the wrinkles of the outer edge center part 52Ab which is shrunk are flattened nicely and as indicated in FIG. 18*c*, it becomes the smooth curve line.

Figure 18C:
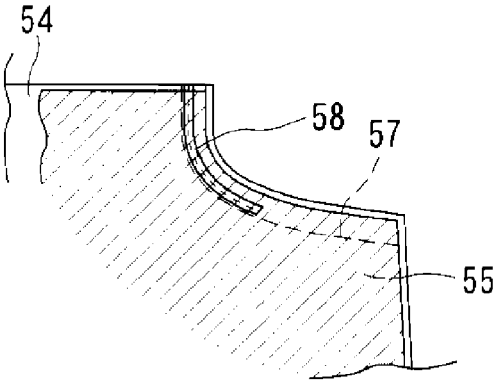
Figure 18D:
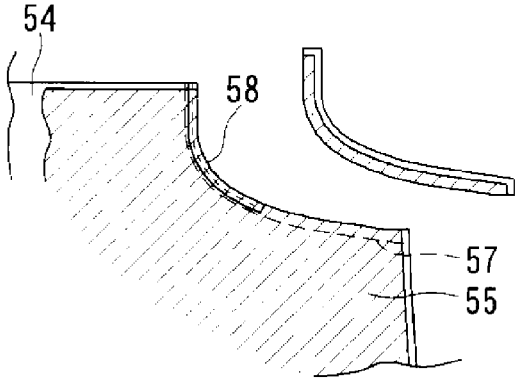
Figure 18E:
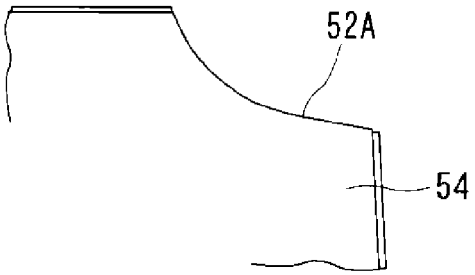
Figure 18F:
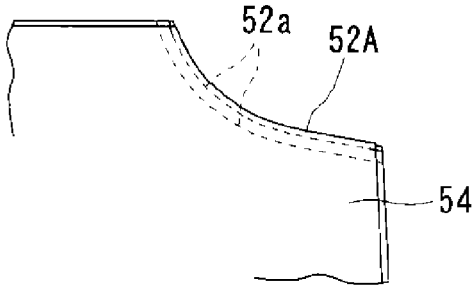

Over this as indicated in FIG. 18*c*, it is to sew on the belt shaped power net 58 as the raw fabric which has expansion and contraction along with the seam of the plain seaming 57. Then as indicated in FIG. 18*d*, it is to cut off the surplus part of the outer side along with the edge of the belt shaped power net 58, as indicated in FIG. 18*e*, it is to fold over the saccate cloth 55 at the part of the plain seaming 57 and then to turn over the saccate cloth to the other side that is the reverse side of the cotton pants 51. Then as indicated in FIG. 18*f*, the structure of the L pocket 52 which the outer edge center part 52Ab is capable of expansion and contraction by applying the double stitch 52*a* long with the outer edge 52A of the new L pocket 52.

In addition, regarding this seventh embodiment, the margin for a seam from the outer edge 52A of the plain seaming 57 is left big as 1.0 cm in order to make the plain seaming 57 easy to sew, so as indicated in FIG. 18*d*, a process to cut off the surplus part of the outer side along with edge of the belt shaped power net 58 is to become necessary, however the process to cut off the surplus part of the outer side becomes unnecessary if the margin for a seam from the outer edge 52A of the plain seaming 57 is left small as 0.5 cm from the beginning, so this method can be taken.

Thus, regarding the cotton pants 51 as a pair of pants with the L pocket which is the result of this the seventh embodiment, the elongating part 53B which structures the structure which is capable of expansion and contraction around waist area and the doubled part of the storing part 53A re positioned near the outer edge 52A close to the front center FC of the L pocket 52, therefore the edge of the storing part 53A becomes the appearance that smoothly connects to the outer edge 52A close to the front center FC of the L pocket and the beauty can not be lost even without hiding the edge of the storing part 53A.

Also, the belt shaped power net 58 as the raw fabric which has expansion and contraction at the condition that the outer edge center part 52Ab is shrunk to the Length direction and then is pressed from the reverse side with steam iron is sewn on over it, so the upper part 52A of the outer edge of the L pocket 52 also gets pulled to the direction of the center FC when the elongating part 53B moves to the direction that is to get pulled out to the center FC due to the waist area being stretched by the structure that is capable of expansion and contraction around waist area. However the center part 52Ab of the outer edge, as mentioned above, is made to be the structure that is capable of expansion and contraction, so it smoothly stretches and follows, so losing the outward appearance by wrinkling as previous around the L pocket 52 does not occur.

And when the force which tries to stretch waist area is released, the elongating part 53B again moves to the direction that is to be stored inside the storing part 53A by the rubber tape 60 as the primary elastic material that the both edges between the elongating part 53B and the storing part 53A are connected, but at this time also the center part 52Ab of the outer edge of the L pocket smoothly shrink and follow because of being the structure which is capable of expansion and contraction and returns to the existed condition finely. Thus, regarding the cotton pants 51 as a pair of pants with the L pocket which is the result of this the seventh embodiment, it made possible to add the structure which is capable of expansion and contraction around waist are to a pair of pants with the L pocket which was thought to be impossible with the simple structure.

Thus, regarding the cotton pants 51 as a pair of pants with the L pocket which is the result of this the seventh embodiment, it makes the waist size capable of expansion and contraction by positioning the borderline of the elongating part 53B and the storing part 53A at the side close to the front center of the L pocket by keeping the outward appearance and beauty finely without letting the steps of the elongating part 53B and the storing part 53A felt by making the elongating part 53B raise when the waist area stretches by the elongating part 53B rubbing and moving against the storing part 53A.

Next, it is to explain regarding the cotton pants as a pair of pants with the L pocket which is the result of the first deformation example to the fourth deformation example of this the seventh embodiment referring to FIG. 19.

As indicated in FIG. 19*a*, the cotton pants 51A s a pair of pants with the L pocket which is the result of the first deformation example of this the seventh embodiment connects the middle of the elongating part 53B and the storing part 53A by only the rubber tape 60 as the primary elastic material without applying the adhesive cloth padding or the stretch stopper material. And it is to make the elongating part 53B raise when the waist area stretches by sewing the edge of the rubber tape 60 and the edge part of the elongating part 53B by diagonal stitch 60*a*.

Also, as indicated in FIG. 19*c*, regarding the cotton pants 51B as a pair of pants with the L pocket which is the result of the second deformation example of this the seventh embodiment, the point that the middle between the elongating part 53C and the storing part 53A is connected only by the rubber tape 60 as the primary elastic material is the same, however the edge part of the elongating part 53C is cut diagonally as the same portion as the inclined angle of the inclined stitch 60*a*. In other words, the one longitudinal portion of the elongating section has an end cut diagonally corresponding to an inclined angle of the diagonal stitch. Due to this, when sewing on the edge of the rubber tape 60 and the edge part of the elongating part 53C by the inclined stitch 60*a*, it can be sewn on along with the edge part of the elongating part 53C, so the sewing becomes easy.

Also, as indicated in FIG. 19*c*, regarding the cotton pants 51C as a pair of pants with The L pocket which is the result of the third deformation example of this the seventh embodiment, it is connected in the middle of the elongating part 53B and the storing part 53A after juxtaposing the stretch stopper material 61 at the rubber tape 60 as the primary elastic material. And it is made the elongating part 53B raise when the waist area stretches by sewing on the rubber tape 60 and the edge of the stretch stopper material 61 and the edge part of the elongating 53B with the inclined stitch 60*a*.

Moreover, as indicated in FIG. 19*d*, regarding the cotton pants 51D as a pair of pants with the L pocket which is the result of the fourth deformation example of this the seventh embodiment, the point to connect the middle of the elongating part 53B and the storing part 53A is the same after juxtaposing the stretch stopper material 61 to the rubber tape 60 as the primary elastic material, however the edge part of the elongating 53C is cut diagonally as the same portion as the inclined angle of the inclined stitch 60*a*. Due to this, it can be sewn on along with the edge part of the elongating part 53C when the rubber tape 60 and the edge of the stretch stopper material 61 and the edge part of the elongating part 53C are sewn on with the inclined stitch 60*a*, so the sewing becomes easy.

Eighth Embodiment

Next, it is to explain regarding a pair of pants with the L pocket that is the result of the eighth embodiment of this invention referring to FIG. 20.

Figure 20A:
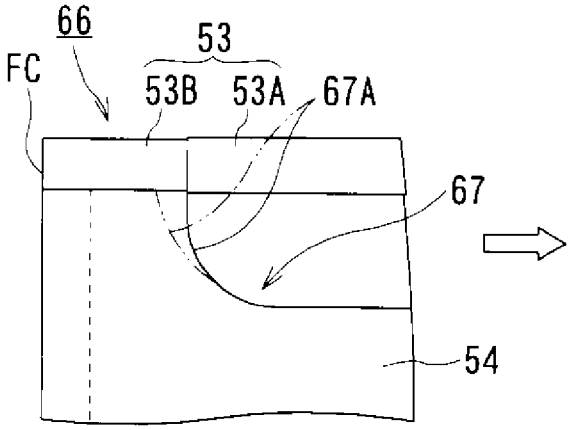
FIG. 20*a* is the partial enlarged drawing which indicates the condition the left L pocket of the cotton pants as a pair of pants with The L pocket which is the result of the eighth embodiment of this invention and the waist area near that are shrunk.

FIG. 20*a* is the partial enlarged drawing which indicates the condition the left L pocket of the cotton pants as a pair of pants with The L pocket which is the result of the eighth embodiment of this invention and the waist area near that are shrunk.

Figure 20B:
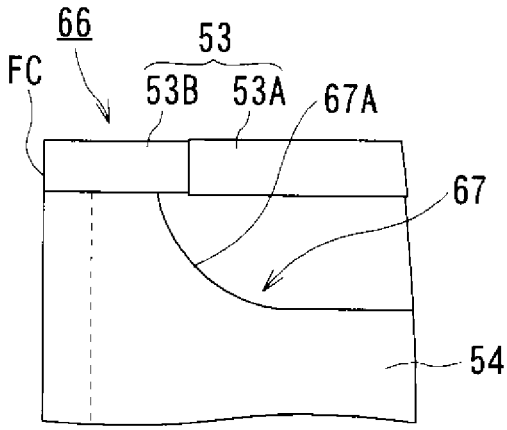
FIG. 20*b* is the partial enlarged drawing which indicates the condition that the waist area is stretched.

FIG. 20*b* is the partial enlarged drawing which indicates the condition that the waist area is stretched.

Figure 20C:
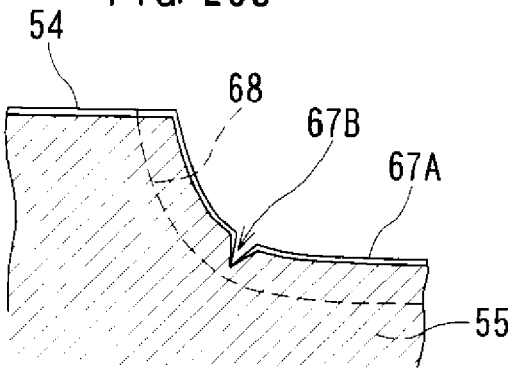
FIG. 20*c* and FIG. 20*d* are the diagrams which indicate the manufacturing procedure of the structure of expansion and contraction of the outer edge of the Left The L pocket seen from the front side.
Figure 20D:
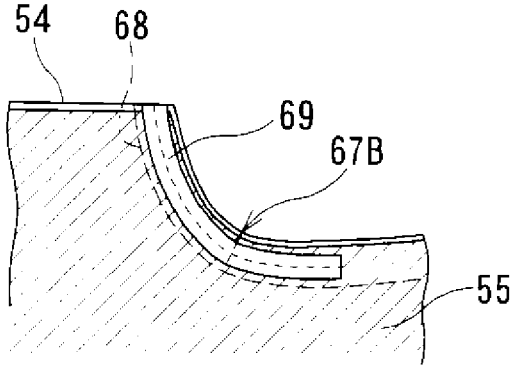

FIG. 20*c* and FIG. 20*d* are the diagrams which indicate the manufacturing procedure of the structure of expansion and contraction of the outer edge of the Left The L pocket seen from the front side.

Figure 20E:
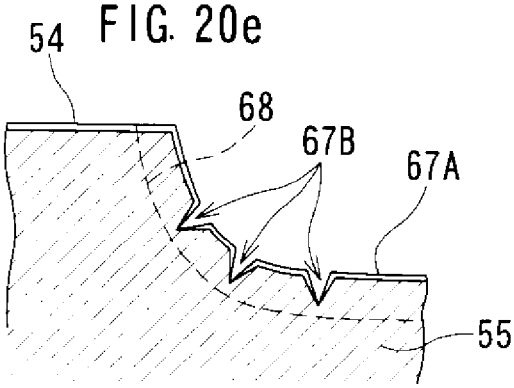
FIG. 20*e* is a diagram which indicates the structure of expansion and contraction of the outer edge of the left L pocket of the cotton pants which is the result of the deformation example of the eighth embodiment of this invention seen from the front side.

FIG. 20*e* is a diagram which indicates the structure of expansion and contraction of the outer edge of the left L pocket of the cotton pants which is the result of the deformation example of the eighth embodiment of this invention seen from the front side.

The cotton pants 66 as a pair of pants with the L pocket which is the result of this the eighth embodiment, has the right and left paired the L pocket 67 near the belt part 53 of the front bodice as well as the cotton pants 51 as a pair of pants with the L pocket which is the result of the seventh embodiment and has the structure which is capable of expansion and contraction around waist area which is capable of expansion and contraction on the apparent length of the belt part 53 near the part (the upper part of the outer edge 67A) close to the front center FC of the outer edge 67A of the pocket entrance of these L pocket 67.

That is, as well as the seventh embodiment, the doubled part that is made of the storing part 53A and the elongating part 53B which is to be inserted inside the storing part 53A is formed near the outer edge 67A of the pocket entrance of right and left paired the L pocket 67 at the belt part and it is made the apparent length of the belt part 53 capable of expansion and contraction by that the edge of the elongating part 53B and the storing part 53A re connected inside the storing part 53A by the rubber tape 60 as the primary elastic material.

And it is the same as the cotton pants 51 which is the result of the seventh embodiment about the points that the rubber tape 60 and the other edge of the stretch stopper material 61 are sewn on diagonally that the upper edge is to incline to the storing part 53A side with the inclined stitch 60 at the edge part of the elongating part 53B and that the elongating part 53B moves to raise to upper as a result of that the lower edge of the rubber tape 60 stretches longer than the upper edge of the rubber tape 60 when the elongating part 53B moves to the direction that is to pulled out of the storing part 53A.

Due to this, in case that the pulling force is not applied at the belt part 53, as indicated in FIG. 20*a*, the upper part of the outer edge 67A of The L pocket 67 corresponds to the edge of the storing part 53A. When the waist area gets stretched by applying the pulling force to the belt part 53, as indicated in FIG. 20*b*, the upper part of the outer edge 67A of the L pocket 67 moves as united to the elongating part 53B and the outer edge 67A of the L pocket 67 smoothly deforms without occurring wrinkles etc. around the L pocket 67.

This is because the outer edge of the L pocket 67 has expansion and contraction.

It is to explain about the sewing method which to make the outer edge 67A of this The L pocket have expansion and contraction referring to FIG. 20*c*.

First, as indicated in FIG. 20*c*, the raw fabric 55 of the saccate cloth which is cut adjusting the form of the outer edge 67A of the L pocket is to be sewn by the plain seaming 68 at the front side of the front bodice 54 of the cotton pants 66.

Next, the slit 67B is applied at the center part of the outer edge 67A. Then as indicated in FIG. 20*d*, the belt shaped power net 69 as the raw fabric which has expansion and contraction is to be sewn over the center part of the outer edge along with the seam of the plain seaming 68 at this condition.

In addition, regarding this the eighth embodiment, the process which is to cut the edge of the outer edge 67A s the seventh embodiment is not going to be necessary because the seam of the plain seaming 68 is taken small as 0.5 cm from the beginning, however the method that is to cut off the edge of the outer edge 67A fter sewing the belt shaped power net 69 by taking 1.0 cm of seam of the plain seaming 68 as well as the seventh embodiment can be taken as well.

The rest, as well as indicated in FIG. 18*e* of the seventh embodiment, folding over the saccate cloth 55 at the part of the plain seaming 68 and turning over the saccate cloth 55 to the other side, that is to the reverse side of the cotton pants 66.

Then, as indicated in FIG. 18*f*, the structure of the L pocket 67 that is capable of expansion and contraction at the center part of the outer edge completes by stitching the double stitch 62*a* long with the outer edge 67A of new The L pocket 67.

Thus, regarding the eighth embodiment, it is to be the L pocket 67 that is capable of expansion and contraction at the center part of the outer edge 67A by applying the slit 67B at the center part of the outer edge 67A, so the process that is to press with steam iron as the seventh embodiment can be omitted and it can make the outer edge 67A of the L pocket 67 have expansion and contraction much easier and shorter of time.

In addition, the slit 67B is not limited to one, as indicated in FIG. 20*e*, the belt shaped power net 69 as the raw fabric which has expansion and contraction over the center part of the outer edge at this condition that the slit 67 B that was applied at 3 parts are shrunk can be also sewn along with the seam of the plain seaming 68.

Due to this, when the elongating part 53B moves to the direction that it is pulled out of the storing part 53A s waist area stretches by the structure which is capable of expansion and contraction around waist area, the upper part 67A of the outer edge of the L pocket 67 also gets pulled to the front center FC direction, however the center part 67A of the outer edge, as mentioned above, is made to be the structure which is capable of expansion and contraction, so it smoothly stretches and follows that the outward appearance would not be lost by wrinkling as present around the L pocket 67.

Then, when the force that tries to stretch the waist area is released, the elongating part 53B moves to the direction that it is stored inside the storing part 53A by the rubber tape as the primary elastic material that the both edges between the elongating part 53B and the storing part 53A re connected. However even in this case the center part 67A of the outer edge of the L pocket 67 smoothly shrinks and follows because of the structure that is capable of expansion and contraction and returns to the existed condition finely. Thus, regarding the cotton pants 66 as a pair of pants with the L pocket that is the result of this the eighth embodiment, it was to make possible to add the structure that is capable of expansion and contraction around waist area to a pair of pants with the L pocket which was thought to be impossible by simple structure.

Thus, regarding the cotton pants 66 as a pair of pants with the L pocket that is the result of this the eighth embodiment, it can make waist size capable of expansion and contraction by positioning the borderline between the elongating part 53B and the storing part 53A close to the front center FC of the L pocket 67, by keeping the outward appearance and beauty finely and by not making the step between the elongating part 53B and the storing part 53A felt by making the elongating part 53B raise when waist area stretches as the elongating part 53B rubbing and moving against the storing part 53A.

In addition, regarding this the eighth embodiment, the patch cloth 59 which is made of cotton raw fabric as common as the front bodice 54 of the cotton pants 66 at the front side of the saccate cloth 55 of the L pocket 67, but the saccate cloth 55 itself of The L pocket can be structured with the cotton raw fabric which is common as the front bodice 54 depending on the material and thickness of the front bodice 54.

Ninth Embodiment

Next, it is to explain regarding a pair of pants with the L pocket that is the result of the ninth embodiment of this invention referring to FIG. 21.

Figure 21A:
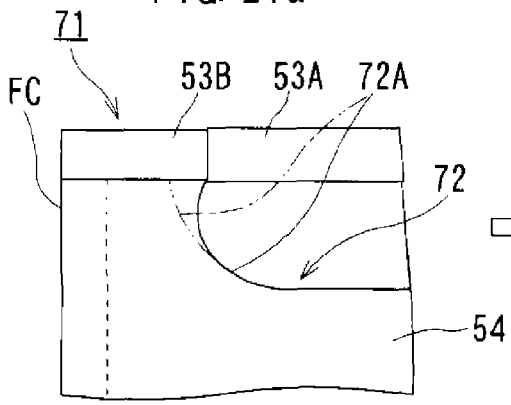
FIG. 21*a* is the partial enlarged drawing which indicates the condition that the left L pocket of the cotton pants as a pair of pants with the L pocket which is the result of the ninth embodiment of this invention and the waist area near that are shrunk.

FIG. 21*a* is the partial enlarged drawing which indicates the condition that the left L pocket of the cotton pants as a pair of pants with the L pocket which is the result of the ninth embodiment of this invention and the waist area near that are shrunk.

Figure 21B:
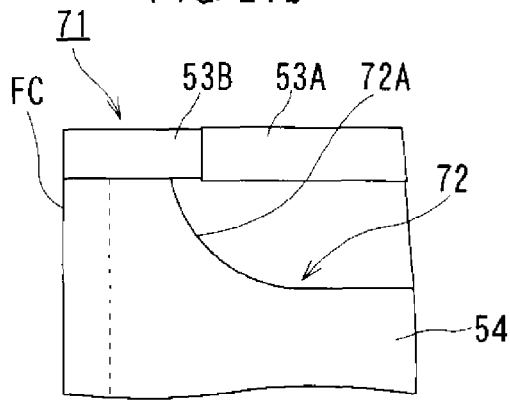
FIG. 21*b* is the partial enlarged drawing which indicates the condition that the waist area is stretched.

FIG. 21*b* is the partial enlarged drawing which indicates the condition that the waist area is stretched.

The cotton pants 71 as a pair of pants with the L pocket which is the result of this ninth embodiment has the L pocket 72 that the right and left are paired near the belt part 53 of the front bodice and has the structure that is capable of expansion and contraction around waist area that the apparent length of the belt part 53 is capable of expansion and contraction near the part (the upper part of the outer edge 72A) close to the front center FC of the outer edge 72A of the pocket entrance of these the L pocket 72.

That is, as well as the seventh embodiment, the doubled part that is made of the storing part 53A and the elongating part 53B which is to be inserted inside the storing part 53A is formed near the outer edge 72A of the pocket entrance of the L pocket 72 that the right and the left are paired at the belt part 53. The apparent length of the belt part 53 is to be capable of expansion and contraction by that the edge of the elongating part 53B and the storing part 53A re connected with the rubber tape 60 as the primary elastic material at inside the storing part 53A.

Then, the rubber tape 60 and the other edge of the stretch stopper material 61 are sewn on diagonally as that the upper edge inclines to the side of the storing part 53A by the inclined stitch 60 at the edge part of the elongating part 53B. And when the elongating part 53B moves toward the direction that is pulled out of the storing part 53A, the Lower edge of the rubber tape 60 stretches longer than the upper edge of the rubber tape 60 so that the elongating part 53B moves as it raises upper direction is the same as the cotton pants 51 which is the result of the seventh embodiment.

Due to this, in case that the pulling force is not applied to the belt part 53, as indicated in FIG. 21*a*, the upper part the outer edge 72A of The L pocket 72 corresponds to the edge of the storing part 53A and when the pulling force applies to the belt part 53 and waist area stretches, as indicated in FIG. 21*b*, the upper part of the outer edge 72A of the L pocket 72 moves together with the elongating part 53B and the outer edge 72A of the L pocket 72 smoothly deforms without occurring wrinkles etc. around The L pocket 72.

The reason why is that, as indicated in FIG. 21*a*, the outer edge 72A of the L pocket 72 is formed curved as projecting to the front center direction FC as it goes from the upper part that connects to the belt part 53 to the Lower part.

Due to this, when the elongating part 53B moves to the direction that is pulled out of the storing part 53A s waist area stretches by the structure which is capable of expansion and contraction around waist area, the upper part of the outer edge 72A of The L pocket 72 also gets pulled to the front center FC direction, however, the upper part of the outer edge 72 A can smoothly follow because the center part of the outer edge 72A is projecting more to the front center FC direction than the upper part of the outer edge 72A and the outward appearance would not be lost by wrinkling as present around the L pocket 72.

Moreover, it is not necessary to press with iron etc. from the reverse side at the condition that the center part of the outer edge 72A is shrunk at the Length direction or to sew on the raw fabric which has the expansion and contraction over that at the condition that the slit is shrunk which was applied more than one at the center part of the outer edge 72A s belt shaped. It is only enough to change the form of the raw fabric, so the manufacturing process is much easier and much shorter to proceed.

Then, when the force which tries to stretch the waist area is released, the elongating part 53B again moves to the direction that is stored inside the storing part 53A by the rubber tape 60 as the primary elastic material that the both edges are connected between the elongating part 53B and the storing part 53A, however, also at this case, the upper part of the outer edge 72A of the L pocket 72 smoothly can follow and returns to the existed form of the L pocket 72 finely. Thus, regarding the cotton pants 71 as a pair of pants with The L pocket which is the result of this the ninth embodiment, it made possible to add the structure which is capable of expansion and contraction around waist to a pair of pants with the L pocket which is the result of this the ninth embodiment by extremely simple structure.

Thus, regarding the cotton pants 71 as a pair of pants with the L pocket which is the result of this the ninth embodiment, by making the elongating part 53B raise when the waist area stretches by that the elongating part 53B rubbing and moving against the storing part 53A, waist size could be capable of expansion and contraction by positioning the borderline between the elongating part 53B and the storing part 53A t the side close to the front center FC of the L pocket 72, by keeping the outward appearance and beauty finely and by not making the steps between the elongating part 53B and the storing part 53A.

In addition, also regarding to this the ninth embodiment, the patch cloth 59 that is made of the cotton raw fabric which is common as the front bodice of the cotton pants 71 is sewn on at the front side of the saccate cloth 55 of the L pocket 72, however, the saccate cloth 55 itself of the L pocket 72 can be structured from the cotton raw fabric which is common as the front bodice 54 depending on the material or thickness of the front bodice.

Tenth Embodiment

Next, it is to explain regarding a pair of pants with the L pocket which is the result of the tenth embodiment of this invention referring to FIG. 22 and FIG. 23.

Figure 22A:
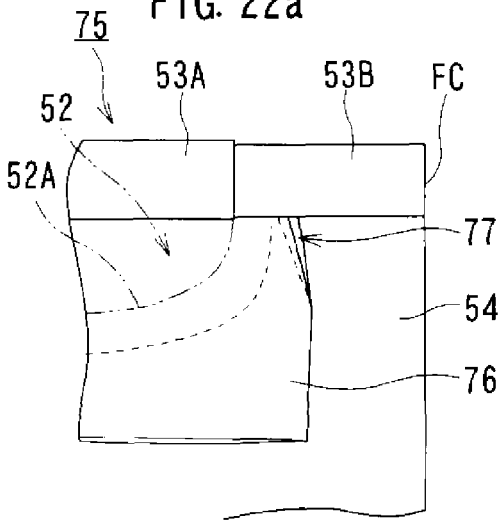
FIG. 22*a* is the partial enlarged drawing which indicates the condition that the left L pocket of the cotton pants as a pair of pants with the L pocket which is the result of the tenth embodiment of this invention and the waist area near that are shrunk seeing from the reverse side.

FIG. 22*a* is the partial enlarged drawing which indicates the condition that the left L pocket of the cotton pants as a pair of pants with the L pocket which is the result of the tenth embodiment of this invention and the waist area near that are shrunk seeing from the reverse side.

Figure 22B:
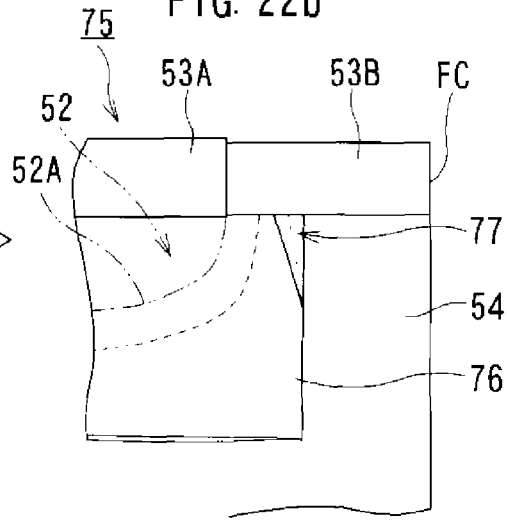
FIG. 22*b* is the partial enlarged drawing which indicates the condition that the waist area is stretched seeing from the reverse side.

FIG. 22*b* is the partial enlarged drawing which indicates the condition that the waist area is stretched seeing from the reverse side.

Figure 23A:
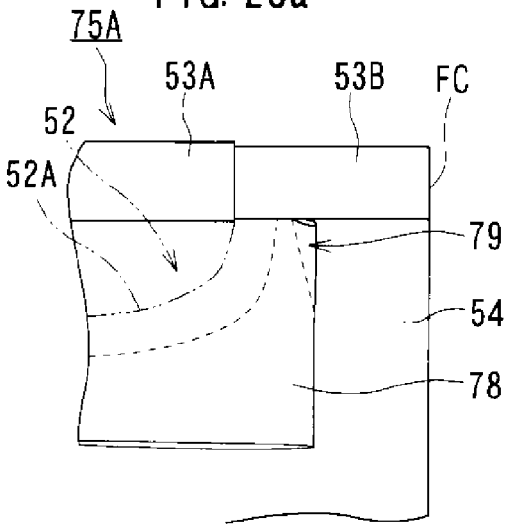
FIG. 23*a* is the partial enlarged drawing which indicates the condition that the right the L pocket of the cotton pants as a pair of pants with the L pocket which is the result of the deformation example of the tenth embodiment of this invention and the waist area near that are shrunk seeing from the reverse side.

FIG. 23*a* is the partial enlarged drawing which indicates the condition that the right the L pocket of the cotton pants as a pair of pants with the L pocket which is the result of the deformation example of the tenth embodiment of this invention and the waist area near that are shrunk seeing from the reverse side.

Figure 23B:
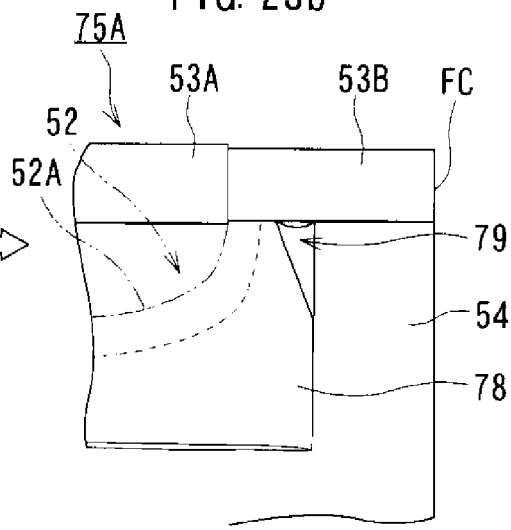
FIG. 23*b* is the partial enlarged drawing which indicates the condition that the waist area is stretched seeing from the reverse side.

FIG. 23*b* is the partial enlarged drawing which indicates the condition that the waist area is stretched seeing from the reverse side.

The cotton pants as a pair of pants with the L pocket which is the result of this the tenth embodiment has the L pocket which the right and the left are paired near the belt part of the front bodice as well as the cotton 51 as a pair of pants with the L pocket which is the result of the seventh embodiment and has the structure which is capable of expansion and contraction around waist area that is capable of expansion and contraction on the apparent length of the belt part 53 near the part close to the front center of the outer edge of the pocket entrance of these the L pocket.

That is, as well as the seventh embodiment, the doubled part which is made of the storing part 53A and the elongating part 53B that is to be inserted inside the storing part 53A is formed near the outer edge of the pocket entrance of the L pocket which right and left are paired at the belt part 53 and the apparent length of the belt part 53 is to be capable of expansion and contraction by that the edge of the elongating part 53B and the storing part 53A re connected by the rubber tape 60 as the primary elastic material inside the storing part 53A.

And the rubber tape 60 and the other edge of the stretch stopper material 61 are sewn on diagonally as the upper edge inclines to the side of the storing part 53A by the inclined stitch 60 at the edge part of the elongating part 53B. When the elongating part 53B moves to the direction that is pulled out of the storing part 53A, the lower edge of the rubber tape 60 stretches longer than the upper edge of the rubber tape, as a result, the elongating part 53B moves as it is raised to upper etc. These points are the same as the cotton pants 51 which is the result of the seventh embodiment.

As indicated in FIG. 22*a*, regarding the cotton pair of pants 75 as a pair of pants with the L pocket which is the result of this tenth embodiment, the tuck 77 is applied at the upper part of the cuff part of the edge of the front center FC side of the saccate cloth 76 of the L pocket and the borderline between the storing part 53A which structures the structure which is capable of expansion and contraction around waist area and the elongating part 53B is positioned near this tuck 77. Therefore, positioning in case of forming the tuck 77 is extremely easy and also the upper part of the outer edge 52A of the L pocket corresponds to the edge of the storing part 53A at the front side, so that the beauty would not be lost even it is not hidden by the belt hold.

Then in case that the elongating part 53B moves by the structure of expansion and contraction of waist, as indicated in FIG. 22*b*, accompanied with that, following by the saccate cloth 76 of the L pocket moves, the tuck 77 opens so that the saccate cloth 76 of the L pocket does not get twisted or go tight and losing the outward appearance definitely can be prevented by such twist or stretch influence to the front side. Hereupon, it is desirable that the width of the pleats of tuck 77 is larger than the portion of expansion and contraction by the structure which is capable of expansion and contraction around waist area. Due to this, even in case that the waist area of a pair of the pair of pants 75 with the L pocket stretches up to the Limit of the structure which is capable of expansion and contraction around waist area, the pulling force definitely can be released because the tuck 77 can be opened with ease.

The structure of the saccate cloth 76 of the L pocket which such tuck 77 is applied, can release the pulling force when the waist area of the cotton pants 75 as a pair of pants with the L pocket expands and contracts sufficiently and by itself and can prevent effectively by occurring the wrinkles around the L pocket 52 seeing from the front side. Also, in case that is commonly used with the structure of the outer edge of the L pocket at the cotton pants 51, 66 and 71 as a pair of pants with the L pocket which is the result of the seventh embodiment to the ninth embodiment which are mentioned above, it can prevent much more effectively by occurring wrinkles around the L pocket seeing from the front when waist area of a pair of pants 51, 66 and 71 with the L pocket expands and contracts.

Also, as indicated in FIG. 23*a*, regarding the cotton pants 75A s a pair of pants with the L pocket which is the result of the deformation example of this the tenth embodiment, tuck 79 which does not have the pleats is applied by leaving the upper part of the cuff part of the edge at the side of the front center FC of the saccate cloth 78 of the L pocket and the borderline between the storing part 53A which structures the structure which is capable of expansion and contraction around waist area near this tuck 79 and the elongating part 53B is positioned. Therefore, it is extremely easy to position in case of forming the tuck 79 and also the upper part of the outer edge 52A of the L pocket corresponds with the edge of the storing part 53A t the front side, so that the beauty would not be lost even it is not hidden by the belt hole.

And in case of that the elongating part 53B is moves by the structure of expansion and contraction of waist, as indicated in FIG. 23*b*, accompanied with that tuck 79 opens following the saccate cloth 78 of the L pocket moves, so the saccate cloth 78 of the L pocket does not get twisted or go tight and it definitely can be prevented to lose the outward appearance by stretching of such tuck 79 influences to the front side. Hereupon, the width that the tuck 79 opens is desirable to be larger than the portion of expansion and contraction by the structure which is capable of expansion and contraction around waist area. Due to this, the pulling force definitely can be released because the tuck 70 can be opened with ease even in the case that the waist area of a pair of pants 75A with the L pocket stretches up to the Limit of the structure which is capable of expansion and contraction around waist area.

The structure of the saccate cloth 78 of the L pocket that such tuck 79 is applied can release the pulling force when the waist area of the cotton pants 75 as a pair of pants with the L pocket expands and contracts sufficiently by itself and it can effectively prevent to occur wrinkles around the L pocket seeing from the front. Also, in case of that to commonly use with the structure of the outer edge of the L pocket which is cotton pants 51, 66 and 71 as a pair of pants with the L pocket which is the result of the seventh embodiment to the ninth embodiment as mentioned above, occurring the wrinkles etc. around the L pocket seeing from the front can be prevented much more effectively when the waist area of a pair of pants 51, 66 and 71 with the L pocket expands and contracts.

Thus, regarding the cotton pants 75 and 75A s a pair of pants with the L pocket which is the result of this the tenth embodiment, by making the elongating part 53B raise when waist area stretches by the elongating part 53B rubbing and moving against the storing part 53A, the waist size can be made capable of expansion and contraction by positioning the borderline between the elongating part 53B and the storing part 53A t the side close to the front center of the L pocket without being the steps between the elongating part 53B and the storing part 53A felt or losing the outward appearance and beauty.

Eleventh Embodiment

Next, it is to explain regarding a pair of pants with the L pocket which is the result of the eleventh embodiment of this invention referring to FIG. 24.

Figure 24A:
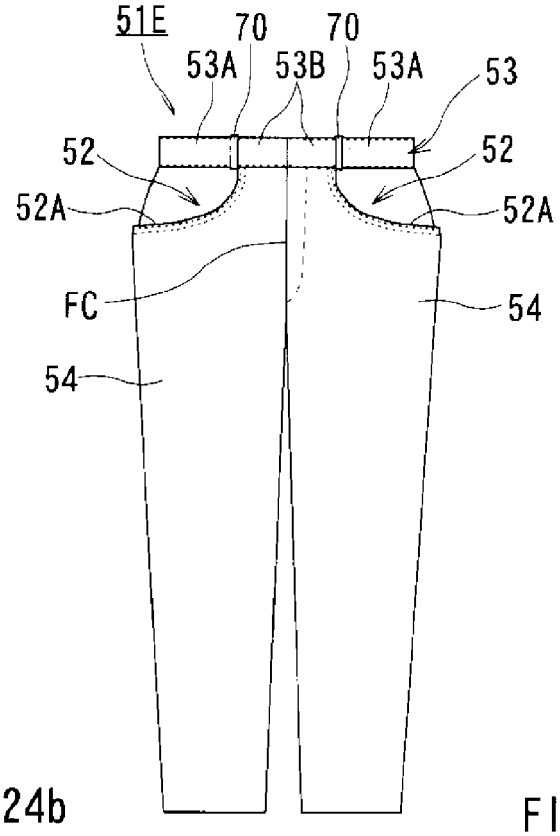
FIG. 24*a* is the diagram which indicates the whole structure of the cotton pants as a pair of pants with the L pocket which is the result of the eleventh embodiment of this invention.

FIG. 24*a* is the diagram which indicates the whole structure of the cotton pants as a pair of pants with the L pocket which is the result of the eleventh embodiment of this invention.

Figure 24B:
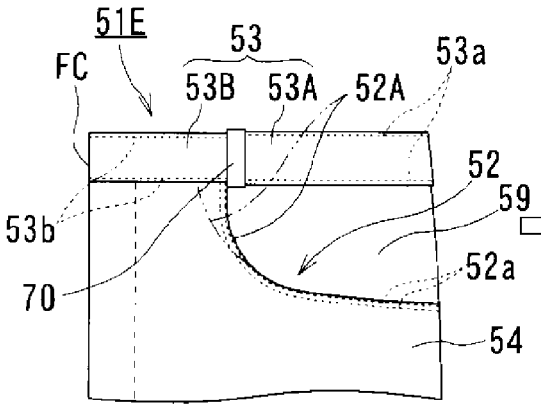
FIG. 24*b* is the partial enlarged drawing which indicates the condition that the left L pocket of the cotton pants and waist area neat that are shrunk.

FIG. 24*b* is the partial enlarged drawing which indicates the condition that the left L pocket of the cotton pants and waist area neat that are shrunk.

Figure 24C:
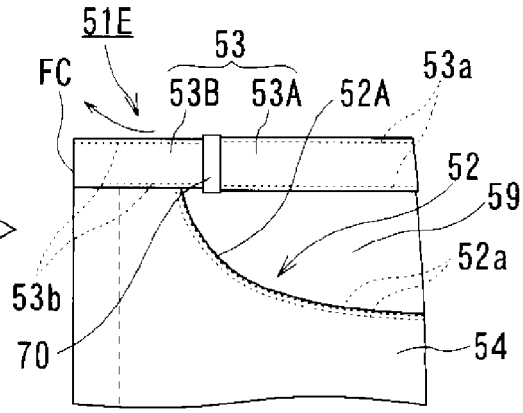
FIG. 24*c* is the partial enlarged drawing which indicates the condition that the waist area is stretched.

FIG. 24*c* is the partial enlarged drawing which indicates the condition that the waist area is stretched.

In addition, the composition of the structure which is capable of expansion and contraction of waist, the L pocket of the cotton pants 51E as a pair of pants with the L pocket which is the result of this the eleventh embodiment and the outer edge is the same as the cotton pants 51 which is the result of the seventh embodiment as indicated in FIG. 15, FIG. 16, FIG. 17 and FIG. 18, so the explanation is to be omitted by adding the same sign for the same part. As indicated in FIG. 24, the point that the cotton pants 51E as a pair of pants with the L pocket which is the result of this the eleventh embodiment differs from the cotton pants 51 which is the result of the seventh embodiment is the belt hole 70 is applied at the belt part 53.

That is, as indicated in FIG. 24*a*, regarding the cotton pants 51E which is the result of this the eleventh embodiment, a paired belt hole 70 is sewn at the border of the both the right and the left the storing part 53A and the elongating part 53B of the belt part 53. Certainly, it is unnatural if the belt hole is only one pair, so the same sort of belt hole 70 is sewn at the both armpit parts and the back part of the belt part 53 of the cotton pants 51 by taking adequate intervals. Due to this, it becomes a pair of pants with the L pocket which the outward appearance and beauty are much more superior because the edge of the storing part 53A gets hidden completely by the belt hole 70.

Due to this, regarding the cotton pants 51E as a pair of pants with the L pocket which is the result of this the eleventh embodiment, by make the elongating part 53B raise when the waist size stretches it is not only that the steps between the elongating part 53B and the storing part 53A does not being felt but also the edge of the storing part 53A gets completely hidden by the belt hole 70, so the waist size can be capable of expansion and contraction by positioning the borderline of the elongating part 53B and the storing part 53A t the side close to the front center of the L pocket without losing the outward appearance and beauty.

Twelfth Embodiment

Next, it is to explain regarding a pair of pants with the L pocket which is the result of the twelfth embodiment of this invention referring to FIG. 25, FIG. 26, FIG. 27, FIG. 28, FIG. 29, FIG. 30 and FIG. 31.

Figure 25A:
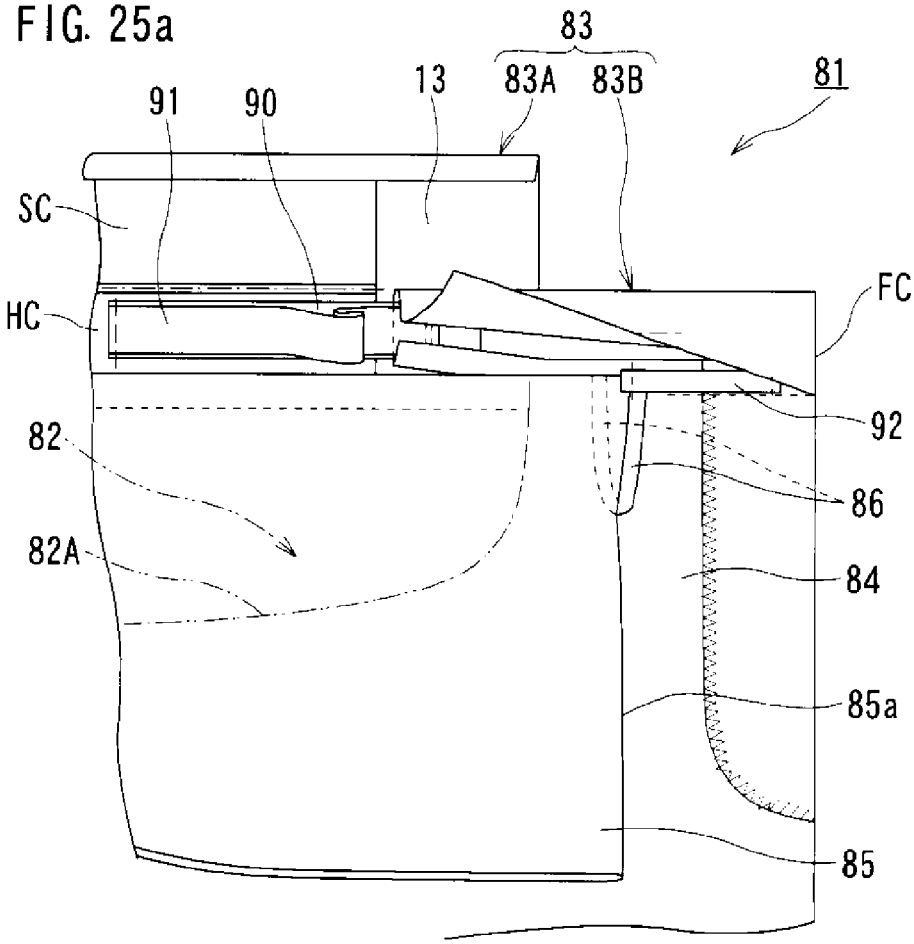
FIG. 25*a* is the partial enlarged drawing which indicates the structure of midway on sewing of the principal part's reverse side of the left L pocket of the cotton pants as a pair of pants with The L pocket which is the result of the twelfth embodiment of this invention.

FIG. 25*a* is the partial enlarged drawing which indicates the structure of midway on sewing of the principal part's reverse side of the left L pocket of the cotton pants as a pair of pants with The L pocket which is the result of the twelfth embodiment of this invention.

Figure 25B:
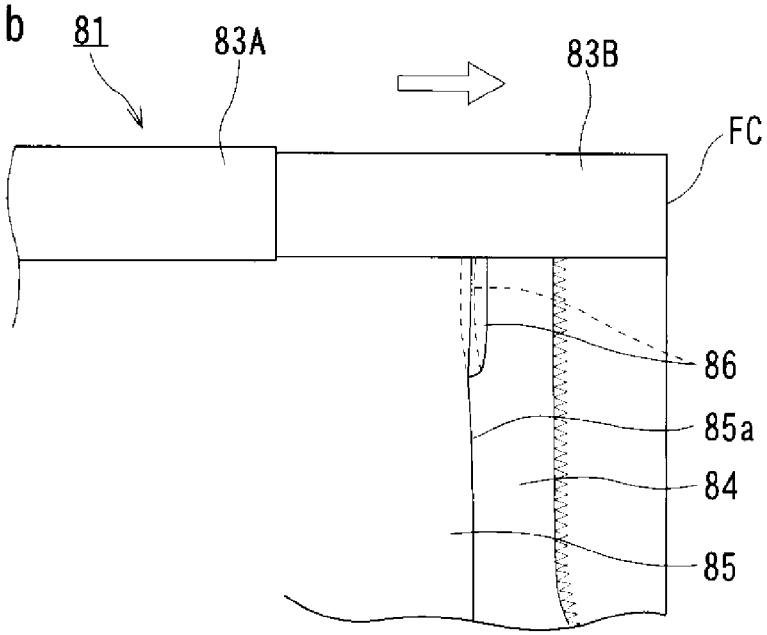
FIG. 25*b* is the diagram which indicates the function effect of a pair of pants with The L pocket which is the result of the twelfth embodiment of this invention.

FIG. 25*b* is the diagram which indicates the function effect of a pair of pants with The L pocket which is the result of the twelfth embodiment of this invention.

FIG. 26*a*, FIG. 26*b*, FIG. 26*c* and FIG. 26*d* are diagrams which indicate the sewing process of saccate cloth of the L pocket of the cotton pants as a pair of pants with the L pocket which is the result of the twelfth embodiment of this invention.

FIG. 27*a*, FIG. 27*b*, FIG. 27*c*, FIG. 27*d*, FIG. 27*e* and FIG. 27*f* are the diagrams which indicate the manufacturing procedures of the structure of expansion and contraction of the outer edge of the left L pocket of a pair of pants with the L pocket which is the result of the twelfth embodiment of this invention seeing from the front side.

FIG. 28*a*, FIG. 28*b*, FIG. 28*c* and FIG. 28*d* are the diagrams which indicate the sewing processes of saccate cloth of the L pocket of the cotton pants as a pair of pants with the L pocket which is the result of the first deformation example of the twelfth embodiment of this invention.

FIG. 29*a*, FIG. 29*b*, FIG. 29*c*, FIG. 29*d* and FIG. 29*e* are the diagrams which indicate the sewing processes of saccate cloth of the L pocket of the cotton pants as a pair of pants with the L pocket which is the result of the second deformation example of the twelfth embodiment of this invention.

FIG. 30*a*, FIG. 30*b*, FIG. 30*c* and FIG. 30*d* are the diagrams which indicate the sewing processes of saccate of the L pocket of the cotton pants as a pair of pants with the L pocket which is the result of the third deformation example of the twelfth embodiment of this invention.

FIG. 31*a*, FIG. 31*b*, FIG. 31*c*, FIGS. 31*d* and 31*e* are the diagrams which indicate the sewing processes of saccate of the L pocket of the cotton pants as a pair of pants with the L pocket which is the result of the fourth deformation example of the twelfth embodiment of this invention.

As indicate in FIG. 25*a*, the cotton pants 81 as a pair of pants with the L pocket which is the result of this the twelfth embodiment has the right and the left paired L pocket 82 near the belt part 83 of the front bodice 84 and has the structure which is capable of expansion and contraction around waist area which is capable of expansion and contraction on the apparent length of the belt part 83 near the part (the upper part of the outer edge 82A) close to the front center FC of the outer edge 82A of pocket entrance of these the L pocket 82.

That is, the doubled part which is made of the storing part 83A and the storing part 83B which is to be inserted inside the storing part 83A near the outer edge 82A of pocket entrance of right and left one paired the L pocket 82 at the belt part 83 and by that the edge of the elongating part 83B and the storing part 83A re connected inside the storing part 83A by the rubber tape 90 as the primary elastic material and the stretch stopper 91, the apparent length of the belt part 83 is capable of expansion and contraction. Also, the thin rubber tape 92 as the supplemental elastic material is sewn on in order to keep the saccate cloth 85 of The L pocket 82.

Hereupon, as indicated in FIG. 25*a*, regarding the cotton pants 81 which is the result of this the twelfth embodiment, the piping part 86 is set by dividing the upper edge of the edge part 85*a* of the saccate cloth 85 of the L pocket 85.

Due to being set the piping part 86 like this, as indicated in FIG. 25*b*, the only inner side of piping part 86 of the upper edge of the saccate cloth 85 gets pulled accompanying rubbing and moving of the elongating part 83B but the left edge of the drawing of the front bodice 84 which the outer side of the piping part 86 of the upper edge of the saccate cloth 85 does not get pulled, so this part does not go tight and the fine outward appearance can be kept even by seeing from the front side.

And regarding the cotton pants 81 which is the result of this the twelfth embodiment, as explained in FIG. 42 in the beginning, the sewing method of the saccate cloth 85 is modified in order to solve the problem that is the cuff part 106*a* which is at the piping 106 of the present saccate cloth 105A is easy to be frayed.

Figure 26A:
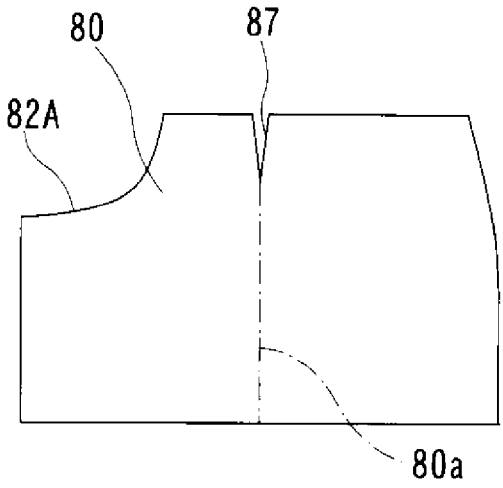
FIG. 26*a*, FIG. 26*b*, FIG. 26*c* and FIG. 26*d* are diagrams which indicate the sewing process of saccate cloth of the L pocket of the cotton pants as a pair of pants with the L pocket which is the result of the twelfth embodiment of this invention.

It is to explain regarding the sewing method of the saccate cloth 85 which is at the cotton pants 81 which is the result of this the twelfth embodiment referring to FIG. 26*a*.

First, as indicated in FIG. 26*a*, the slit 87 as the divided part from the upper part is applied to the cuff part 80*a* of the raw fabric 80 of the saccate cloth 85.

Figure 26B:
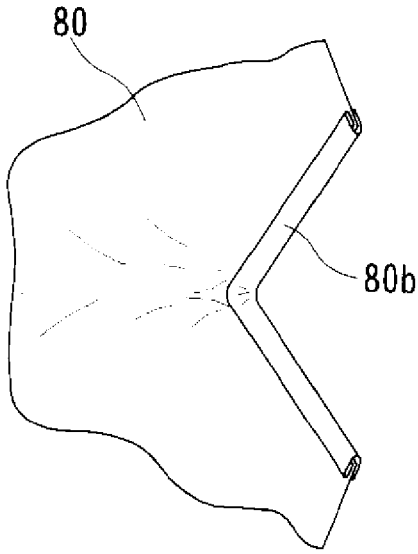

Next, as indicated in FIG. 26*b*, the piping 80*b* is conducted while supplying the bias cloth that is the material that forms the piping 80*b* by having recourse to the exclusive sewing machine for piping as extending the slit 87 of the raw fabric 80 of this saccate cloth 85.

Figure 26C:
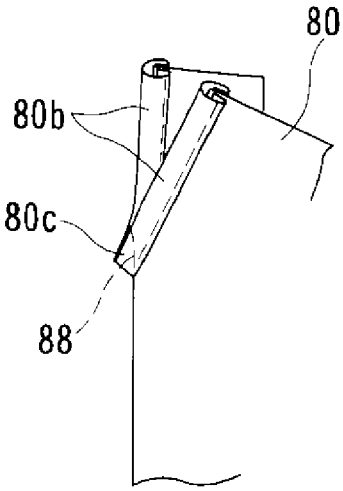
Figure 26D:
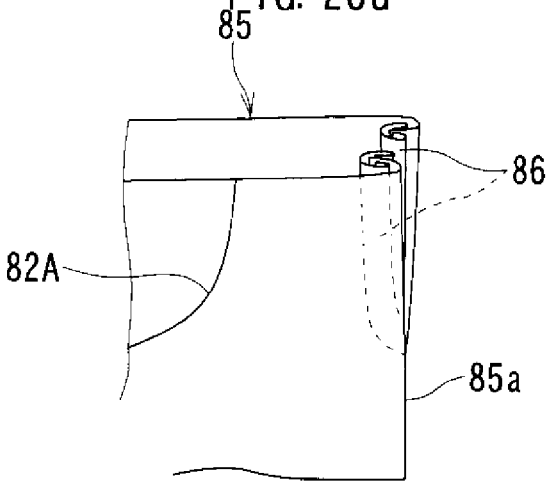

Next, as indicated in FIG. 26*c*, the pick sewing id conducted at the cuff part 80*c* of the Lower edge of piping 80*b*, as indicated in the FIG. 26 (*d*), the whole raw fabric 80 of the saccate cloth 85 is to turn over as the part that the pick sewing is conducted comes inside and the Lower edge of the raw fabric 80 of the saccate cloth 85 and the edge of the other side are to be sewn together.

Thus, the saccate cloth 85 of the cotton pants 81 is sewn. Due to this, the final piping part 86 that was formed is that the cuff part 80*c* of the lower edge of the piping 80*b* strengthens by that the pick sewing 88 is conducted to the cuff part 80*c* and turned over and the saccate cloth 85 is sewn. Therefore, it does not get frayed even if the force is put by wearing for the long period of time and repeating laundering.

And because the piping 80*b* is conducted at the divided part 87 that the upper part of the edge close to the front center FC of the saccate cloth 85 was divided by the slit 87, only the inner side of the piping part 86 of the upper edge of the saccate cloth 85 gets pulled accompanied by rubbing and moving of the elongating part 83B but the left edge of the front bodice 84 that the outer side of the piping part 86 of the upper edge of the saccate cloth 85 does not get pulled so that this part does not go tight. Therefore the fine outward appearance can be kept even seeing from the front side.

Moreover, regarding the cotton pants 81 as a pair of pants with the L pocket which is the result of this the twelfth embodiment, when the waist area moves to the direction that the elongating part 83B gets pulled out of the storing part 83A that the waist area stretches by the structure that is capable of expansion and contraction around waist area, the outer edge 82A of the L pocket 82 smoothly deforms without occurring wrinkles etc. around the L pocket 82. This is because the outer edge 82A of The L pocket 82 has expansion and contraction. It is to explain regarding the sewing method that to make the outer edge 82A of this The L pocket 82 have expansion and contraction referring to FIG. 27.

FIG. 27*a*, FIG. 27*b*, FIG. 27*c*, FIG. 27*d*, FIG. 27*e* and FIG. 27*f* are indicating the sewing method seeing all the left L pockets 82 from the front side.

Figure 27A:
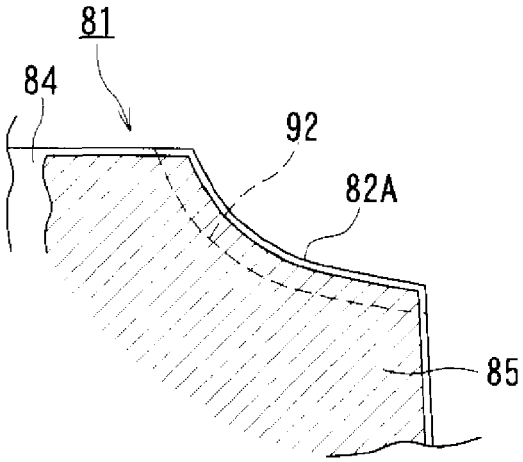
FIG. 27*a*, FIG. 27*b*, FIG. 27*c*, FIG. 27*d*, FIG. 27*e* and FIG. 27*f* are the diagrams which indicate the manufacturing procedures of the structure of expansion and contraction of the outer edge of the left L pocket of a pair of pants with the L pocket which is the result of the twelfth embodiment of this invention seeing from the front side.

First, as indicated in FIG. 27*a*, the raw fabric 85 of the saccate cloth that was cut adjusting to the form of the outer edge 82A of the L pocket 82 at the front side of the front bodice 84 of the cotton pants 81 to be sewn on by the plain seaming 92.

Figure 27B:
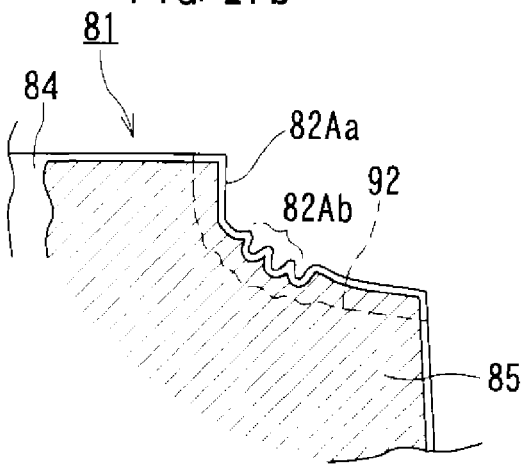

Next, as indicated in FIG. 27*b*, it is to compress with steam iron and press over the center part 82Ab of the outer edge at the condition that the center part 82Ab of outer edge 82A is shrunk to the Length direction while the upper part 82A of the outer edge 82A is put perpendicularly. Due to this, the wrinkles of the center part 82Ab of the outer edge at the condition that was shrunk flatten finely and as indicated in FIG. 27*c*, it becomes smooth curve line.

Figure 27C:
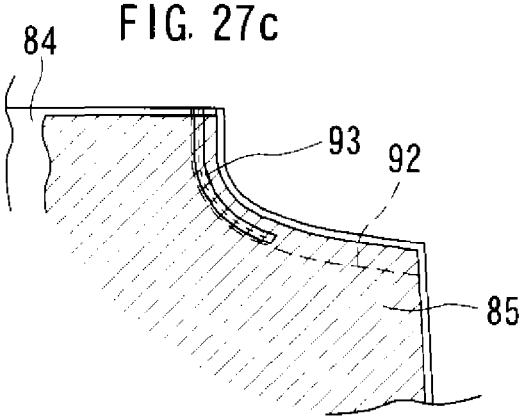

Over this, as indicated in FIG. 27*c*, the belt shaped power net 93 as the raw fabric which has expansion and contraction is sewn on along with the seam of the plain seaming 92.

Figure 27D:
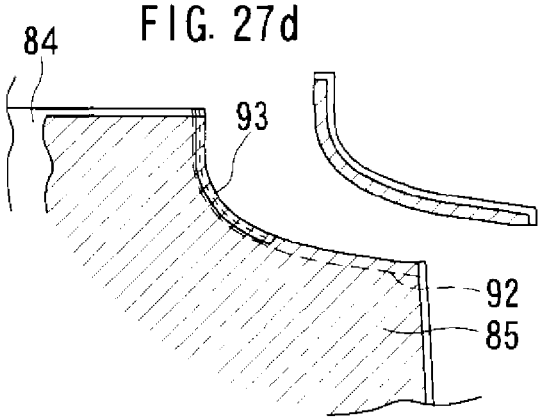
Figure 27E:
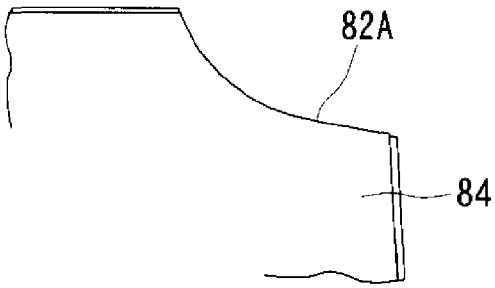

And as indicated in FIG. 27*d*, the surplus part of the outer side is cut off along with the edge of the belt shaped power net 93 and as indicated in FIG. 27*e* the saccate cloth 85 is folded over at the part of the plain seaming 92 and the saccate 85 is to be turned over to the other side that is the reverse side of the cotton pants 81.

Figure 27F:
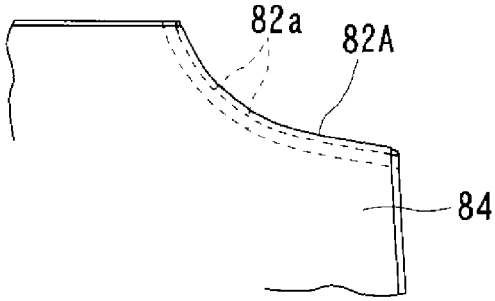

And as indicated in FIG. 27*f*, the structure of The L pocket 82 that the center part 82Ab of the outer edge is capable of expansion and contraction by stitching the double stitch 82*a* long with the outer edge 82A of new The L pocket 82.

In addition, regarding this the twelfth embodiment, the margin for a seam from the outer edge 82A of the plain seaming 92 is taken widely as 1.0 cm in order to make the plain seaming 92 easy to sew, so as indicated in FIG. 27*d*, the process that is to cut off the surplus area of the outer side along with the edge of the belt shaped power net 93 becomes necessary, however, this process that is to cut off the surplus part of the outer side becomes unnecessary if the margin for a seam from the outer edge 82A of the plain seaming 92 is taken small as 0.5 dm from the beginning, so this method can be taken.

Thus, regarding the cotton pants 81 as a pair of pants with the L pocket which is the result of this the twelfth embodiment, the doubled part of the storing part 83A and the elongating part 83B that structures the structure that is capable of expansion and contraction around waist area positions near the outer edge 82A close to the front center FC of the L pocket 82, so the edge of the storing part 83A becomes the appearance that seems to smoothly connect to the outer edge 82A close to the front center FC of the L pocket 82, therefore the beauty can not be lost even not by hiding the edge of the storing part 83A.

Also, the belt shaped power net 93 as the raw fabric that has expansion and contraction is sewn over the center part 82Ab of the outer edge that is pressed with steam iron from the reverse side at the condition that it was shrunk to the Length direction, therefore the upper part 82A of the outer edge of the L pocket 82 also gets pulls to the front center FC direction when the elongating part 83B moves to the direction that it is pulled out of the storing part 83A after the waist area stretches by the structure that is capable of expansion and contraction around waist area, however, the center part 82Ab of the outer edge as mentioned above is made to be the structure that is capable of expansion and contraction, so it smoothly stretches and follows. Therefore the outward appearance can not be lost by wrinkling as presence around the L pocket 82.

And when the force that tries to stretch around waist area is released, the elongating part 83B again moves to the direction that is to be stored inside the storing part 83A by the rubber tape 90 as the primary elastic material that the both edges are connected between the elongating part 83B and the storing part 83A, however, also at this occasion, the center part 82Ab of the outer edge of the L pocket smoothly shrinks and follows because of the structure that is capable of expansion and contraction and finely returns to the existed condition. Thus, regarding the cotton pants 81 as a pair of pants with the L pocket that is the result of this the twelfth embodiment, it made possible to add the structure that is capable of expansion and contraction around waist area to a pair of pants with the L pocket which was thought to be impossible by the simple structure.

Thus, regarding the cotton pants 81 which is the result of this the twelfth embodiment, the strength of the saccate cloth 85 of the L pocket 82 is kept to be able to resist wearing for long period of time and repeating laundering and also the beauty will not be lost by that the L pocket area going tight when wearing it.

In addition, regarding also the cotton pants 81 which is the result of this the twelfth embodiment, as well as the cotton pants 1B which is the result of the second deformation example of the first embodiment that is indicated in FIG. 6*a*, the piping can be conducted at the upper edge of the cuff part of the front center FC side of saccate cloth 85 of The L pocket 82. Thus, the resistance of when the elongating part 83B moves lowers and the waist area stretches by conducting the piping also at the upper edge of the saccate cloth 85, moreover the upper edge of the saccate cloth 85 strengthens and the outward appearance of the reverse side when the cotton 81 is displayed on the shelf as a merchandise can be improved.

Next, it is to explain regarding the sewing process of saccate cloth of the L pocket of the cotton pants as a pair of pants with the L pocket which is the result of the first deformation example of this the twelfth embodiment referring to FIG. 28. The sewing process of saccate cloth of the L pocket that is the result of the first deformation example of this the twelfth embodiment is the same as the sewing process of saccate cloth 85 of the L pocket 82 that is indicated in the FIG. 26. What differs is that the divided part that the piping is conducted is slid to inner from the cuff part of the front center side of the saccate cloth.

Figure 28A:
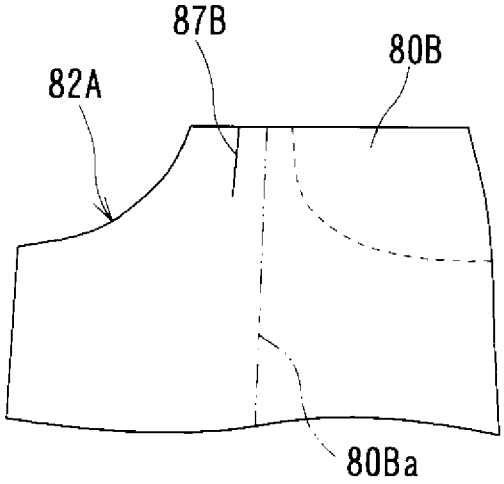
FIG. 28*a*, FIG. 28*b*, FIG. 28*c* and FIG. 28*d* are the diagrams which indicate the sewing processes of saccate cloth of the L pocket of the cotton pants as a pair of pants with the L pocket which is the result of the first deformation example of the twelfth embodiment of this invention.
Figure 28B:
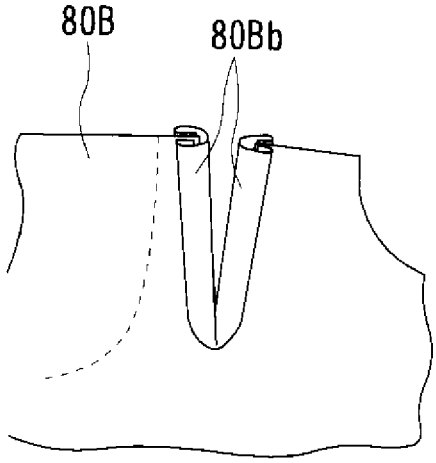

That is, as indicated in FIG. 28*a*, the slit 87B as the divided part is done from the upper part at the position that is slid approximately 7 mm from the cuff part 80Ba of the raw fabric 80B of the saccate cloth 85B. Next, as indicated in FIG. 28 *b*, the piping 80Bb is conducted while the slit 87B of the raw fabric 80B of this saccate cloth 85B is expanded and the bias cloth which becomes the material that forms the piping 80Bb is supplied by the exclusive sewing machine for the piping.

Figure 28C:
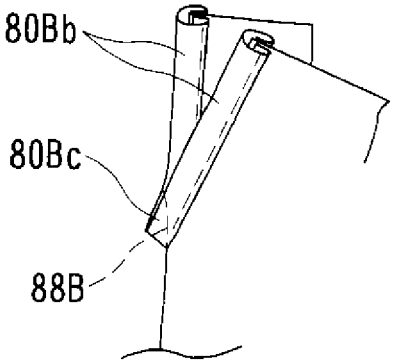
Figure 28D:
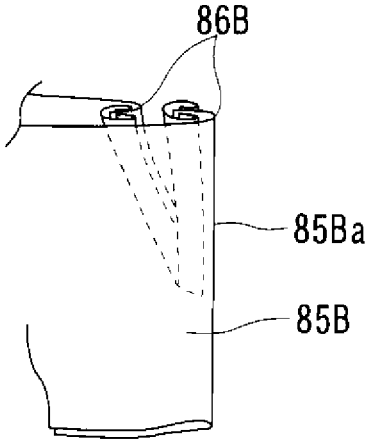

Next, as indicated in FIG. 28*c*, the pick sewing 88B is conducted to the cuff part 80Bc of the Lower edge of the piping 80Bb, as indicated in FIG. 28*d*, the whole raw fabric 80B of the saccate cloth 85B is turned over to make the part which the pick sewing is conducted come inside and sewn on the lower edge of the raw fabric 80B of the saccate cloth 85B and the edge of the other side. Thus, the saccate cloth 85B that is the result of the first deformation example of this the twelfth embodiment is sewn.

Due to this, the finally formed piping part will not be frayed even the force works by wearing for a long period of time and repeating laundering because that the cuff part 80Bc of the Lower edge of the piping 80Bb gets strengthened by that the saccate cloth 85B is sewn after the cuff part 80Bc is conducted pick sewing 88B and turned over. Also, because of positioning the position of piping part 86B slid by approximately 7 mm from the cuff part 85Ba of the saccate cloth 85B that is the portion of the width of the piping 80Bb, the piping becomes hid and invisible, therefore the beauty of the reverse side when displayed on shelf as merchandise improves.

Then the upper part of the edge close to the front center FC of saccate cloth 85B is divided by the slit 87B and the piping 80Bb is conducted at the divided part 87B, therefore only inside the piping part 86B of the upper edge of the saccate cloth 85B gets pulled accompanied by rubbing and moving of the elongating part 83B but the left edge of the front bodice 84 that the outer side of the piping part 86B of the upper edge of saccate cloth 85B does not get pulled, so this part does not go tight and it can keep fine outward appearance even seeing from the front side.

Next, it is to explain regarding the sewing process of the saccate cloth of the L pocket of the cotton pants as a pair of pants with the L pocket which is the result of the second deformation example of this the twelfth embodiment referring to FIG. 29. The saccate cloth 85C of the L pocket which is the result of the second deformation example of this the twelfth embodiment differs from the mentioned above saccate cloth 85 and 85B and it is not sewn from one piece of raw fabric, but sewn two pieces of raw fabrics by connecting them.

Figure 29A:
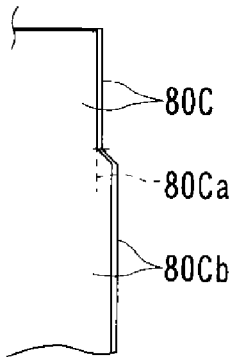
FIG. 29*a*, FIG. 29*b*, FIG. 29*c*, FIG. 29*d*, and FIG. 29*e* are the diagrams which indicate the sewing processes of saccate cloth of the L pocket of the cotton pants as a pair of pants with the L pocket which is the result of the second deformation example of the twelfth embodiment of this invention.
Figure 29B:
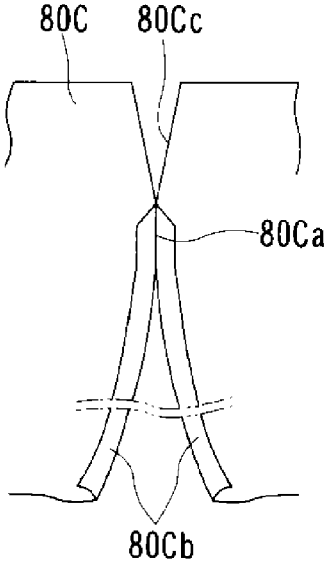
Figure 29C:
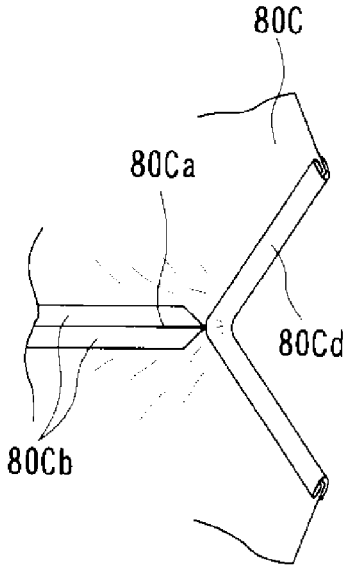

That is, as indicated in FIG. 29*a*, the edges of raw fabrics 80C of two pieces of saccate cloth which has projected part 80Cb are combined and sewn on by the stitch 80Ca at approximately 1 cm from the top of the projected part 80Cb and as indicated in FIG. 29*b*, the divided part 80Cc is expanded, as indicated in FIG. 29*c*, the bias cloth which is to be the material to form the piping 80Cd is supplied by the exclusive sewing machine for piping at the divided part 80Cc and piping 80Cc is conducted.

Figure 29D:
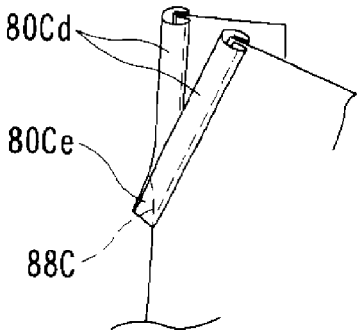
Figure 29E:
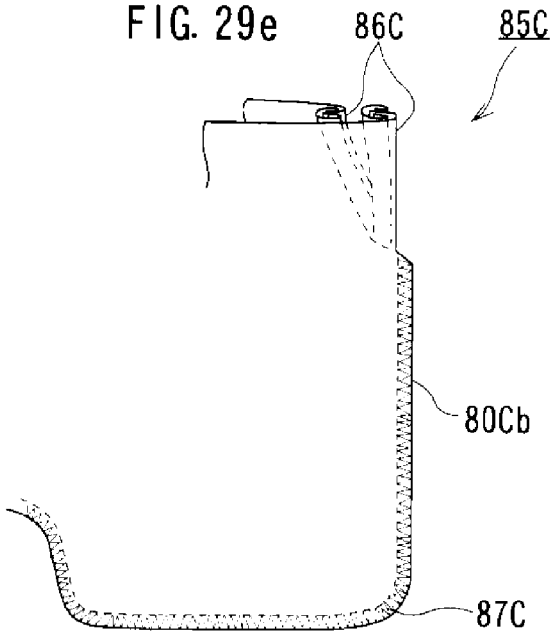

Next, as indicated in FIG. 29*d*, pick sewing 88C is conducted at the cuff part 80Ce of the lower edge of the piping 80Cd and as indicated in FIG. 29*e*, the whole raw fabric 80C of the saccate cloth 85C are turned over to make the part that the pick sewing is conducted come inside and the lower edge of the raw fabric 80C of the saccate cloth 85C and the edge of the other side are sewn together over the projected part 80Cb by locking sewing machine (To interlock).

Thus, the saccate cloth 85C which is the result of the second deformation example of this the twelfth embodiment is sewn and lock management 87C is conducted not only the piping part 86C which is formed but also the lower edge of the saccate cloth 85C and the other side, therefore it becomes a robuster saccate cloth 85C.

Next, it is to explain regarding the sewing process of the saccate cloth of the L pocket of the cotton pants as a pair of pants with the L pocket which is the result of the third deformation example of this the twelfth embodiment referring to FIG. 30. The saccate cloth 85D of the L pocket which is the result of the third deformation example of this the twelfth embodiment is sewn by connecting two raw fabrics, but it differs from the saccate cloth 85C that the piping is conducted first before connecting together.

Figure 30A:
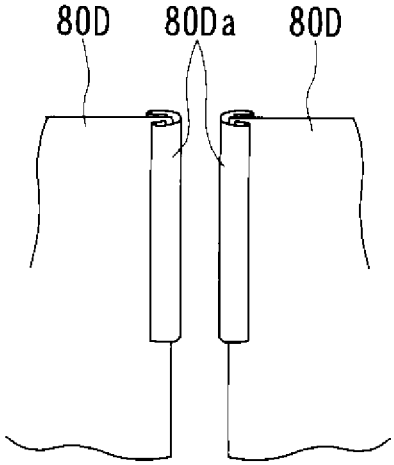
FIG. 30*a*, FIG. 30*b*, FIG. 30*c* and FIG. 30*d* are the diagrams which indicate the sewing processes of saccate of the L pocket of the cotton pants as a pair of pants with the L pocket which is the result of the third deformation example of the twelfth embodiment of this invention.

That is, as indicated in FIG. 30*a*, First, the bias cloth that is to be the material that forms the piping 80Da is supplied at each edge of raw fabric 80D of two pieces of saccate cloth by the exclusive sewing machine for piping and the piping is conducted.

Figure 30B:
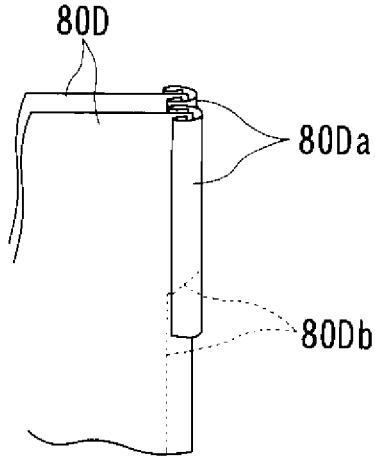

Next, as indicated in FIG. 30*b*, piping 80Da of raw fabric 80D of these two pieces of saccate cloth are combined and while sewing on the lower part of piping 80D one another, and connected by stitch 80Db.

Figure 30C:
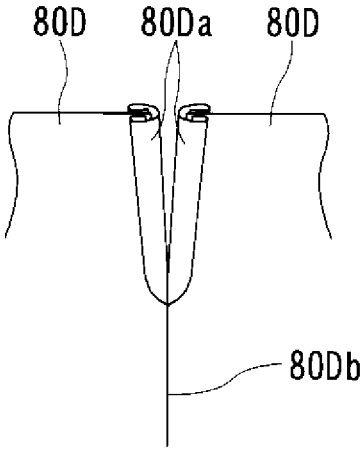
Figure 30D:
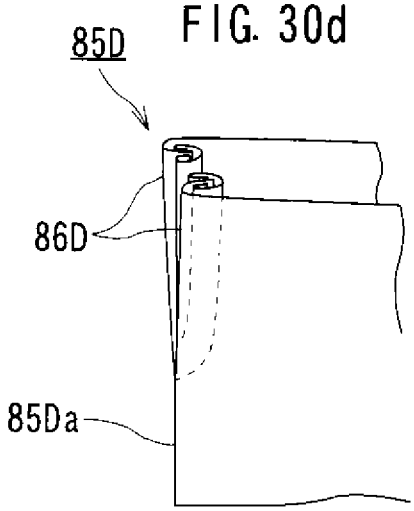

Then, as indicated in FIG. 30*c* and FIG. 30*d*, while raw fabric 80D of two pieces of saccate cloth are turned over to make piping 80Da places inside, the lower edge of raw fabric 80 of saccate cloth 85D and the edge on the other side are sewn together. Thus, the saccate cloth 85D that is the result of the third deformation example of this the twelfth embodiment is sewn.

Next, it is to explain regarding sewing process of the saccate cloth of the L pocket of the cotton pants as a pair of pants with the L pocket which is the result of the fourth deformation example of this the twelfth embodiment referring to FIG. 31. The saccate cloth 85E of the L pocket which is the result of the fourth deformation example of this the twelfth embodiment is sewn by connecting two pieces of raw fabrics, but it differs from saccate cloth 85C and the patch cloth 89 is sewn on at one side of raw fabric 80E of two pieces of saccate cloth in advance.

Figure 31A:
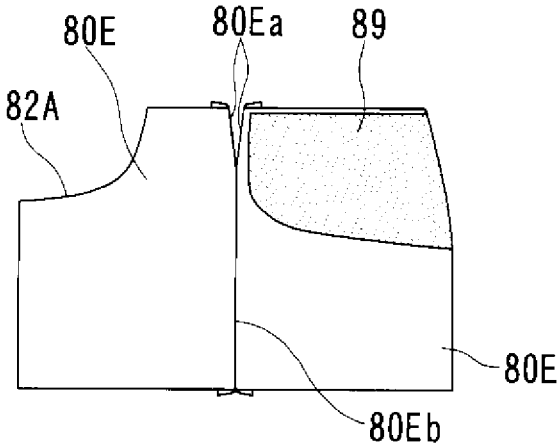
FIG. 31*a*, FIG. 31*b*, FIG. 31*c*, FIG. 31*d* and FIG. 31*e* are the diagrams which indicate the sewing processes of saccate of the L pocket of the cotton pants as a pair of pants with the L pocket which is the result of the fourth deformation example of the twelfth embodiment of this invention.

That is, as indicated in FIG. 31*a*, the patch cloth 89 is sewn on at one side of raw fabric 80E of two pieces of saccate cloth in advance and the outer edge 82 A of the L pocket is formed at the other side. The raw fabrics 80E of these two pieces of saccate cloth are sewn together along with the joint 80Eb and the upper part 80Ea is left unsewn as divided part.

Figure 31B:
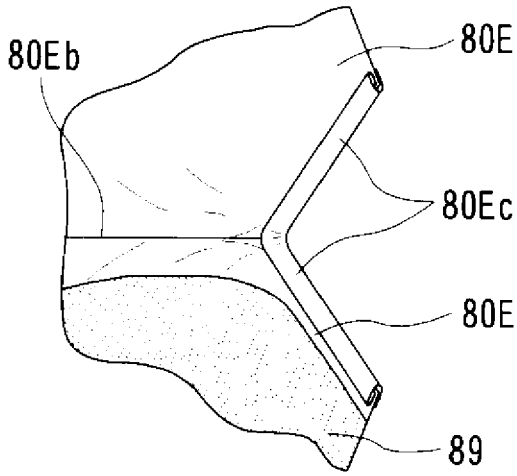

Next, as indicated in FIG. 31*b*, while expanding this divided part 80Ea, the bias cloth that is to be the material to form piping 80Ec by making use of exclusive sewing machine for piping and the piping 80Ec is conducted.

Figure 31C:
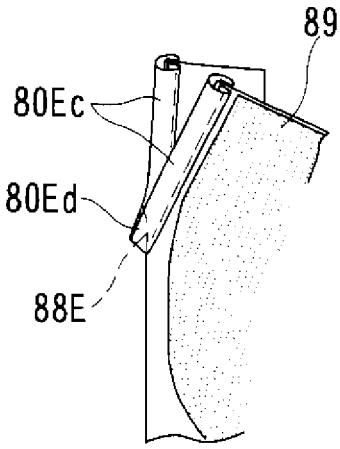
Figure 31D:
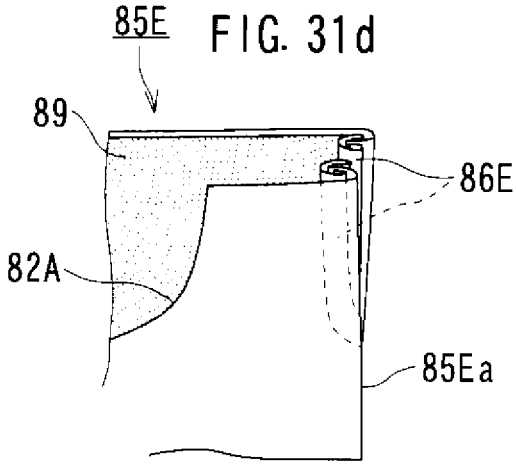

Next, as indicated in FIG. 31*c*, the pick sewing 88E is conducted at the cuff part 80Ed of the lower edge of piping 80Ec, and as indicated in FIG. 31*d*, the whole raw fabric 80E of saccate cloth 85E is turned over as the part that the pick sewing 88E was conducted comes inside and the lower edge of the raw fabric 80E of the saccate cloth 85E and the edge of the other side are sewn together. Thus, the saccate cloth 85E that is the result of the fourth deformation example of this the twelfth embodiment is sewn.

Figure 31E:
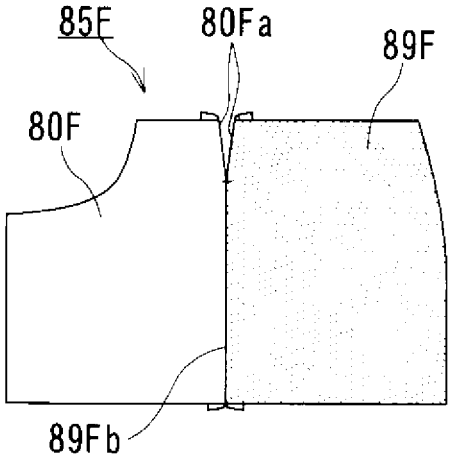

In addition, as indicated in FIG. 31*e*, it can make to be saccate cloth 85F by sewing together by the same sort of procedure by making use of raw fabric 89F that is common of the front bodice of the cotton pants as a pair of pants with the L pocket at one side of raw fabric of two pieces of saccate cloth.

Thirteenth Embodiment

Next, it is to explain regarding a pair of pants with the L pocket that is the result of the thirteenth embodiment of this invention referring to FIG. 32.

Figure 32A:
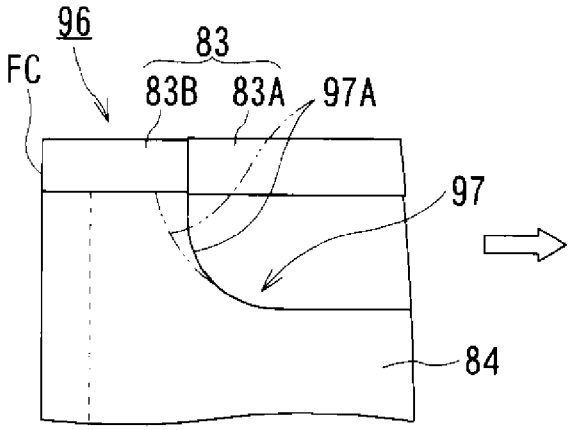
FIG. 32*a* is the partial enlarged drawing that indicates the condition that the left L pocket of the cotton pants as a pair of pants with the L pocket which is the result of the thirteenth embodiment of this invention and waist area near that are shrunk.

FIG. 32*a* is the partial enlarged drawing that indicates the condition that the left L pocket of the cotton pants as a pair of pants with the L pocket which is the result of the thirteenth embodiment of this invention and waist area near that are shrunk.

Figure 32B:
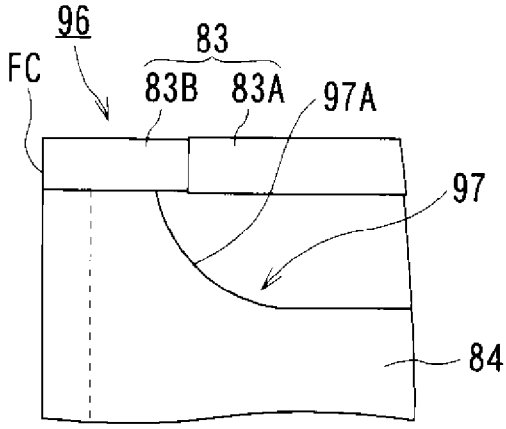
FIG. 32*b* is the partial enlarged drawing that indicates the condition that the waist area is stretched.

FIG. 32*b* is the partial enlarged drawing that indicates the condition that the waist area is stretched.

Figure 32C:
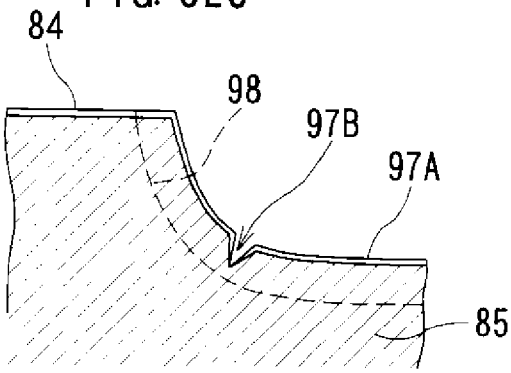
FIG. 32*c* and FIG. 32*d* are the diagrams which indicate the manufacturing procedure of the expansion and contraction structure of the outer edge of the left L pocket seeing from the front side.
Figure 32D:
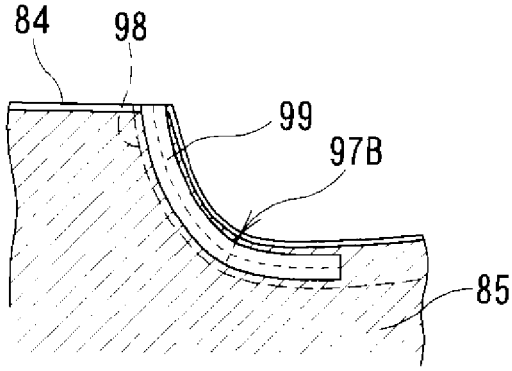

FIG. 32*c* and FIG. 32*d* are the diagrams which indicate the manufacturing procedure of the expansion and contraction structure of the outer edge of the left L pocket seeing from the front side.

Figure 32E:
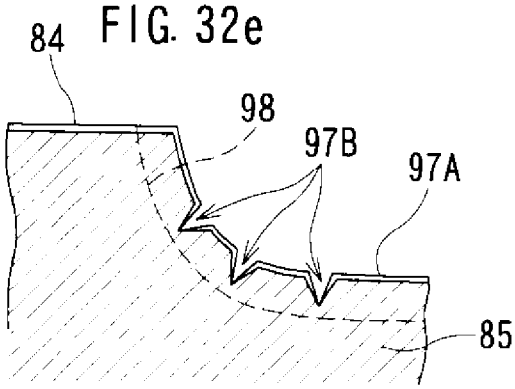
FIG. 32*e* is a diagram which indicates the expansion and contraction structure of the outer edge of the left L pocket of the cotton pants which is the result of the deformation example of the thirteenth embodiment of this invention seeing from the front side.
Figure 33A:
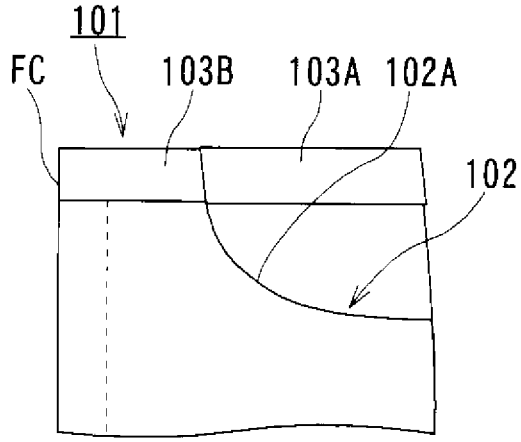
FIG. 33*a* is the partial enlarged drawing shown from the front indicating around the L pocket of pants which has The L pocket adopted structure which is capable of expansion and contraction of waist size.
Figure 33B:
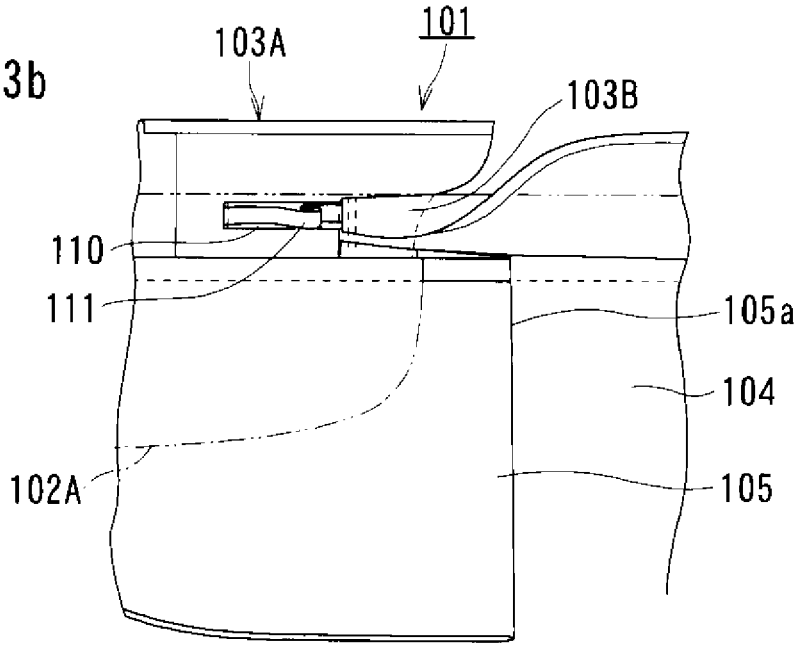
FIG. 33*b* is partial enlarged drawing shown from reverse indicating around the L pocket before sewing on the elongating part.
Figure 33C:
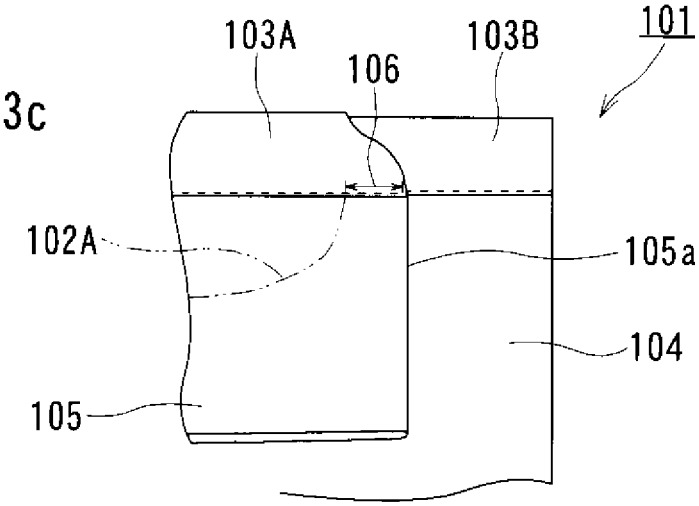
FIG. 33*c* is partial enlarged drawing shown from reverse indicating around The L pocket after sewing on the elongating part and the storing part.

FIG. 32*e* is a diagram which indicates the expansion and contraction structure of the outer edge of the left L pocket of the cotton pants which is the result of the deformation example of the thirteenth embodiment of this invention seeing from the front side.

The cotton pants 96 as a pair of pants with the L pocket which is the result of this the thirteenth embodiment is, as well as the cotton pants 81 as a pair of pants with the L pocket which is the result of the twelfth embodiment, has the right and the left paired the L pocket 97 near the belt part 83 of the front bodice and has the structure which is capable of expansion and contraction around waist area that is capable of expansion and contraction on apparent length of the belt part 83 near the part (the upper part of the outer edge 97A) close to the front center FC of the outer edge 97A of the pocket entrance of these L pocket 97.

That is, as well as the twelfth embodiment, the doubled part that is made of the storing part 83A and the elongating part 83B which is to be inserted inside the storing part 83A near the outer edge 97A of the pocket entrance of the right and left paired the L pocket 97 at the belt part 83 and the apparent length is to be capable of expansion aid contraction of the belt part 83 by that the edge of the elongating part 83B and the storing part A are connected by the rubber tape 90 as the primary elastic material inside the storing part 83A. Then it is the same as the cotton pants 81 which is the result of the twelfth embodiment regarding the piping part 86 is applied while the upper edge of the edge part 85*a* of the saccate cloth 85 of the L pocket 97 is divided.

Due to this, in case of that the pulling force is not applied at the belt part 83, as indicated in FIG. 32*a*, the upper part of the outer edge 97A of the L pocket 97 is corresponded to the edge of the storing part 83A. When the waist area stretches by that the belt part 83 gets pulling force, as indicated in FIG. 32*b*, the upper part of the outer edge 97A of The L pocket 97 moves together with the elongating part 83B and the outer edge 97A of The L pocket 97 smoothly deforms without occurring wrinkles etc. around the L pocket 97. This is because the outer edge 97A of the L pocket 97 has expansion and contraction.

It is to explain regarding the sewing method that to make the outer edge 97A of this the L pocket 97 have expansion and contraction referring to FIG. 32*c* and FIG. 32*d*.

First, as indicated in FIG. 32*c*, the raw fabric 85 of the saccate cloth that is cut by adjusting to the form of the outer edge 97A of the L pocket 97 is sewn on to the front side of the front bodice 84 of the cotton pants 96 by the plain seaming 98.

Next, the slit 97B is set at the center part of the outer edge 97A and as indicated in FIG. 32*d*, the belt shaped power net 99 as the raw fabric that has expansion and contraction over the center part of the outer edge at the condition that the slit 97B of the center part of the outer edge is shrunk while the upper part of the outer edge 97A is put perpendicularly is sewn along with the seam of the plain seaming 98.

In addition, regarding the thirteenth embodiment, the operation to cut off the edge of the outer edge 97A is not necessary as the twelfth embodiment because the margin for a seam of the plain seaming 98 is taken small as 0.5 cm, however, the method to cut off the edge of the outer edge 97A can be taken after sewing on the belt shaped power net 99 while the margin for a seam is taken as 1.0 cm as well as the twelfth embodiment.

And then, as well as indicated in FIG. 27*e* of the twelfth embodiment, the saccate cloth 85 is to be folded over at the part of the plain seaming 85 and the saccate cloth 85 to be turned over to the other side that is to the reverse side of the cotton pants.

And as indicated in FIG. 27*f*, the structure of the L pocket 97 that the center part of the outer edge is capable of expansion and contraction by stitching the double stitch 82*a* long with the outer edge 97A of new L pocket 97.

Thus, regarding the thirteenth embodiment, it is to be the L pocket that the center part of the outer edge 97A is capable of expansion and contraction by setting the slit 97B at the center part of the outer edge, therefore the process that to press with steam iron as the twelfth embodiment can be omitted and it can make the outer edge 97A of the L pocket 97 have expansion and contraction much easier and much shorter of time. In addition, the slit 97B is not limited to one, as indicated in FIG. 32*e*, the belt shaped power net 99 as the raw fabric that has expansion and contraction can be sewn along with the seam of the plain seaming 98 over the center part of the outer edge at the condition that three slit 97B are shrunk after setting the slit 97B at the three parts.

Due to this, when the elongating part 83B moves to the direction that the storing part 83A is pulled out while the waist area stretches by the structure that is capable of expansion and contraction around the waist area, the upper part 97A of the outer edge of the L pocket 97 also gets pulled to the direction of the front center FC, however the center part 97A of the outer edge as mentioned above is made as the structure of that is capable of expansion and contraction, therefore it smoothly stretches and follows and the outward appearance can not be lost by wrinkling as the present around the L pocket 97.

And when the force that tries to stretch the waist are is released, the elongating part 83B again moves to the direction that is stored inside the storing part 83A by the rubber tape 90 as the primary elastic material that the both edges are connected between the elongating part 83B and the storing part 83A, however at this occasion, the center part 97A of the outer edge of the L pocket 97 smoothly shrinks and follows because it is made as structure that is capable of expansion and contraction and returns to the existed condition. Thus, regarding the cotton pants 96 as a pair of pants with the L pocket which is the result of this the thirteenth embodiment, it made possible to add the structure that is capable of expansion and contraction around waist area to a pair of pants with the L pocket which was presently thought to be impossible by the simple structure.

Due to this, regarding the cotton pants 96 as a pair of pants with the L pocket which is the result of this thirteenth embodiment, the beauty would not be lost by that the L pocket 97 area goes tight when wearing it while it resists wearing for a long period of time and repeating laundering and keeps the intensity of the saccate cloth 85 of The L pocket.

That is all to explain regarding the each enforced composition of a pair of pants with the L pocket which is the result of this invention, however moreover, these each enforced composition can be applied to a pair of pants with the L pocket which is the result of this invention at the same time in the capable range. For example, the structure of a pair of pants with the L pocket which is the result of the mentioned above the seventh embodiment to the twelfth embodiment can also be combined to a pair of pants with the L pocket which is the result of the mentioned above the first embodiment to the sixth embodiment and the structure of a pair of pants with the L pocket which is the result of the mentioned above the twelfth embodiment also can be combined to a pair of pants with the L pocket which is the result of the mentioned above sixth embodiment to the eleventh embodiment.

Regarding each of the mentioned above embodiment, the storing part and the elongating part that are all made of the common fabric of the front bodice of a pair of pants with the L pocket and also only the example that was made to be the structure that is folded at the upper edge of the belt part while the both front and reverse sides of the storing part and the elongating part are connected are explained, however the structure of the storing part and the elongating part is not limited to this.

For example, it can also make to be the structure that the both raw fabrics are connected at the upper edge of the belt part while stating only the front side of the storing part and the elongating part as the common fabric of the front bodice and stating the reverse side of the storing part and the elongating part as different raw fabric. Hereupon, the structure that makes use of a marbelt at the reverse side of the elongating part by stating the reverse side of the storing part marbelt regarding the other raw fabric that structures the reverse side of the storing part and the elongating part and the structure that makes use of the raw fabric that has expansion and contraction such as power net or rubber raw fabric by stating the reverse sides of the storing part and the elongating part are united can be considered. Also the reverse side of the storing part to be manufactured as common fabric as the front bodice while the rubber raw fabric is made use of at the reverse side of the elongating part or the structure that to be the marbelt can be adopted.

Also, regarding the each embodiment mentioned above, it was explained for the occasion the right and the left pockets of the fore of a pair of pants with the L pocket are all the L pockets, however it is regardless even if the one side of the right and left pockets is the L pocket and the other is a different pocket such as underarm pocket. Also, regarding the each embodiments mentioned above, it is mainly explained about the example of the cotton pants as a pair of pants with the L pocket, however it can be applied to any kind of garment regardless to casual a pair of pants or a pair of pants which is not casual if it is a pair of pants which has the L pocket including chino pants that is one kind of cotton pants and Jeans.

Moreover regarding each embodiment mentioned above, it was explained only the case that the rubber tape is made use of as the primary elastic material, however the material that has various elasticity besides such as flat rubber and rubber made plate as the primary elastic material can be made use of.

When enforcing this invention, it is not limited to each embodiment mentioned above regarding the structure, the form, the material, the raw fabric, the size, the length, the width and the connection etc. In addition to that, the numerical value which is mentioned in the embodiment of this invention is not anything to indicate a critical value, but is to indicate the appropriate value that is suitable for enforcement, therefore it is not anything to deny the enforcement even though the mentioned above numerical value is changed a little.

The invention claimed is:

1. A pair of pants comprising a L pocket, a belt section having a padding material, a primary elastic material connected to the belt section and a structure to enable the belt section to expand and contract around a waist defined by the belt section so that an apparent length of the belt section is allowed to increase and decrease by the primary elastic material:

the belt section comprising:

a doubled section essentially consisting of two sections, the doubled section being positioned near an upper part of an outer edge part of the L pocket, while the outer edge part of the L pocket is located at a side the pants;

a storing section defining one of the two sections of the doubled section, the storing section having an inner sheet and an outer sheet so as to form an inside space therein, and the primary elastic material being provided at the inside space of the storing section, the storing section having an opening end of the inner sheet and an opening end of the outer sheet formed into a vertical line, respectively, so as to be substantially perpendicular to a longitudinal direction of the belt section;

an elongating section defining an other of the two sections of the doubled section, the elongating section having one longitudinal portion inserted in the inside space of the storing section so as to be covered by the storing section, the elongating section having an other longitudinal portion protruded from the storing section, the primary elastic material having one longitudinal end fixed on the storing section and an other longitudinal end fixed on the elongating section, and the elongating section being connected to the storing section via the primary elastic material so that the elongating section is movable to allow the belt section to expand and contract; and an inner structure provided inside the belt section to raise the elongating section when the elongating section is pulled out from the storing section, the inner structure having a diagonal stitch formed at the other longitudinal end of the primary elastic material to fix the other longitudinal end of the primary elastic material on the elongating section, wherein the one longitudinal end of the primary elastic material has a second stitch parallel to the vertical line of the storing section and is fixed on the storing section by the second stitch, wherein the diagonal stitch is formed in an inclined manner to the vertical line of the storing section to fix the other longitudinal end of the primary elastic material at an edge part of the elongating section, wherein a first length defined between an upper end of the second stitch at the one end of the primary elastic material and an upper end of the diagonal stitch at the other end of the primary elastic material is set smaller than a second length defined between a lower end of the second stitch at the one end of the primary elastic material and a lower end of the diagonal stitch at the other end of the primary elastic material, and wherein the primary elastic material has an upper edge part shorter than a lower edge part thereof between the diagonal stitch and the second stitch so that the elongating section is pulled out of the storing section in a raised manner.

2. A pair of pants according to claim 1, further comprising an adhesive cloth padding fixed inside the storing section, the one end of the primary elastic material being sewn on the adhesive cloth padding.

3. A pair of pants according to claim 1, wherein the one longitudinal portion of the elongating section has an end cut diagonally corresponding to an inclined angle of the diagonal stitch.

* * * * *